US006890705B2

(12) United States Patent
Miyake et al.

(10) Patent No.: US 6,890,705 B2
(45) Date of Patent: May 10, 2005

(54) SILVER HALIDE PHOTOSENSITIVE MATERIAL AND IMAGE-FORMING METHOD USING SAME

(75) Inventors: Kiyoteru Miyake, Kanagawa-ken (JP); Masahiro Asami, Kanagawa-ken (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/152,629

(22) Filed: May 23, 2002

(65) Prior Publication Data

US 2003/0118952 A1 Jun. 26, 2003

(30) Foreign Application Priority Data

May 23, 2001 (JP) ..... 2001-154549
Jul. 17, 2001 (JP) ..... 2001-217314

(51) Int. Cl.[7] ..... G03C 1/498; G03C 1/00; G03C 5/16; G03C 1/34

(52) U.S. Cl. ..... 430/350; 430/503; 430/506; 430/505; 430/543; 430/567; 430/571; 430/600; 430/611; 430/619; 430/620

(58) Field of Search ..... 430/620, 619, 430/567, 350, 506, 571, 503, 600, 611, 603, 543, 505

(56) References Cited

U.S. PATENT DOCUMENTS 4,451,555 A * 5/1984 Pollet et al. ..... 430/445
5,840,475 A * 11/1998 Levy et al. ..... 430/619
5,958,668 A * 9/1999 Matsumoto et al. ..... 430/619
6,280,913 B1 * 8/2001 Irving et al. ..... 430/496
6,500,590 B2 * 12/2002 Irving et al. ..... 430/21

FOREIGN PATENT DOCUMENTS

EP 1113316 4/2001

* cited by examiner

*Primary Examiner*—Thorl Chea
(74) *Attorney, Agent, or Firm*—Sughrue Mion, PLLC

(57) ABSTRACT

The second silver halide photosensitive material comprises a substrate and at least one photosensitive silver halide emulsion layer formed thereon, the silver halide photosensitive material comprising at least two types of silver halide grains with different projected areas having photosensitivity in the same spectral range; silver halide grains having a larger projected area having a refractive index n1 and an average thickness a, and silver halide grains having a smaller projected area having a refractive index n2 and an average thickness b; and the silver halide grains satisfying the conditions defined by the following equation (1):

$$n2 \leqq n1, \text{ and } a \leqq b \times (n2/n1) \quad (1).$$

26 Claims, No Drawings

SILVER HALIDE PHOTOSENSITIVE MATERIAL AND IMAGE-FORMING METHOD USING SAME

FIELD OF THE INVENTION

The present invention relates to a silver halide photosensitive material suitable for shooting with high sensitivity and excellent sharpness, and to a method using the silver halide photosensitive material for easily and rapidly forming an image without a photographic processing solution.

BACKGROUND OF THE INVENTION

Widely used nowadays as silver salt photographic systems using silver halide photosensitive materials are black and white photographic systems in which silver halide grains are reduced by a developing agent to provide developed silver for forming an image, and color photographic systems in which an aromatic primary amine developing agent is converted to an oxidized form by a development reaction, and a dye is formed by the coupling reaction of the oxidized developing agent with a color coupler is utilized for forming a dye image. However, the silver halide photosensitive materials need a particular processor and careful control for processing, resulting in limited facilities for use. The reasons are as follows: (i) processing solutions used for color developing, bleaching and fixing in the color processing steps should be precisely controlled with respect to the composition and temperature, thereby requiring professional knowledge and technical skills; (ii) these processing solutions contain chemical substances, such as a color-developing agent and an iron chelate compound as a bleaching agent, whose drainage needs regulations from the viewpoint of environment protection, whereby a developing apparatus should be accompanied by a special facility for disposing them; and (iii) despite the recent development of technology contributing to reducing the processing time, the processing of the silver halide photosensitive materials still takes a long time, failing to achieve sufficiently rapid image forming.

A thermal development photographic system in which an image is formed by heating is known as a photographic system using no processing solution comprising a color-developing agent. Heat-developable photosensitive materials utilizing thermal development for image forming and image-forming methods using them are disclosed in U.S. Pat. Nos. 3,152,904 and 3,457,075; D. Klosterboer, "Thermally Processed Silver Systems"; J. Sturge, V. Walworth; and A. Shepp, "Imaging Processes and Materials"; Neblette, Edition 8, Chapter 9, pages 279, 1989, etc. The heat-developable photosensitive material generally comprises a non-photosensitive silver source that can be reduced in development, such as an organic silver salt, a catalytic amount of a photocatalyst such as a silver halide, and a silver-reducing agent, each of which is dispersed in an organic binder matrix. Such a heat-developable photosensitive material is stable at room temperature, and forms a silver image by a redox reaction between an oxidant for the silver source and the reducing agent, when it is heated at such a high temperature as 80° C. or more after exposure. The redox reaction is accelerated by catalytic reactivity of a latent image, which is formed by exposure. The silver formed in the exposed region turns black, making a contrast with the unexposed region thereby forming image.

There have been many proposals regarding methods for forming a color image by thermal development. For example, U.S. Pat. No. 4,559,290 discloses a method in which an oxidation product with no dye-releasing ability formed from a dye-releasing redox compound (DRR compound) is used with a reducing agent or a precursor thereof, the reducing agent being oxidized by thermal development depending upon an exposure amount of the silver halide, and the oxidation product of the DRR compound being reduced by the remaining un-oxidized reducing agent to release a diffusible dye. European Laid-Open Patent Application No. 220746A and Kokaigiho (Journal of Technical Disclosure), No. 87-6199, Vol. 12, No. 22 disclose heat-developable color photosensitive materials using a compound releasing a diffusible dye by the reductive cleavage of N-X bond in which X is an oxygen atom, a nitrogen atom or a sulfur atom, in place of the oxidation product of the DRR compound.

The well-known heat-developable color photosensitive material 110 utilizes a coupling reaction between a coupler and an oxidation product of a developing agent. These materials are disclosed in U.S. Pat. Nos. 3,761,270 and 4,021,240, Japanese Patent Laid-Open Nos. 59-231539 and 60-128438, etc. Generally, the coupler absorbs no visible light before color processing. Therefore, such heat-developable color photosensitive materials utilizing the coupling reaction have advantages in sensitivity as gin compared with the photosensitive materials using the above-mentioned DRR compound, so that they can be used not only as a printing material, but also as a photosensitive material for shooting.

Japanese Patent Laid-Open No. 10-260518 discloses color photosensitive materials for shooting utilizing a coupling reaction. These color photosensitive materials are attached to a processing element having a base precursor coated on a support using a small amount of water, and then subjected to heat development. However, the color photosensitive material requires the processing element and water, resulting in disadvantage in the reduction in size and simplification of the processor. Thus, expectations are high for complete dry-processing type, photosensitive materials for shooting, which are used without the processing element and water.

Japanese Patent Laid-Open No. 2000-171961 discloses complete dry-processing, mono-sheet-type, heat-developable, color-photosensitive materials and an image-forming method using such materials. However, in the case in which a photosensitive layer comprising gelatin, an organic silver compound, silver halide, a developing agent, etc. is coated on a PET base and heat-developed at 140° C. for 10 seconds in accordance with the method, the resultant image is high in haze and poor in granularity if a normal scanner is used.

Thus, the above conventional thermal developing methods fail to achieve both of sufficiently high sensitivity for shooting and low density and turbidity suitable for rapidly reading image with high quality by a scanner after developing.

OBJECT OF THE INVENTION

An object of the present invention is to provide a silver halide photosensitive material that is high in sensitivity and can form a high-quality image easily and rapidly, so that the image can be rapidly read by a scanner with high quality even in a case where residual silver halide is existent in the silver halide photosensitive material.

SUMMARY OF THE INVENTION

As a result of intense research in view of the above object, the inventors have found that a silver halide photosensitive material using a photosensitive silver halide having a particular silver chloride content in combination with a heterocyclic silver salt compound and a heterocyclic mercapto compound, and a silver halide photosensitive material comprising plural kinds of silver halide grains having photosensitivity in the same spectral range and different projected area, in which the silver halide grains satisfy particular conditions of a refractive index and thickness, can easily and rapidly form a high-quality image with high sensitivity. The present invention has been accomplished by this finding.

Thus, the first silver halide photosensitive material of the present invention comprises a substrate and at least one photosensitive silver halide emulsion layer formed thereon, the photosensitive silver halide emulsion layer comprising a silver halide emulsion comprising silver halide grains, a silver salt of a benzotriazole compound, a mercaptotetrazole compound, and a reducing agent, the silver chloride content of the silver halide grains being 50 mole % or more, a molar ratio of the silver salt of a benzotriazole compound to the silver halide grains being 1 mole % or more, and a molar ratio of the mercaptotetrazole compound to the silver halide grains being 0.1 mole % or more.

In the first silver halide photosensitive material, the mercaptotetrazole compound is preferably a silver salt of 1-phenyl-5-mercaptotetrazole or 1-alkyl-5-mercaptotetrazole. At least 50% of a projected area of the silver halide grains is preferably occupied by tabular silver halide grains having an average thickness of 0.2 $\mu$m or less and a major crystal face of (111) or (100). It is preferable that the silver halide grains are chemically sensitized by a tellurium compound. Further, the benzotriazole compound preferably has an alkyl group having 1 to 12 carbon atoms.

The second silver halide photosensitive material of the present invention comprises a substrate and at least one photosensitive silver halide emulsion layer formed thereon, wherein the silver halide photosensitive material comprises at least two types of silver halide grains with different projected areas having photosensitivity in the same spectral range; silver halide grains having a larger projected area having a refractive index n1 and an average thickness $\alpha$, and silver halide grains having a smaller projected area having a refractive index n2 and an average thickness b among the at least two types of silver halide grains; and the silver halide grains satisfying the conditions defined by the following equation (1):

$$n2 \leqq n2, \text{ and } a \leqq b \times (n2/n1) \quad (1).$$

In the second silver halide photosensitive material, at least 50% of the projected area of each of the at least two silver halide grains is occupied by tabular silver halide grains having an average aspect ratio of 5 or more and an average thickness of 0.2 $\mu$m or less. It is also preferable that the silver halide grains satisfy the condition defined by the following equation (2):

$$a \leqq b \times (n2/n1)^6 \quad (2).$$

In the second silver halide photosensitive material, n2 is preferably 2.15 or less, and at least two types of silver halide grains are contained preferably in different layers. Further, the silver halide grains having a smaller projected area are preferably tabular silver halide grains having a major crystal face of (100) or (111) and an average aspect ratio of 5 or more. The second silver halide photosensitive material preferably comprises a reducing agent and a silver source that can be reduced by a reducing agent. It preferably comprises a compound forming a dye by a coupling reaction with an oxidation product of the reducing agent.

An object of the present invention is also to provide a complete dry-processing, mono-sheet-type, color photosensitive material that is high in sensitivity and can form a high-quality image easily and rapidly.

The method for forming an image according to the present invention comprises the steps of exposing the first or second silver halide photosensitive material; and heating the exposed photosensitive material at 100 to 200° C. for 5 to 60 seconds to form an image. The image formed on the photosensitive material can be optically read easily to produce a digital image information.

DETAILED DESCRIPTION OF THE PREFERRED EMBODIMENTS

Each of the first and second silver halide photosensitive materials according to the present invention comprises a substrate, and photograph-constituting layers containing at least one photosensitive silver halide emulsion layer. The first and second silver halide photosensitive materials are preferably used as heat-developable photosensitive materials particularly in a case where the photosensitive silver halide emulsion layer comprises a non-photosensitive silver source, a reducing agent, etc. Components in the first and second silver halide photosensitive materials and image-forming methods using the photosensitive materials are described in detail below.

[1] Photograph-Constituting Layers

The photograph-constituting layers comprise at least one photosensitive silver halide emulsion layer comprising a photosensitive silver halide. The photograph-constituting layers may further comprise an intermediate layer, a protective layer, a filter layer, an ultraviolet-absorbing layer, an undercoat layer, etc. The photosensitive silver halide emulsion layer preferably has a thickness of 3 to 30 $\mu$m. The photograph-constituting layers may comprise an organic silver salt that can be reduced on development, a heat (thermal) solvent, a developing agent, a coupler, a binder, etc. The coupler is a compound that forms a dye by a coupling reaction with an oxidation product of a developing agent. The organic silver salt, the heat solvent, the developing agent and the coupler are preferably contained in the silver halide emulsion layer although they may be contained in the other layers such as the intermediate layer. The binder is generally contained in every layer composing the photograph-constituting layers.

(A) Photosensitive Silver Halide

In the first silver halide photosensitive material of the present invention, the photosensitive silver halide emulsion layer comprises a silver halide emulsion comprising silver halide grains, and a silver chloride content of the silver halide grains is 50 mole % or more. The silver chloride content is preferably 80 mole % or more, particularly 95 mole % or more. In a case where image processing is carried out using a computer, etc. without desilvering after the development of a color film, it is generally preferred from the viewpoint of image or color reproduction that the developed film is transparent. The silver chloride content of 50 mole % or more makes the developed film more transparent. The silver halide grains having the silver chloride content of 50 mole % or more are hereinafter referred to as "high-silver chloride grains."

The high-silver chloride grains may comprise silver bromide, silver iodide, etc. These different kinds of silver halide may be uniformly mixed or localized in the high-silver chloride grains. The silver halide grains having different halogen compositions may be formed on the high-silver chloride grains by epitaxial junction. Silver iodide content of the high-silver chloride grains is preferably 0.1 to 20 mole %, more preferably 0.1 to 6 mole %. Such a silver salt as silver rhodanide, silver sulfide, silver selenide, silver carbonate, silver phosphate, a silver salt of a benzotriazole compound, etc. may be dissolved in or deposited on the high-silver chloride grains.

A localized phase having a halogen composition different from that of the high-silver chloride grains may be arranged in the form of a layer or non-layer in the high-silver chloride grains, on the edge or corner thereof, and/or on the surface thereof. It is particularly preferred that the localized phase is deposited on the edge or corner of the silver halide grains by epitaxial junction. In a case where a sensitizing dye is adsorbed onto the high-silver chloride grains, it is preferred that a layer of silver iodobromide is localized on the surfaces of the high-silver chloride grains. The halogen composition of the localized phase may be analyzed by X-ray diffraction, electron microscopy, etc. Composition-analyzing methods using X-ray diffraction are described in C. R. Berry and S. J. Marino, "Photographic Science and Technology," Vol. 2, page 149 (1955), ibid., Vol. 4, page 22 (1957), etc. The halogen composition of the surface of the silver halide grains may be analyzed by X-ray photoelectron spectroscopy (ESCA).

It is preferable that the halogen composition distribution 110 corresponding to the silver bromide content, the silver iodide content and the silver chloride content is narrow among the silver halide grains. The variation coefficient of the halogen composition distribution is preferably 3 to 30%, more preferably 3 to 25%, particularly 3 to 20%. Herein, "variation coefficient" is a value of percentage obtained by dividing the standard deviation of the halogen composition in the silver halide grains by the average value thereof. The halogen composition distribution may be analyzed by an X-ray micro-analyzer (EPMA).

The high-silver chloride grains are preferably used in the form of a monodisperse emulsion with a narrow grain size distribution, although the grains may be used in the form of a polydisperse emulsion with a wide grain size distribution. The monodisperse emulsion is defined as a photosensitive silver halide emulsion having a grain size distribution of 30% or less in terms of a variation coefficient. Applications of the monodisperse emulsion are described in Trevor Maternaghan, Surfactant Science Series, Technological Applications of Dispersions, 52, 373, (1994), etc.

As described in Japanese Patent Laid-Open Nos. I-167743 and 4-223463, two or more kinds of monodisperse emulsions having substantially the same color sensitivity and different grain sizes may be used together to control gradation. Although the monodisperse emulsions may be contained in the same layer, it is preferable that a layer composed of a monodisperse emulsion with a larger grain projected size is arranged above a layer composed of a monodisperse emulsion layer with a smaller grain projected size. The polydisperse emulsion may be used in combination with the other polydisperse emulsion or the monodisperse emulsion.

The second silver halide photosensitive material of the present invention comprises two or more kinds of silver halide grains having the same photosensitivity and different projected areas. Thus, the second silver halide photosensitive material comprises at least two types of silver halide grains with different projected areas having photosensitivity in the same spectral range; silver halide grains having a larger projected area having a refractive index n1 and an average thickness a, and silver halide grains having a smaller projected area having a refractive index n2 and an average thickness b among the at least two types of silver halide grains; and the silver halide grains satisfying the conditions defined by the following equation (1):

$$n2 \leqq n1, \text{ and } a \leqq b \times (n2/n1) \quad (1).$$

In the second silver halide photosensitive material, n1, n2, a and b satisfy the conditions defined preferably by the following equation (2), more preferably by the following equation (3), further preferably by the following equation (4), particularly by the following equation (5):

$$a \leqq b \times (n2/n1)^6 \quad (2),$$

$$a \leqq b \times (n2/n1)^8 \quad (3),$$

$$a \leqq b \times (n2/n1)^{10} \quad (4), \text{ and}$$

$$a \leqq b \times (n2/n1)^{12} \quad (5).$$

In the equations (1) to (5), n2 is preferably 2.15 or less, more preferably 2.10 or less. The second silver halide photosensitive material satisfying the above conditions can exhibit a reduced turbidity when the image information is read by a scanner after the thermal development, to lower the minimum density.

The silver halide grains may be regular crystal grains with no twinning plane, single twinning-plane grains, parallel multiple twin grains, multiple nonparallel twinning-plane grains, mixtures thereof, etc. The silver halide grains may be in a spherical shape, a potato-shape, a tabular shape with a high aspect ratio, etc. It should be noted that the aspect ratio is a ratio of the diameter of a circle equivalent to the projected area of the tabular grain to the thickness thereof. The shape of the silver halide grains may be analyzed by an electron microscope using a carbon replica method utilizing a shadowing treatment with a heavy metal, etc., in which the silver halide grains and a standard referential latex grain are simultaneously observed by a transmission electron microscope.

The shape of the twin-crystal grain is described in the Society of Photographic Science of Japan, "Shashin Kogyo No Kiso, Gin-en Shashin Hen (Fundamentals of Photographic Engineering, The Book of Silver Salt Photography)," Corona Co., Ltd., page 163.

The regular crystal grains of silver halide may be cubic grains with a major crystal face of (100), octahedral grains with a major crystal face of (111), dodecahedral grains with a major crystal face of (110), etc. The dodecahedral grains are described in Japanese Patent Publication No. 55-42737, Japanese Patent Laid-Open No. 60-222842, the Journal of Imaging Science, 30, 247 (1986), etc. The silver halide grains may have a major crystal face of (h11), (hh1), (hk0) or (hk1). Tetradecahedral grains having both (100) and (111) faces, grains having (111) and (110) faces, etc. may also be used in the present invention. Further, grains may be in the shape of a polyhedron such as a triakisoctahedron, a rhomboidal trisoctahedron, a hexaxisoctahedron, etc.

In general, a crystal habit-controlling agent is used for forming a crystal face other than the (100) face in the high-silver chloride grains. For example, to provide the silver halide grains having a major crystal face of (111), a mono-pyridinium salt described in Japanese Patent Laid-Open No. 8-227117 (pages 4 to 6), a bis-pyridinium salt described in Japanese Patent Laid-Open No. 2-32, etc. are preferably used as the crystal habit-controlling agent to remove the crystal habit-controlling agent.

The crystal habit-controlling agent remaining on the surfaces of the silver halide grains after the formation of the grains has negative effects on Dins the adsorption of the sensitizing dye and development. Therefore, the crystal habit-controlling agent is preferably desorbed from the surfaces after the formation of the grains. It is difficult for the silver halide grains to maintain the (111) face under ordinary conditions during and after the removal of the crystal habit-controlling agent. Thus, it is preferred that the crystal habit-controlling agent is substituted by a sensitizing dye, etc. and desorbed to maintain the crystal face of the silver halide grains. This method for removing the crystal habit-controlling agent is described in Japanese Patent Laid-Open Nos. 9-080656 and 9-106026, U.S. Pat. Nos. 5,221,602, 5,286,452, 5,298,387, 5,298,388 and 5,176,992, etc.

The crystal habit-controlling agent desorbed by the above-mentioned method is preferably removed by washing with water. Washing with water is carried out at a temperature causing no coagulation of a protective colloid of gelatin by a flocculation method, ultrafiltration, etc. In the case of using a pyridinium salt as the crystal habit-controlling agent, the temperature for the washing with water is preferably 40° C. or higher, particularly 50° C. or higher. In the flocculation method, a flocculent having a sulfonic acid group or a carboxylic acid group is used. In general, the pyridinium salt strongly interacts with the sulfonic acid group. In the case of removing the crystal habit-controlling agent of the pyridinium salt by the flocculent with a sulfonic acid group, the crystal habit-controlling agent often forms a salt with the flocculent to be insufficiently removed by the washing with water. Thus, the flocculent having a carboxylic acid group is preferably used for removal of the pyridinium salt. Examples of flocculents having carboxylic acid groups are disclosed in British Patent No. 648,472, etc. The pH is not particularly limited at the time of washing with water unless the silver halide grains are excessively flocculated. A lower pH is preferred to accelerate the desorption of the crystal habit-controlling agent from the silver halide grains.

As described above, the tabular silver halide grain having a high aspect ratio is preferably used in the present invention. The tabular silver halide grains preferably have a major crystal face of (111) or (100).

The tabular silver halide grain having the major crystal face of (100) is disclosed in U.S. Pat. Nos. 4,946,772, 5,275,930 and 5,264,337, Japanese Patent Laid-Open Nos. 5-281640,5-313273, 6-308648 and 8-82883, European Patent No. 0534395A1, Japanese Patent Laid-Open No. 2000-131790, etc. To prepare such tabular silver halide grains, it is important to form a nucleus that selectively grows in the direction toward the periphery. Thus, a bromide ion or an iodide ion, and/or a compound that can be selectively adsorbed by a particular face is preferably added at an initial stage of the nucleation. The nucleus is then subjected to physical digestion and grain growth. The grain growth may be achieved by adding a soluble silver salt and a soluble halide, or a small silver halide grain emulsion to the nucleus.

The tabular silver halide grain having the major crystal face of (111) is disclosed in U.S. Pat. Nos. 4,399,215, 4,400,463 and 5,217,858, Japanese Patent Laid-Open Nos. 2-32 and 8-227117, etc. The photosensitive silver halide grain with the silver chloride content of 50 mole % or more generally has the exterior major crystal face of (100) under the absence of an adsorbed substance. The tabular silver halide grains having the major crystal face of (11) are preferably prepared by forming twin nuclei using an adsorptive substance that is selectively adsorbed on the (111) plane, eliminating the nuclei of the regular crystal, the single twinning-plane and nonparallel twinning-plane in the physical digestion to selectively provide the multiple parallel twinning-plane nuclei, and causing the thus obtained nuclei to grow. An empirical rule of the preparation of the tabular silver halide grains having a major crystal face of (111) is described in the Journal of Photographic Science, 36, 182 (1988).

The aspect ratio of the tabular silver halide grain may be increased to obtain the larger surface area thereof, so that the absorbed amount of the sensitizing dye is increased and the degree of spectral sensitization is improved. In a case where the photographing sensitivity is in proportion to the surface area of the silver halide grains, the amount of the photosensitive silver halide required for a predetermined sensitivity can be reduced by increasing the aspect ratio. In a case where the surface area of the silver halide grains is kept uniform, the grain size can be reduced by increasing the aspect ratio, whereby the number of the silver halide grains is increased to improve the graininess. Further, when the aspect ratio is increased, the scattered component of light having a large scattering angle against the incident light path is reduced to improve the sharpness of the silver halide photosensitive material. Thus, the tabular silver halide grains having high aspect ratios are particularly used for photosensitive materials for shooting with high sensitivity. The advantages of the tabular silver halide grains are described in J. T. Kofron and R. E. Booms, "KODAK T-Grain Emulsions in Color Films" and J. Soc. Sci. Technol. Japan, Vol. 49, No. 6, pages 499 to 504.

The average aspect ratio of the tabular silver halide grains is preferably 4 to 100, more preferably 6 to 80. It should be noted that the average aspect ratio is an average value of the aspect ratios of all tabular silver halide grains in the silver halide emulsion.

The tabular silver halide grains are parallel multiple twin grains, when the exterior major crystal face of each grain is a (111) face. If the exterior major crystal face is a (100) face, the tabular silver halide grains have no twinning planes. Intervals between the twinning planes may be 0.012 μm or less as described in U.S. Pat. No. 5,219,720, and a value obtained by dividing distance between the (111) faces by the interval between the twinning planes may be 15 or more as described in Japanese Patent Laid-Open No. 5-249585. When the tabular silver halide grains have a major crystal face of (111), the top shape of the tabular silver halide grains may be triangular, hexagonal, rounded-triangular, rounded-hexagonal, circular, etc. Even if the major crystal face is (111), the side faces linking the major crystal face may be selected from the group consisting of a (111) face, a (100) face, mixtures thereof, faces of higher crystal index, etc. The tabular silver halide grain having an exterior major crystal face of (100) usually has a rectangular top shape.

The tabular silver halide grains occupies preferably 50 to 100%, more preferably 80 to 100%, particularly 90 to 100%, of the total projected area of the silver halide grains contained in the photosensitive silver halide emulsion layer.

The average thickness of the tabular silver halide grains is preferably 0.2 μm or less, more preferably 0.01 to 0.15 μm, particularly 0.01 to 0.10 μm. The average thickness of 0.2 μm or less improves the sensitivity of the silver halide photosensitive material to increase the transparency of the developed material. It should be noted that the average thickness is an average value of the grain thickness of all tabular silver halide grains contained in the photosensitive silver halide emulsion layer.

Particularly in the first silver halide photosensitive material, it is preferred that the silver halide grains are the tabular silver halide grains having an average thickness of 0.2 μm or less, 50% or more of the total projected area of the grains being occupied by the tabular silver halide grains with a major crystal face of (111) or (100). In the second silver halide photosensitive material, 50% or more of the projected area of each of at least two types of silver halide grains is preferably occupied by the tabular silver halide grains having an average aspect ratio of 5 or more and an average thickness of 0.2 μm or less. The silver halide grains having a smaller projected area are preferably tabular silver halide grains with a major crystal face of (100) or (111) having an aspect ratio of 5 or more.

The diameter of a circle equivalent to the average projected area of the tabular silver halide grains is preferably 0.2 to 8 μm, more preferably 0.3 to 5 μm, particularly 0.4 to 4 μm.

When the tabular silver halide grain has a projected plane of hexagon, a ratio in length of the longest side to the shortest side in the hexagon is preferably 1 to 2, particularly about 1. The tabular silver halide grains having such a length ratio occupy preferably 50 to 100%, more preferably 70 to 100%, of the total projected area of all silver halide grains.

When the tabular silver halide grain has a rectangular projected plane, the ratio in length of the longest side to the shortest side in the rectangle is preferably 1 to 2, particularly about 1. The rectangle is thus preferably a square. The tabular silver halide grains having such a length ratio occupy preferably 50 to 100%, more preferably 70 to 100%, of the total projected area of all silver halide grains.

The silver halide grains preferably have various structures from the viewpoint of sensitivity. For example, the silver halide grain may comprise a plurality of layers having halogen compositions different from each other. The silver halide grain having the silver chloride content of 50 mole % or more preferably comprises a plurality of layers having different contents of silver bromide or iodide. A so-called core/shell grain comprising a core having a low silver bromide content covered with a shell having a high silver bromide or iodide content, or a shell having a low it silver bromide content, may be used to control the developability of the photosensitive material. Also known is a silver halide grain in which a core having a low silver bromide content is covered with a first shell having a high silver bromide content and a second shell having a low silver bromide content deposited on the first shell, to increase the sensitivity of the silver halide grain.

In this silver halide grain, a dislocation line is formed in the second shell corresponding to the fringe of the outer edge of the tabular grain due to crystal disorder, contributing to increase in sensitivity. The fringe is a circumference part of the tabular silver halide grain, specifically outside a point at which the silver bromide content is below or exceeds the average silver bromide content of the tabular silver halide grain.

The density of the dislocation lines in the silver halide grain is not particularly limited and may be 10 lines or more, 30 lines or more, 50 lines or more, etc. in each silver halide grain.

The positions and number of the dislocation lines in the silver halide grain may be directly observed by transmission electron microscopy. The observation of the dislocation lines may generally be carried out by a transmission method the silver halide grains placed on a mesh for the electron microscopy, while preventing the silver halide grains from being subjected to such excess pressure as to form dislocation lines, and by cooling the silver halide grains to prevent damage such as printout due to electron beam. The thicker the silver halide grains, the more difficult the electron beams penetrate thereinto. Thus, in the case of thick silver halide grains, a high-voltage electron microscope (200 kV or more per 0.25-μm thickness) is preferably used for observation in more detail.

As described above, the silver halide grains having different halogen compositions may be deposited by epitaxial junction. In the case of using the tabular high-silver chloride grains, a localized phase having a high silver bromide or iodide content may be formed in or on the grains. The localized phase is preferably deposited on the tops or edges of the grains by the epitaxial junction. The epitaxial portions act as sensitivity speck-forming sites to increase sensitivity, and this effect is remarkable even in the tabular silver halide grains.

The silver bromide content of the protrusion connected by the epitaxial junction is preferably larger than that of the host grain of the tabular silver halide grain. The difference between the silver bromide content of the protrusion and that of the host grain is preferably 10 mole % or more, more preferably 15 mole % or more, particularly 20 mole % or more. The silver iodide content of the protrusion is preferably 1 mole % or less.

The size of the epitaxial protrusion may be determined depending on the shape or the halogen composition of the host grain. The size of the epitaxial protrusion is controlled such that a molar ratio of silver in the epitaxial protrusion to that in the host grain is preferably about 0.3 to 50 mole %, more preferably 0.3 to 25 mole %, particularly 0.5 to 15 mole %. When the epitaxial protrusion is too small, it is difficult to obtain the effects of the present invention. Too large an epitaxial protrusion results in the reduction of sensitivity and pressure resistance.

The epitaxial protrusion is preferably formed only at the edges or corners of the tabular silver halide grains. The epitaxial protrusion occupies preferably 1 to 50%, more preferably 1 to 40%, particularly 1 to 30%, of the surface area of the silver halide grain.

To control a position at which the epitaxial protrusion is deposited, an adsorptive substance, which can act as a site-director, is preferably added to the silver halide emulsion. Cyanine and merocyanine dyes are preferably used as the adsorptive substances. The position and area of the epitaxial protrusion can be controlled by selecting the amount of the adsorptive substance. Nitrogen-containing heterocyclic compounds such as amino azaindene compounds may be used as the adsorptive substances. The adsorptive substances may be used referring to a method disclosed in U.S. Pat. No. 4,435,501.

The epitaxial protrusion preferably comprises a metal complex, which is a complex ion comprising a transition metal ion and a ligand such as a halide ion, cyanide ion, etc.

The high-silver chloride grain emulsion may be prepared by a method described in: P. Glafkides, "Chimie et Physique Photographique," Paul Montel, 1967; G. F. Duffin, "Photographic Emulsion Chemistry," Focal Press, 1966; V. L. Zelikrnan et al., "Making and Coating Photographic Emulsion," Focal Press, 1964; etc.

The latent image may be formed in the silver halide emulsion on its surface, inside or in its shallow inner portion. The internal latent image-type emulsion may be used as a direct reversal emulsion in combination with a nucleating agent, a light-fogging agent, etc.

The silver halide emulsion may be prepared by an acid process, a neutral process or an ammonia process. The pH of the reaction solution may be increased to such an extent as not to provide fogging. The reaction between a water-soluble silver salt and a water-soluble halide may be carried out by a single-jet method, a double-jet method, a combination thereof, etc. A so-called reversed mixing method, in which the silver halide grains are formed under a condition of excess silver ion, may be also used. Also, a controlled double-jet method, in which the pAg of the reaction solution is maintained at a desired value, may be used, and a silver halide emulsion having a regular crystal system, a sufficiently uniform grain size distribution and a sufficiently uniform halogen composition can be prepared by this method. Further, as described in U.S. Pat. No. 4,879,208, it is preferred that a submicron grain emulsion is added to the reaction mixture for the silver halide emulsion to grow the grains by 14' physical digestion. The submicron grain emulsion may be prepared beforehand or in the preparation of the silver halide emulsion.

The silver halide grains are preferably formed while controlling the pAg and pH of the reaction mixture. The control of the pAg and pH is described in Photographic Science and Engineering, Vol. 6, pages 159 to 165 (1962); the Journal of Photographic Science, Vol. 12, pages 242 to 251 (1964); U.S. Pat. No. 3,655,394; and British Patent No. 1413748.

A protective colloid is preferably used for the preparation of the silver halide emulsion. The protective colloid is preferably a gelatin or a derivative thereof. Examples of the gelatin derivative include a lime-treated gelatin, an acid-treated gelatin, a delimed gelatin, a phthalated gelatin, a trimellitylated gelatin, a succinated gelatin, a carbamoyl gelatin, an esterified gelatin, etc. A gelatin oxidized by an oxidizing agent such as hydrogen peroxide may be suitably used as the protective colloid for the preparation of the tabular silver halide grains. An enzyme-treated, depolymerized gelatin described in Bull. Soc. Photo. Japan., No. 16, page (1966), a gelatin hydrolyzate and an enzyme decomposer of gelatin may also be used as the protective colloid.

Hydrophilic binders other than gelatin may be used as the protective colloid. The hydrophilic binder may be used alone or in combination with gelatin. Preferred examples of the hydrophilic binder include gelatin and derivatives thereof; graft polymers of gelatin and other polymers; proteins such as albumin and casein; cellulose derivatives such as hydroxyethylcellulose and cellulose sulfates; sodium alginate; starch derivatives; polysaccharides; carrageenan; synthetic hydrophilic polymers containing homopolymers and copolymers such as polyvinyl alcohol, alkyl-modified polyvinyl alcohol, polyvinyl-N-pyrrolidone, polyacrylic acid, polymethacrylic acid, polyacrylamide, polyvinylimidazole and polyvinylpyrazole; thioether polymers described in U.S. Pat. No. 3,615,624; etc.

Examples of the solvent for the silver halide emulsion include thiocyanate compounds described in U.S. Pat. Nos. 2,222,264, 2,448,534 and 3,320,069; thioether compounds described in U.S. Pat. Nos. 3,271,157, 3,574,628, 3,704,130, 4,297,439 and 4,276,347; thione compounds described in Japanese Patent Laid-Open Nos. 53-144319, 53-82408 and 55-77737; imidazole compounds described in Japanese Patent Laid-Open No. 54-100717; benzimidazole compounds described in Japanese Patent Publication No. 60-54662; amine compounds described in Japanese Patent Laid-Open No. 54-100717; etc. Ammonia may be used in combination with the above solvent. A nitrogen-containing compound described in Japanese Patent Publication No. 46-7781, Japanese Patent Laid-Open Nos. 60-222842 and 60-122935, etc. may be added to a mixture for preparing the silver halide grains. The solvent for the silver halide emulsion is described in Japanese Patent Laid-Open No. 62-215272, pages 12 to 18, etc. in detail.

A metal salt (or its complex salt) may be added to the mixture for preparing the silver halide grains at the step of the formation of the silver halide grains or the physical digestion. The metal salt may be cadmium, zinc, lead, thallium, iridium, platinum, palladium, osmium, rhodium, chromium, ruthenium, rhenium, cobalt, gallium, copper, nickel, manganese, indium, tin, calcium, strontium, barium, aluminum, bismuth, etc. The metal salts may be used alone or in combination therewith. The metal salt is preferably a water-soluble salt such as an ammonium salt, acetate, nitrate, sulfate, phosphate, hydroxide, a 6-coordinated complex salt, a 4-coordinated complex salt, etc. Preferred examples of the complex ions and the coordination compounds for the metal salt include bromide ion; chlorine ion; cyanide ion; nitrosyl ion; thiocyanogen ion; thionitrosyl ion; water; ammonia; compounds and ions having an oxo group; compounds and ions having a carbonyl group; organic ligands such as imidazole ligands, pyridine ligands and bipyridine ligands; combinations thereof; etc. Specifically, potassium ferrocyanide, $K_2IrCl_6$, $K_3IrCl_6$, $(NH_4)_2RhCl_5(H_2O)$, $K_2RuCl_5(NO)$, $K_3Cr(CN)_6$, $K_4Ru(CN)_6$, $CdCl_2$, $Pb(CH_3COO)_2$, etc. are preferably used as the metal salt. Metal complexs having a cyanide ion ligand such as an iridium complex salt and a potassium ferrocyanide, lead chloride, cadmium chloride and zinc chloride are preferably used to increase the sensitivity and the concentration at the exposure with high illuminance. Rhodium salts, ruthenium salts and chromium salts are preferred for high contrast. Further, in the preparation of the high-silver chloride grain emulsion, a metal complex salt having an electron trap depth of 0.2 eV or less described in U.S. Pat. No. 6,017,684 is preferably used to increase the sensitivity.

The amount of the metal salt is preferably about $10^{-9}$ to $10^{-2}$ mole per one mole of the silver halide. The metal salt may be introduced uniformly inside the silver halide grains. Alternatively, the metal salt may be introduced only into limited portions of the grains on their surfaces or inner portions, into the localized phase of silver bromide, or into the high-silver chloride grain portions. The metal salt may be added to the silver halide grains by mixing a solution of the metal salt with an aqueous halide solution or a solution of a water-soluble silver salt used for the preparation of the silver halide grains. Silver halide grains doped with the metal ion composing the metal salt may be added to the grains. Further, the solution of the metal salt may be directly added before, during or after the formation of the silver halide grains. The solution of the metal salt may be added continuously during the formation of the silver halide grains.

The metal salt is added after the addition of preferably 70% or more, more preferably 80% or more, particularly 90% or more, of the total amount of the aqueous halide solution or the water-soluble silver salt solution.

When the metal salt is dissolved in a solvent such as water, methanol, acetone, etc., a hydrogen halide such as HCl and HBr, thiocyanic acid or a salt thereof, an alkali halide such as KCl, NaCl, KBr and NaBr, etc. may preferably be added to the solution to stabilize it. An acid or an alkali is also preferably added to the solution for stabilization.

The adding rate, amount or concentration of the silver salt solution (aqueous $AgNO_3$ solution, etc.) or the aqueous halide solution (aqueous KBr solution, etc.) for preparing the silver halide grains may be increased to accelerate the formation of the silver halide grains. Such methods for rapidly forming silver halide grains are described in British Patent No. 1335925, U.S. Pat. Nos. 3,672,900, 3,650,757 and 4,242,445, and Japanese Patent Laid-Open Nos.

55-142329, 55-158124, 58-113927, 58-113928, 58-111934 and 58-111936.

The solubility of the silver halide may be reduced by adding a halide ion suitable for the poor-solubility silver halide during or after the preparation of the silver halide grains. This process called "halogen conversion" is described in "Die Grundlagen der Photographischen Prozesse mit Silverhalogeniden," pages 662 to 669, "The Theory of Photographic Process," 4th Edition, pages 97 to 98, etc.

Thiosulfonate, a dichalcogen compound disclosed in U.S. Pat. Nos. 5,219,721 and 5,364,754, lipoic acid, cysteine, elemental sulfur, an inorganic metal complex such as a cobalt-ammonia complex, etc. may be added during or after the preparation of the silver halide grains.

The silver halide emulsion used in the present invention is preferably chemically sensitized. The chemical sensitization method may be a method for chemical sensitization with chalcogen such as sulfur, selenium, tellurium, etc.; a sensitization method with a noble metal such as gold, platinum, palladium, etc.; a reduction sensitization method; a combination thereof; etc. These methods are described in Japanese Patent Laid-Open No. 3-110555, Japanese Patent Application No. 4-75798, etc. The chemical sensitization may be carried out in the presence of a nitrogen-containing, heterocyclic compound disclosed in Japanese Patent Laid-Open No. 62-253159. Further, an antifoggant may be added after the chemical sensitization as described in Japanese Patent Laid-Open Nos. 5-45833 and 62-40446, etc.

The chemical sensitization may be carried out in any process during the preparation of the silver halide emulsion. Several different types of the silver halide emulsions may be prepared by changing the timing with which the chemical sensitization is performed. Thus, chemical sensitization nuclei are may be formed in the grains, in shallow inner positions or on surfaces of the grains. For example, nuclei sensitized by reduction are formed preferably within the grains, while chalcogen-sensitized nuclei and gold-sensitized nuclei are formed preferably on the surfaces of the grains.

Usable as a sulfur sensitizer is a labile sulfur compound. Examples of the sulfur sensitizer include thiosulfate compounds such as sodium thiosulfate; thiourea compounds such as diphenylthiourea, triethylthiourea and arylthiourea; aryl isothiocyanate; cystine; p-toluenethiosulfonic acid; rhodanine compounds; mercapto compounds; etc.

The amount of the sulfur sensitizer is preferably determined depending on conditions such as pH, temperature, combination with other sensitizers, silver halide grain size, etc. such that the resultant silver halide emulsion has effectively increased sensitivity. In general, the amount of the sulfur sensitizer is preferably $10^{-9}$ to $10^{-1}$ mole per one mole of the silver halide.

Usable as a selenium sensitizer is a known labile selenium compound. Examples of the selenium sensitizer include colloidal metal selenium; selenourea compounds such as N,N-dimethylselenourea and N,N-diethylselenourea; selenoketone compounds; selenoamide compounds; aliphatic isoselenocyanate compounds such as aryl isoselenocyanate; selenocarboxylic acids and ester derivatives thereof; selenophosphate compounds; selenide compounds such as diethylselenide compounds and diethylselenide compounds; etc. The amount of the selenium sensitizer may be determined depending on the above conditions, though it is preferably $10^{-10}$ to $10^{-1}$ mole per one mole of the silver halide.

In the present invention, it is preferable to chemically sensitize the photosensitive silver halide by a tellurium compound to improve its sensitivity and storage stability. The tellurium compound may be a known compound disclosed in U.S. Pat. Nos. 1,623,499, 3,320,069 and 3,772,031; British Patent Nos. 235,211, 1,121,496, 1,295,462 and 1,396,696; Canadian Patent No. 800,958; Japanese Patent Laid-Open No. 8-95184; J. Chem. Soc. Chem. Commun., 635 (1980); ibid., 1102 (1979); ibid., 645 (1979); J. Chem. Soc. Perkin Trans 1, 2191 (1980); S. Patai, "The Chemistry of Organic Selenium and Tellurium compounds," Vol. 1 (1986); ibid., Vol. 2 (1987); etc. The tellurium compound is preferably represented by any of the following general formulae (I), (II) and (III).

General Formula (I)

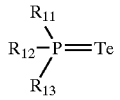

General Formula (II)

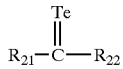

General Formula (III)

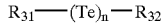

In the general formula (1), each of $R_{11}$, $R_{12}$ and $R_{13}$ represents an aliphatic group, an aromatic group, a heterocyclic group, —$OR_{14}$, —$NR_{15}(R_{16})$, —$SR_{17}$, —$OSiR_{18}(R_{19})(R_{20})$, X, or a hydrogen atom. Each of $R_{14}$ and $R_{17}$ represents an aliphatic group, an aromatic group, a heterocyclic group, a hydrogen atom, or a cation. Each of $R_{15}$ and $R_{16}$ represents an aliphatic group, an aromatic group, a heterocyclic group, or a hydrogen atom. Each of $R_{18}$, $R_{19}$ and $R_{20}$ represents an aliphatic group. X represents a halogen atom.

The aliphatic group represented by each of $R_{11}$, $R_{12}$, $R_{13}$, $R_{14}$, $R_{15}$, $R_{16}$, $R_{17}$, $R_{18}$, $R_{19}$ and $R_{20}$ is preferably a group having 1 to 30 carbon atoms, particularly an alkyl group, an alkenyl group, an alkynyl group or an aralkyl group each having 1 to 20 carbon atoms, which may be straight, blanched or cyclic. The aliphatic group may be a methyl group, an ethyl group, an n-propyl group, an isopropyl group, a t-butyl group, an n-octyl group, an n-decyl group, an n-hexadecyl group, a cyclopentyl group, a cyclohexyl group, an allyl group, a 2-butenyl group, a 3-pentenyl group, a propargyl group, a 3-pentynyl group, a benzyl group, a phenethyl group, etc.

The aromatic group represented by each of $R_{11}$, $R_{12}$, $R_{13}$, $R_{14}$, $R_{15}$, $R_{16}$ and $R_{17}$ is preferably a group having 6 to 30 carbon atoms, particularly an aryl group such as a phenyl group and a naphthyl group each having 6 to 20 carbon atoms, which may be monocyclic or polycyclic.

The heterocyclic group represented by each of $R_{11}$, $R_{12}$, $R_{13}$, $R_{14}$, $R_{15}$, $R_{16}$ and $R_{17}$ is preferably a saturated or unsaturated heterocyclic group having a 3 to 10-membered ring structure with a nitrogen atom, an oxygen atom or a sulfur atom. The heterocyclic group may be monocyclic, and may form a condensed ring with the other aromatic rings or a heterocycle. The heterocyclic group is more preferably a 5 or 6-membered, aromatic heterocyclic group, examples thereof including a pyridyl group, a furyl group, a thienyl group, a thiazolyl group, an imidazolyl group, a benzimidazolyl group, etc.

The cation represented by each of $R_{14}$ and $R_{17}$ is preferably an alkali metal cation or an ammonium cation.

The halogen atom represented by X is preferably a fluorine atom, a chlorine atom, a bromine atom or an iodine atom.

The above-mentioned aliphatic groups, aromatic groups and heterocyclic groups may have substituents. Examples of the substituents include alkyl groups, aralkyl groups, alkenyl groups, alkynyl groups, aryl groups, alkoxy groups, aryloxy groups, amino groups, acyl amino groups, ureide groups, urethane groups, sulfonylamino groups, sulfamoyl groups, carbamoyl groups, sulfonyl groups, sulfinyl groups, alkyloxycarbonyl groups, aryloxycarbonyl groups, acyl groups, acyloxy groups, phosphoric amide groups, diacylamino groups, imide groups, alkylthio groups, arylthio groups, halogen atoms, a cyano group, sulfo groups, a carboxyl group, a hydroxy group, phosphono groups, a nitro group, heterocyclic groups, etc. The substituents may be further substituted. When the above-mentioned group has a plurality of substituents, the substituents may be the same or different atoms or groups.

Each of $R_{11}$, $R_{12}$ and $R_{13}$ is preferably an aliphatic group or an aromatic group, more preferably an alkyl group, or an aromatic group. $R_{11}$, $R_{12}$ and $R_{13}$ may be bonded to each other to form a ring with a phosphorus atom. Further, $R_{15}$ and $R_{16}$ may be bonded to each other to form a nitrogen-containing heterocycle.

In the general formula (II), $R_{21}$, represents an aliphatic group, an aromatic group, a heterocyclic group or —$NR_{23}(R_{24})$, and $R_{22}$ represents —$NR_{25}(R_{26})$, —$N(R_{27})N(R_{28})R_{29}$ or —$OR_{30}$. Each of $R_{23}$, $R_{24}$, $R_{25}$, $R_{26}$, $R_{27}$, $R_{28}$, $R_{29}$ and $R_{30}$ represents a hydrogen atom, an aliphatic group, an aromatic group, a heterocyclic group or an acyl group.

Examples of the aliphatic groups, the aromatic groups and the heterocyclic groups of $R_{21}$, $R_{23}$, $R_{24}$, $R_{25}$, $R_{26}$, $R_{27}$, $R_{28}$, $R_{29}$ and $R_{30}$ may be the same as those of $R_{11}$, $R_{12}$, $R_{13}$, $R_{14}$, $R_{15}$, $R_{16}$, $R_{17}$, $R_{18}$, Rig and $R_{20}$ in the general formula (I).

$R_{21}$, and $R_{25}$, $R_{21}$, and $R_{27}$, $R_{21}$and $R_{28}$, $R_{21}$ and $R_{30}$, $R_{23}$ and $R_{25}$, $R_{23}$ and $R_{27}$, $R_{23}$ and $R_{28}$, and $R_{23}$ and $R_{30}$, respectively, may be bonded to each other to form a ring, and each of $R_{21}$, $R_{23}$, $R_{25}$ $R_{27}$, $R_{28}$ and $R_{30}$ is preferably an alkylene group, an arylene group, an aralkylene group, or an alkenylene group.

The acyl group represented by each of $R_{23}$, $R_{24}$, $R_{25}$, $R_{26}$, $R_{27}$, $R_{28}$, $R_{29}$ and $R_{30}$ is preferably a group having 1 to 30 carbon atoms, particularly a linked or blanched acyl group having 1 to 20 carbon atoms. Examples of the acyl groups include an acetyl group, a benzoyl group, a formyl group, a pivaloyl group, a decanoyl group, etc.

$R_{21}$ is preferably an aliphatic group, an aromatic group, or —$NR_{23}(R_{24})$, more preferably an aromatic group or —$NR_{23}(R_{24})$. $R_{22}$ is preferably —$NR_{25}(R_{26})$. Each of $R_{23}$, $R_{24}$, $R_{25}$ and $R_{26}$ is preferably an aliphatic group or an aromatic group, more preferably an alkyl group or an aromatic group. Each of $R_{21}$, $R_{23}$ and $R_{25}$ is an alkylene group, an arylene group, an aralkylene group, or an alkenyl group, and $R_{21}$, and $R_{25}$, and $R_{23}$ and $R_{25}$, respectively, may be bonded to each other to form a ring.

In the general formula (III), each of $R_{31}$ and $R_{32}$ represents an aliphatic group, an aromatic group, a heterocyclic group or —(C=Y')-$R_{33}$. $R_{31}$ and $R_{32}$ may be the same or different groups. n represents 1 or 2. $R_{33}$ represents a hydrogen atom, an aliphatic group, an aromatic group, a heterocyclic group, —$NR_{34}(R_{35})$, —$OR_{36}$ or —$SR_{37}$, and Y' represents an oxygen atom, a sulfur atom or $NR_{38}$. Each of $R_{34}$, $R_{35}$, $R_{36}$, $R_{37}$ and $R_{38}$ represents a hydrogen atom, an aliphatic group, an aromatic group, or a heterocyclic group.

Examples of the aliphatic groups, the aromatic groups and the heterocyclic groups of $R_{31}$, $R_{32}$, $R_{33}$, $R_{34}$, $R_{35}$, $R_{36}$, $R_{37}$ and $R_{38}$ may be the same as those of $R_{11}$, $R_{12}$, $R_{13}$, $R_{14}$, $R_{15}$, $R_{16}$, $R_{17}$, $R_{18}$, $R_{19}$ and $R_{20}$ in the general formula (I).

$R_{31}$ and $R_{32}$, and $R_{34}$ and $R_{35}$, respectively, may be bonded to each other to form a ring.

Each of $R_{31}$ and $R_{32}$ is preferably a heterocyclic group, or —(C=Y') $R_{33}$, more preferably —(C=Y')-$R_{33}$. $R_{33}$ is preferably —$NR_{34}(R_{35})$, or —$OR_{36}$, more preferably —$NR_{34}(R_{35})$. Y' is preferably an oxygen atom, and Each of $R_{34}$, $R_{35}$ and $R_{36}$ is preferably an aliphatic group, an aromatic group or a heterocyclic group.

Specific Examples of the tellurium compounds represented by any of the general formulae (I), (II) and (III) include compounds disclosed in the chemical formula 22 to 36 of Japanese Patent Laid-Open No. 8-95184.

The amount of the tellurium compound sensitizer may be determined depending on the above various conditions as well as the above-mentioned sulfur sensitizer. In general, the amount of the tellurium compound sensitizer is preferably $10^{-8}$ to $10^{-2}$ mole, more preferably $10^{-i}$ to $5\times10^{-3}$ mole, per one mole of the silver halide. Although conditions for chemical sensitization using the tellurium compound sensitizer are not particularly limited, the pH of the emulsion is preferably 5 to 8, the pAg thereof is preferably 6 to 11, more preferably 7 to 10, and the temperature is preferably 40 to 95° C., more preferably 45 to 85° C.

In the sensitization method using gold as a noble metal, the valence of gold may be +1 or +3. Examples of the gold sensitizer include chloroauric acid compounds, potassium chloroaurate, auric trichloride, potassium aurithiocyanate, potassium iodoaurate, tetraauric acid, ammonium aurothiacyanate, pyridyltrichloro gold, gold sulfide, gold selenide, gold telluride, etc., The amount of the gold sensitizer may be determined depending on the above various conditions as well as the above-mentioned sulfur sensitizer. In general, the amount of the gold sensitizer is preferably $10^{-10}$ to $10^{-1}$ mole per one mole of the silver halide.

The sensitization method using gold as a noble metal may be carried out alone or in combination with the chalcogen chemical sensitization method using a sulfur sensitizer, a selenium sensitizer, a tellurium sensitizer, etc. In this case, the gold sensitizer may be added simultaneously with the chalcogen sensitizer, or before, during or after the chemical sensitization with a chalcogen. Although conditions for chemical sensitization using the gold sensitizer are not particularly limited, the pH of the emulsion is preferably 3 to 10, more preferably 5.5 to 8.5, and the pAg thereof is preferably 5 to 11, more preferably 6.8 to 9.0.

A chalcogenide compound described in U.S. Pat. No. 3,772,031 may be also added to the mixture for preparing the emulsion. Further, the chemical sensitization may be carried out in presence of a cyanogen salt, a thiocyanogen salt, a selenocyanogen salt, a carbonate, a phosphate, an acetate, etc. in addition to the sulfur sensitizer, the selenium sensitizer and the tellurium sensitizer.

The silver halide emulsion used in the present invention may be spectrally sensitized by a spectral sensitizing dye. The spectral sensitizing dye is adsorbed to the silver halide grains, so that the grains are sensitized to light in a desired wavelength range. Examples of the spectral sensitizing dyes include cyanine dyes, merocyanine dyes, composite cyanine dyes, composite merocyanine dyes, holopolar dyes, hemicyanine dyes, styryl dyes, hemioxonol dyes, etc. The spectral sensitizing dye is preferably used with a super-sensitizer.

The spectral sensitizing dye may be added to the silver halide emulsion at any time during the preparation of the emulsion, though it is generally added after the chemical sensitization and before the application of the emulsion. The spectral sensitization may be carried out simultaneously with the chemical sensitization by adding the spectral sensitizing dye and the chemical sensitizer at the same time as described in U.S. Pat. Nos. 3,628,969 and 4,225,666.

Alternatively, the spectral sensitization may be carried out before the chemical sensitization as described in Japanese Patent Laid-Open No. 58-113928. Further, the spectral sensitization may be started before the precipitation and preparation of the silver halide grains are finished. Furthermore, a method for adding the spectral sensitizing dye stepwise described in U.S. Pat. No. 4,225,666 may be used in the present invention, in which a part of the spectral sensitizing dye is added before the chemical sensitization, 110 and the remainder thereof is added after the chemical sensitization. The spectral sensitization may be carried out by a method described in U. S. Pat. No. 4,183,756. In a case where the high-silver chloride grains having a major crystal face of (111) are formed using the crystal habit-controlling agent, the spectral sensitizing dye is preferably added during or after the formation of the grains and before a desalting process.

The amount of the spectral sensitizing dye may be determined depending on the shape and size of the silver halide grains or the desired photographic properties. A molar ratio of the spectral sensitizing dye to 1 mol of the silver halide is preferably $10^{-8}$ to $10^{-1}$ mol, more preferably $10^{-5}$ to $10^{-2}$ mol, particularly $10^{-4}$ to $10^{-3}$ mol.

The spectral sensitizing dye may be added to the silver halide in the form of a solution in water or a hydrophilic organic solvent such as methanol, alcohol, methylpropylglycol, etc. The solution may be adjusted to be alkaline or acidic to increase the solubility or the storage stability. The spectral sensitizing dye may be added in the form of an aqueous solution comprising a surfactant as described in Japanese Patent Publication No. 49-44. The spectral sensitizing dye may be dissolved and mixed with a dispersing agent using a co-solvent, etc., and the resultant mixture may be dried with the co-solvent, etc. removed, so that it is added in the form of powder as described in Japanese Patent Laid-Open No. 49-128725 and Japanese Patent Publication No. 49-8,330. Fine silica grains may be adsorbed to the spectral sensitizing dye as described in U.S. Pat. No. 3,649,286. Alternatively, a dispersing agent such as sorbitol and a surfactant may be added to the spectral sensitizing dye in water, and the resultant mixture is mechanically ground and dispersed to form a slurry, which is dried and then added to the silver halide, as described in U.S. Pat. No. 4,006,025 and Japanese Patent Laid-Open Nos. 52-110012, 53-102733 and 53-102732. Further, the spectral sensitizing dye may be mechanically ground to 1 μm or less and dispersed in water, further dispersed in a hydrophilic colloid such as gelatin as a dispersing aid, and then added to the silver halide, as described in Japanese Patent Laid-Open No. 58-105141.

A plurality of the spectral sensitizing dyes may be used in combination to make it possible to control the wavelength distribution of the spectral sensitivity and conduct super-sensitization. A combination of the spectral sensitizing dyes capable of exhibiting the super-sensitization provides sensitivity much exceeding the simple sum of the sensitivity of each dye.

The spectral sensitizing dye is preferably combined with a compound that has a function of super-sensitization though it does not act for spectral sensitization by itself or absorbs substantially no visible light. Such a super-sensitizer may be a diaminostilbene compound described in U.S. Pat. No. 3,615,641, Japanese Patent Laid-Open No. 63-23145, etc. A molar ratio of the super-sensitizer to the spectral sensitizing dye is preferably 0.3 to 0.003, more preferably 0.1 to 0.01. The super-sensitizer may be added to the silver halide emulsion at any time during the preparation of the emulsion as well as the spectral sensitizing dye. The above-mentioned methods for adding the spectral sensitizing dye may applied to the addition of the super-sensitizer.

A soluble calcium compound, a soluble bromine compound, a soluble iodine compound, a soluble chlorine compound or a soluble SCN compound may be added to the silver halide before, during or after the addition of the spectral sensitizing dye, thereby increasing the adsorption of the spectral sensitizing dye. Such compounds may be used in combination, and their preferred examples include $CaCl_2$, KI, KCl, KBr and KSCN. Fine grains of silver bromide, silver chlorobromide, silver iodobromide, silver iodide, silver rhodanide, etc. may be used as such a compound. An iodine ion is preferably localized on the surface of the emulsion grains to increase the sensitivity.

An antifoggant, a stabilizer or a precursor thereof may be added to the silver halide emulsion to prevent the fogging or the reduction of sensitivity during storage of the silver halide photosensitive material. Examples of the antifoggants and the stabilizers include nitrogen-containing heterocyclic compounds such as azaindene compounds, triazole compounds, tetrazole compounds and purine compounds; mercapto compounds such as mercaptotetrazole compounds, mercaptotriazole compounds, mercapto imidazole compounds and mercapto thiadiazole compounds; etc. The antifoggants and the stabilizers are described in detail in T. H. James, "The Theory of the Photographic Process," Macmillan, 1977, pages 396 to 399 and references therein.

Examples of the antifoggants, the stabilizers and the stabilizer precursors further include thiazonium salts described in U.S. Pat. Nos. 2,131,038 and 2,694,716; azaindene compounds described in U.S. Pat. Nos. 2,886,437 and 2,444,605; mercury salts described in U.S. Pat. No. 2,728,663; urazole compounds described in U.S. Pat. No. 3,287,135; sulfocatechol compounds described in U.S. Pat. No. 3,235,652; oxime compounds, nitron compounds and nitroindazole compounds described in British Patent No. 623,448; multivalent metal salts described in U.S. Pat. No. 2,839,405; thiuronium salts described in U.S. Pat. No. 3,220,839; palladium salts, platinum salts and gold salts described in U.S. Pat. Nos. 2,566,263 and 2,597,915; halogen-substituted organic compounds described in U.S. Pat. Nos. 4,108,665 and 4,442,202; triazine compounds described in U.S. Pat. Nos. 4,128,557, 4,137,079, 4,138,365 and 4,459,350; phosphorus compounds described in U.S. Pat. No. 4,411,985; organic halogenated compounds described in Japanese Patent Laid-Open Nos. 50-119624, 54-58022,56-70543, 56-99335, 61-129642, 62-129845, 6-208191, 7-5621 and 8-15809, and U.S. Pat. Nos. 5,340,712, 5,369,000 and 5,464,737; etc.

The antifoggant, the stabilizer and the stabilizer precursor may be added at any time during the preparation of the silver halide emulsion, for example, during the preparation of the emulsion after the chemical sensitization; at the time of completing the chemical sensitization; during the chemical sensitization; before the chemical sensitization; after the formation of the silver halide grains and before the desalinization; during the formation of the silver halide grains; and/or before the formation of the silver halide grains. The antifoggant or the stabilizer is preferably used in combination with a divalent metal cation such as a zinc ion as described in U.S. Pat. No. 6,165,704.

The antifoggant, the stabilizer and the stabilizer precursor may be used not only to prevent the fogging and stabilization, but also to control the habitus of the silver halide grains, to prevent the dissolution of the grains, to reduce the grain size, to control the chemical sensitization, and to control the sequence of the sensitizing dye, etc.

The amount of each of the antifoggant, the stabilizer and the stabilizer precursor may be determined depending on the halogen composition and the use of the silver halide emulsion, though it is preferably $10^{-6}$ to $10^{-1}$ mol, more preferably $10^{-5}$ to $10^{-2}$ mol, per one mol of the silver halide.

The antifoggant used for the first and second silver halide photosensitive materials of the present invention is preferably represented by any of the following general formulae (F-1) and (F-2), and the general formula (F-1) is more preferable.

General Formula (F-1)

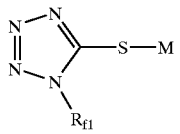

General Formula (F-2)

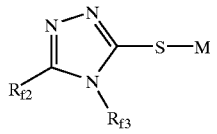

In the general formula (F-1), $R_{f1}$ represents an alkyl group having 4 to 20 carbon atoms, an aryl group having 6 to 20 carbon atoms, or an aralkyl group having 7 to 20 carbon atoms.

In the general formula (F-2), $R_{f2}$ represents a hydrogen atom, an alkyl group having 4 to 20 carbon atoms, an aryl group having 6 to 20 carbon atoms, or an aralkyl group having 7 to 20 carbon atoms, and $R_{f3}$ represents an alkyl group having 4 to 20 carbon atoms, an aryl group having 6 to 20 carbon atoms, or an aralkyl group having 7 to 20 carbon atoms. The total number of the carbon atoms of $R_{f2}$ and $R_{f3}$ is 4 to 30.

The alkyl group represented by $R_{f1}$, $R_{f2}$, or $R_{f3}$, may have a substituent and may be straight, branched, or cyclic. Examples of the alkyl decyl group, an n-butyl group, an n-hexyl group, an n-octyl group, an n-decyl group, an n-dodecyl group, a 2-ethylhexyl group, an n-hexadecyl group, a 6-methoxyhexyl group, a 6-hydroxyhexyl group, a cyclohexyl group, etc.

The aryl group represented by $R_{f1}$, $R_{f2}$ or $R_{f3}$ may have a substituent. Examples of the aryl groups include a phenyl group, a naphthyl group, a 4-methoxyphenyl group, etc.

The aralkyl group represented by $R_{f1}$, $R_{f2}$ or $R_{f3}$ may have a substituent. Examples of the aralkyl groups include a benzyl group, a phenethyl group, a 4-chlorobenzyl group, etc.

$R_{f1}$ is preferably an alkyl group having 6 to 12 carbon atoms or an aralkyl group having 7 to 12 carbon atoms, more preferably an alkyl group having 6 to 12 carbon atoms, particularly a normal alkyl group having 8 to 12 carbon atoms.

In the general formula (F-2), $R_{f2}$ is preferably a hydrogen atom, an alkyl group having 6 to 12 carbon atoms, an aryl group having 6 to 12 carbon atoms, or an aralkyl group having 7 to 12 carbon atoms, and $R_{f3}$ is an alkyl group having 6 to 12 carbon atoms, an aryl group having 6 to 12 carbon atoms, or an aralkyl group having 7 to 12 carbon atoms. The total number of the carbon atoms of $R_{f2}$ and $R_{f3}$ is 6 to 20. $R_{f2}$ is more preferably an alkyl group having 6 to 12 carbon atoms, an aryl group having 6 to 12 carbon atoms, or an aralkyl group having 7 to 12 carbon atoms, and $R_{f3}$ is more preferably an aryl group having 6 to 12 carbon atoms, or an aralkyl group having 7 to 12 carbon atoms, the total number of the carbon atoms of $R_{f2}$ and $R_{f3}$ being 6 to 16. $R_{f2}$ is particularly an alkyl group having 6 to 12 carbon atoms, or an aryl group having 6 to 12 carbon atoms, and $R_{f3}$ is particularly an aryl group having 6 to 12 carbon atoms, or an aralkyl group having 7 to 12 carbon atoms, the total number of the carbon atoms of $R_{f2}$ and $R_{f3}$ being 6 to 14.

In the general formulae (F-1) and (F-2), M represents a hydrogen atom or a cation. Examples of the cations include alkali metal ions such as a sodium ion and a potassium ion; alkaline earth metal ions such as a magnesium ion, a calcium ion and a barium ion; ammonium ions such as an unsubstituted ammonium ion and a tetramethylammonium ion; etc. M is preferably a hydrogen atom Further, a water-insoluble metal salt composed of the compound represented by the general formula (F-1) or (F-2) may be used as the antifoggant. The metal ion of M forming a water-insoluble metal salt as a counter cation may be Fe ion, Cu ion, Ag ion, Hg ion, etc. Among the metal ions, Ag ion is the most preferred.

As described above, $R_{f1}$, $R_{f2}$ and $R_{f3}$ may have substituents, and preferred examples of the substituents include halogen atoms such as a chlorine atom, a bromine atom and an iodine atom; substituted or unsubstituted alkyl groups preferably having 1 to 10 carbon atoms, which may be straight, branched or cyclic, such as a methyl group, an ethyl group, an n-propyl group, an isopropyl group, a t-butyl group, an n-octyl group, a 2-chloroethyl group, a 2-cyanoethyl group and a 2-ethylhexyl group; substituted or unsubstituted cycloalkyl groups preferably having 3 to 10 carbon atoms, such as a cyclohexyl group and a cyclopentyl group; substituted or unsubstituted alkenyl groups preferably having 2 to 10 carbon atoms, which may be straight, branched or cyclic, such as a vinyl group and an allyl group; substituted or unsubstituted cycloalkenyl groups preferably having 3 to 10 carbon atoms, such as a 2-cyclopenten-1-yl group and 2-cyclohexen-1-yl group; alkynyl groups; aralkyl groups; aryl groups; substituted or unsubstituted, aromatic or non-aromatic, heterocyclic groups having 3 to 10 carbon atoms, which may preferably be aromatic or non-aromatic with a 5- or 6-membered ring structure and preferably aromatic, such as a 2-furyl group, a 2-thienyl group, a 2-pyrimidinyl group and a 2-benzthiazolyl group; a cyano group; a hydroxyl group; a nitro group; a carboxyl group; substituted or unsubstituted alkoxy groups preferably having 1 to 10 carbon atoms, such as a methoxy group, an ethoxy group, an isopropoxy group, a t-butoxy group, an n-octyloxy group, and a 2-methylhexyloxy group; substituted or unsubstituted aryloxy groups preferably having 6 to 10 carbon atoms, such as a phenoxy group, a 2-methylphenoxy group, a 4-t-butylphenoxy group and 3-nitrophenoxy group; silyloxy groups preferably having 3 to 10 carbon atoms, such as a trimethylsilyloxy group and a t-butyldimethylsilyloxy group; substituted or unsubstituted heterocyclic oxy groups preferably having 2 to 10 carbon atoms, such as a 1-phenyltetrazole-5-oxy group and a 2-tetrahydropyranyloxy group; acyloxy groups, which may be substituted or unsubstituted alkylcarbonyloxy groups having 2 to 10 carbon atoms and substituted or unsubstituted arylcarbonyloxy groups having 6 to 10 carbon atoms, such as a formyloxy group, an acetoxy group, a pivaloyloxy group, a benzoyloxy group, and p-methoxyphenylcarbonyloxy group, and preferably a formyloxy group; substituted or unsubstituted carbamoyl groups preferably having 1 to 10 carbon atoms, such as an N,N-dimethylcarbamoyloxy group, an N,N-diethylcarbamoyloxy group, and a morpholinocarbonyloxy group; substituted or unsubstituted alkoxycarbonyloxy groups preferably having 2 to 10 carbon atoms, such as a methoxycarbonyloxy group, an ethoxycarbonyloxy group, a t-butoxycarbonyloxy group, and an n-octylcarbonyloxy group; substituted or unsubstituted aryloxycarbonyloxy groups preferably having 7 to 10 carbon atoms, such as a phenoxycarbonyloxy group, and a p-methoxyphenoxycarbonyloxy group; amino groups, which may be substituted or unsubstituted alkylamino groups having 1 to 10 carbon atoms and substituted or unsubstituted anilino groups having 6 to 10 carbon atoms, such as a unsubstituted amino group, a methylamino group, a dimethyl amino group, a unsubstituted anilino group and an N-methylanilino group, preferably a unsubstituted amino group; acylamino groups, which may be substituted or unsubstituted alkylcarbonylamino groups having 1 to 10 carbon atoms and substituted or unsubstituted arylcarbonylamino groups having 6 to 10 carbon atoms, such as a formylamino group, an acetylamino group, a pivaloylamino group and a benzoylamino group, preferably a formylamino group; substituted or unsubstituted aminocarbonylamino groups preferably having 1 to 10 carbon atoms, such as a carbamoylamino group, an N,N-dimethylaminocarbonylamino group, an N,N-diethylaminocarbonylamino group, and a morpholinocarbonylamino group; substituted or unsubstituted alkoxycarbonylamino groups preferably having 2 to 10 carbon atoms, such as a methoxycarbonylamino group, an ethoxycarbonylamino group, a t-butoxycarbonylamino group, an n-octadecyloxycarbonylamino group, and an N-methylmethoxycarbonylamino group; substituted or unsubstituted aryloxycarbonylamino groups preferably having 7 to 10 carbon atoms, such as a phenoxycarbonylamino group and ap-chlorophenoxycarbonylamino group; substituted or unsubstituted sulfamoylamino groups preferably having 0 to 10 carbon atoms, such as a unsubstituted sulfamoylamino group, an NN-dimethylaminosulfonylamino group, and an N-n-octylaminosulfonylamino group; substituted or unsubstituted alkylsulfonylamino groups preferably having 1 to 10 carbon atoms, such as a methylsulfonylamino group, and a butylsulfonylamino group; substituted or unsubstituted arylsulfonylamino group preferably having 6 to 10 carbon atoms, such as a phenylsulfonylamino group, a 2,3,5-trichlorophenylsulfonylamino group, and a p-methylphenylsulfonylamino group; a mercapto group; substituted or unsubstituted alkylthio groups preferably having 1 to 10 carbon atoms, such as a methylthio group and an ethylthio group; substituted or unsubstituted arylthio groups preferably having 6 to 10 carbon atoms, such as a phenylthio group, a p-chlorophenylthio group and an m-methoxyphenylthio group; substituted or unsubstituted heterocyclic thio groups preferably having 2 to 10 carbon atoms, such as a 2-benzothiazolylthio group, and a 1-phenyltetrazole-5-ylthio group; substituted or unsubstituted sulfamoyl groups preferably having 0 to 10 carbon atoms, such as an N-ethylsulfamoyl group, an N-(3-dodecyloxypropyl)sulfamoyl group, an NN-dimethylsulfarnoyl group, an N-acetylsulfamoyl group, an N-benzoylsulfamoyl group, and an N-(N'-phenylcarbamoyl)sulfamoyl group; a sulfo group; substituted or unsubstituted alkylsulfinyl groups preferably having 1 to 10 carbon atoms, such as a methylsulfinyl group and an ethylsulfinyl group; substituted or unsubstituted arylsulfinyl groups preferably having 6 to 10 carbon atoms, such as a phenylsulfinyl group, and a p-methylphenylsulfonyl group; substituted or unsubstituted alkylsulfonyl groups preferably having 1 to 0.10 carbon atoms, such as a methylsulfonyl group and an ethylsulfonyl group; substituted or unsubstituted arylsulfonyl groups preferably having 6 to 10 carbon atoms, such as a phenylsulfonyl group, and a p-methylphenylsulfonyl group; acyl groups, which may be substituted or unsubstituted alkylcarbonyl groups having 2 to 10 carbon atoms and substituted or unsubstituted arylcarbonyl groups having 7 to 10 carbon atoms, such as a formyl group, an acetyl group, a pivaloyl group, a 2-chloroacetyl group, and a benzoyl group, preferably a formyl group; substituted or unsubstituted aryloxycarbonyl groups preferably having 7 to 10 carbon atoms, such as a phenoxycarbonyl group, an o-chlorophenoxycarbonyl group, and an m-nitrophenoxycarbonyl group; substituted or unsubstituted alkoxycarbonyl groups preferably having 2 to carbon atoms, such as a methoxycarbonyl group, an ethoxycarbonyl group and a t-butoxycarbonyl group; substituted or unsubstituted carbamoyl groups preferably having 1 to 10 carbon atoms, such as a carbamoyl group, an N-methylcarbamoyl group, an N,N-dimethylcarbamoyl group and an N-(methylsulfonyl)carbamoyl group; substituted or unsubstituted arylazo groups preferably having 6 to 10 carbon atoms, such as a phenylazo group and a p-chlorophenylazo group; substituted or unsubstituted heterocyclic azo groups preferably having 3 to carbon atoms, such as a 5-ethylthio-1,3,4-thiadiazole-2-ylazo group; imide groups, which may be an N-succinimide group, and an N-phthalimide group; substituted or unsubstituted phosphino groups preferably having 2 to 12 carbon atoms, such as a dimethylphosphino group, a diphenylphosphino group, and a methylphenoxyphosphino group; substituted or unsubstituted phosphinyl groups preferably having 2 to 12 carbon atoms, such as a unsubstituted phosphinyl group, and a diethoxyphosphinyl group; substituted or unsubstituted phosphinyloxy group preferably having 2 to 12 carbon atoms, such as a diphenoxyphosphinyloxy group; substituted or unsubstituted phosphinylamino groups preferably having 2 to 10 carbon atoms, such as a dimethoxyphosphinylamino group, and a dimethylarinophosphinylamino group; substituted or unsubstituted silyl group preferably having 3 to 10 carbon atoms, such as a trimethylsilyl group, a t-butyldimethylsilyl group and a phenyldimethylsilyl group; etc.

The compound represented by the general formula (F-1) or (F-2) may be synthesized by a known method. Specific examples of the compounds are illustrated below without intention of restricting the scope of the present invention defined by the claims attached hereto.

| Compound No. | Heterocyclic Compound | Compound No. | Heterocyclic Compound |
|---|---|---|---|
| I-1 | 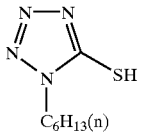 | I-7 | 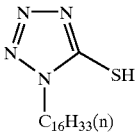 |

-continued
| Compound No. | Heterocyclic Compound | Compound No. | Heterocyclic Compound |
|---|---|---|---|
| I-2 | 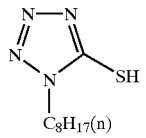 | I-8 | 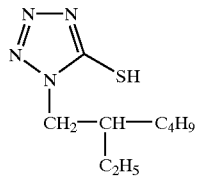 |
| I-3 | 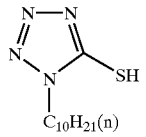 | I-9 | 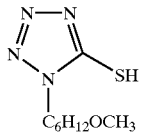 |
| I-4 | 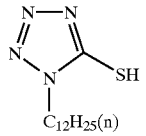 | I-10 | 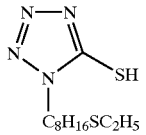 |
| I-5 | 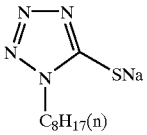 | I-11 | 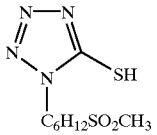 |
| I-6 | 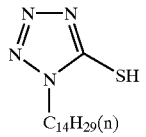 | I-12 | 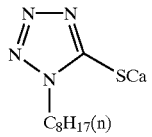 |
| I-13 | 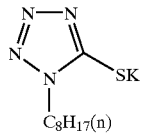 | I-19 | 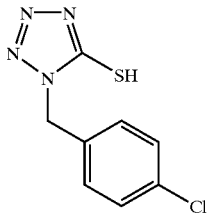 |
| I-14 | 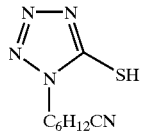 | I-20 | 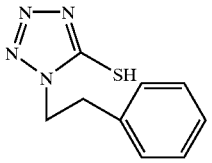 |
| I-15 | 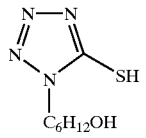 | I-21 | 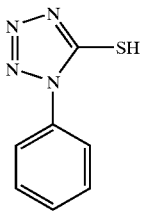 |

-continued
| Compound No. | Heterocyclic Compound | Compound No. | Heterocyclic Compound |
|---|---|---|---|
| I-16 | 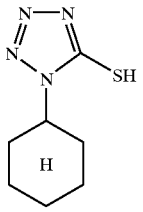 | I-21 | 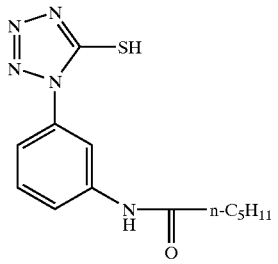 |
| I-17 | 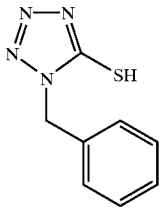 | I-22 | 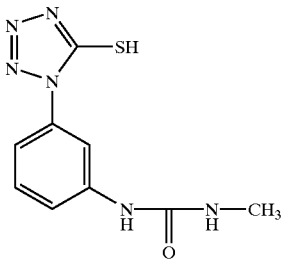 |
| I-18 | 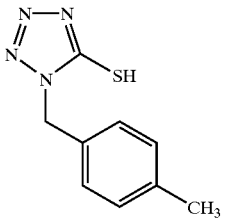 | | |
| II-1 | 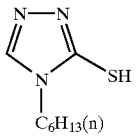 | II-7 | 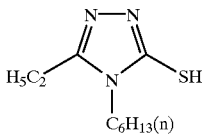 |
| II-2 | 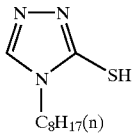 | II-8 | 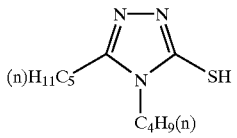 |
| II-3 | 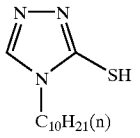 | II-9 | 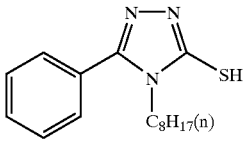 |
| II-4 | 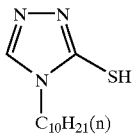 | II-10 | 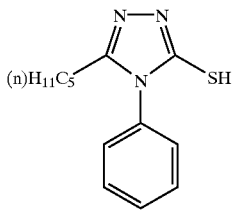 |

-continued
| Compound No. | Heterocyclic Compound | Compound No. | Heterocyclic Compound |
|---|---|---|---|
| II-5 | 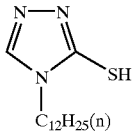 | II-11 | 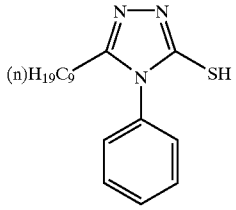 |
| II-6 | 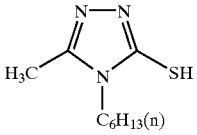 | II-12 | 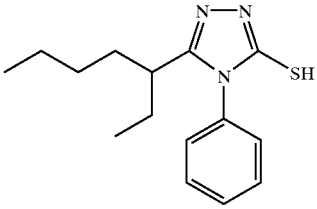 |
| II-13 | 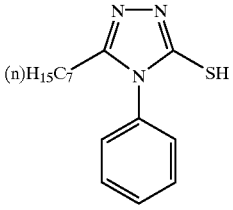 | II-19 | 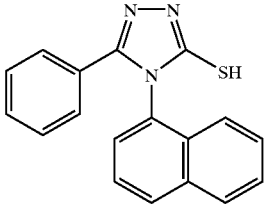 |
| II-14 | 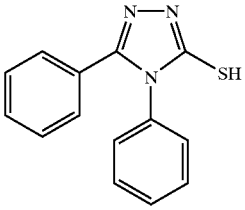 | II-20 | 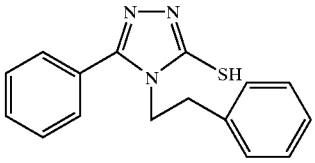 |
| II-15 | 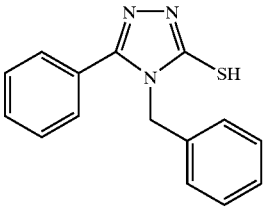 | | |
| II-16 | 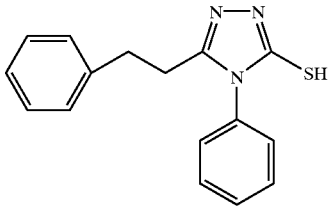 | | |
| II-17 | 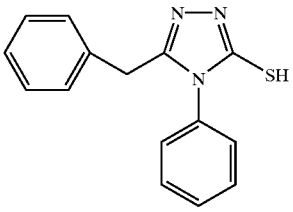 | | |

-continued

| Compound No. | Heterocyclic Compound | Compound No. | Heterocyclic Compound |
|---|---|---|---|
| II-18 | 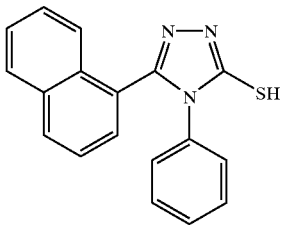 | | |

The compound represented by any of the general formulae (F-1) and (F-2) may be incorporated into the first and second silver halide photosensitive materials of the present invention by a known method. For example, the compound may be dissolved in a suitable solvent such as methanol, ethanol and ethyl acetate and then added to the application liquid. Further, an aqueous solution of an alkali metal salt may be added to the application liquid, wherein the alkali metal salt being prepared by substituting a hydrogen atom of the mercapto group contained in the compound with a sodium ion, a potassium ion, etc. Such a solution of the compound may be added at any time during the preparation of the application liquid. For example, the solution may be added to the silver halide emulsion beforehand, may be added to the other component, or may be added at the final stage of the preparation of the application liquid. A dispersion prepared by dispersing fine crystals of a silver salt derived from the compound in water or a gelatin solution may be added to the application liquid. Such a silver salt may be prepared by a known method for preparing a silver halide, or by a method described in Japanese Patent Laid-Open No. 1-100177.

The amount of the compound represented by any of the general formulae (F-1) and (F-2) may be determined in a range of $1\times10^{-5}$ to 1 mol per one mol of the silver halide depending on its use. The amount of the compound is preferably $10^{-4}$ to $10^{-2}$ mol per one mol of the silver halide, when M is a hydrogen atom without forming a salt, or when M is an alkali metal cation forming an alkali metal salt. Further, the amount is preferably $10^{-2}$ to 1 mol per one mol of the silver halide in a case where the compound forms a silver salt.

The first silver halide photosensitive material according to the present invention comprises a mercaptotetrazole compound. The mercaptotetrazole compound is preferably represented by the above general formula (F-1). The mercaptotetrazole compound may also preferably be a silver salt of 1-phenyl-5-mercaptotetrazole or 1-alkyl-5-mercaptotetrazole. In the first silver halide photosensitive material, a molar ratio of the mercaptotetrazole compound to the silver halide grains is 0.1 mole % or more, preferably 0.5 mole % or more.

Additives usable for photosensitive materials are described in detail in Research Disclosure (RD), Nos. 17643 (1978), 18716 (1979) and 307105 (1989) as follows.

| Additives | RD 17643 | RD 18716 | RD 307105 |
|---|---|---|---|
| Chemical Sensitizer | Page 23 | Page 648, Right Column | Page 866 |

-continued

| Additives | RD 17643 | RD 18716 | RD 307105 |
|---|---|---|---|
| Sensitivity-Increasing Agent | — | Page 648, Right Column | — |
| Spectral Sensitizer | Pages 23 to 24 | Page 648, Right Column | Pages 866 to 868 |
| Super-Sensitizer | — | Page 649, Right Column | — |
| Brightening Agent | Page 24 | Page 648, Right Column | Page 868 |
| Antifoggant | Pages 24 to 26 | Page 649, Right Column | Pages 868 to 870 |
| Stabilizer | — | — | — |
| Light Absorbent | Pages 25 to 26 | Page 649, Right Column | Page 873 |
| Filter Dye | — | Page 650, Left Column | — |
| Ultraviolet Absobant | — | — | — |
| Dye Image Stabilizer | Page 25 | Page 650, Left Column | Page 872 |
| Hardening Agent | Page 26 | Page 651, Left Column | Pages 874 to 875 |
| Binder | Page 26 | Page 651, Left Column | Pages 873 to 874 |
| Plasticizer or Lubricant | Page 27 | Page 650, Right Column | Page 876 |
| Coating Aid | Pages 26 to 27 | Page 650, Right Column | Pages 875 to 876 |
| Surfactant | — | — | — |
| Antistatic Agent | Page 27 | Page 650, Right Column | Pages 876 to 877 |
| Matting Agent | — | — | Pages 878 to 879 |

The amount of silver in the photosensitive silver halide per 1 $m^2$ of the photosensitive silver halide emulsion layer is preferably 0.05 to 20 $g/m^2$, more preferably 0.1 to 10 $g/m^2$.

(B) Organic silver salt

The organic silver salt that can be reduced is relatively stable to light and generates a silver ion when heated at 80° C. or higher in the presence of an exposed photocatalyst such as an latent image of the photosensitive silver halide, a reducing agent, etc. The organic silver salt is preferably an organic or inorganic complex comprising a ligand with a gross stability constant against silver ion of 4.0 to 10.0.

The photosensitive silver halide emulsion layer of the first silver halide photosensitive material comprises a silver salt of a benzotriazole compound as the above-mentioned organic silver salt, a molar ratio of the silver salt to the silver halide grains being 1 mole % or more. The benzotriazole compound preferably has an alkyl group with 1 to 12 carbon atoms. The first silver halide photosensitive material may comprise other organic silver salts that are described below.

The second silver halide photosensitive material of the present invention preferably comprises organic silver salts that are described below.

Preferably usable as the above organic silver salts are silver salts of organic compounds having carboxyl groups, such as silver salts of aliphatic carboxylic acids and silver salts of aromatic carboxylic acids. Further, silver salts that can be substituted by halogen atoms or a hydroxyl group are also preferred. Preferred examples of the aliphatic carboxylic acids include behenic acid, stearic acid, oleic acid, lauric acid, caproic acid, myristic acid, palmitic acid, maleic acid, fumaric acid, tartaric acid, arachidic acid, linoleic acid, butanoic acid, camphoric acid, thioether group-containing aliphatic carboxylic acids disclosed in U.S. Pat. No. 3,330,663, etc., and these aliphatic carboxylic acids may be combined. Preferred examples of the aromatic carboxylic acids include benzoic acid; substituted benzoic acids such as 3,5-dihydroxybenzoic acid, o-methylbenzoic acid, m-methylbenzoic acid, p-methylbenzoic acid, 2,4dichlorobenzoic acid, acetoamidobenzoic acid and p-phenylbenzoic acid; gallic acid; tannic acid; phthalic acid; terephthalic acid; salicylic acid; phenylacetic acid; pyromellitic acid; 3-carboxymethyl-4-methyl-4-thiazoline-2-thione; carboxylic acids disclosed in U.S. Pat. No. 3,785,830; etc.

Silver salts of compounds having a mercapto group or a thione group and derivatives thereof may be also used as the above-mentioned organic silver salt.

Such silver salt preferably has a 5- or 6-membered heterocyclic skeleton having carbon atoms and 2 or less heteroatoms selected from the group consisting of oxygen, sulfur and nitrogen, at least one nitrogen atom being preferably contained. The 5- or 6-membered heterocyclic skeleton is preferably a triazole ring skeleton, an oxazole ring skeleton, a thiazole ring skeleton, a thiazoline ring skeleton, a thiazole ring skeleton, an imidazoline ring skeleton, an imidazole ring skeleton, a diazole ring skeleton, a pyridine ring skeleton, or a triazine ring skeleton. Preferred examples of the silver salt having the heterocyclic skeleton include a silver salt of 3-mercapto-4-phenyl-1,2,4-triazole; a silver salt of 2-mercaptobenzoxazole; a silver salt of 2-mercapto-5-aminothiadiazole; a silver salt of 2-(ethylglycolamido)-benzothiazole; a silver salt of 5-carboxyl-1-methyl-2-phenyl-4-thiopyridine; a silver salt of mercaptotriazine; a silver salt of 2-mercaptobenzoxazole; silver salts of 1-mercapto-5-alkyltetrazole; a silver salt of 1-mercapto-5-phenyltetrazole described in Japanese Patent Laid-Open No. 1-100177; silver salts of 1,2,4-mercaptothiazole derivatives such as a silver salt of 3-amino-5-benzylthio-1,2,4-thiazole described in U. S. Pa. No. 4,123,274; silver salts of thione compounds such as a silver salt of 3-(3-carboxyethyl)-4-methyl-4-thiazoline-2-thione described in U.S. Pat. No. 3,301,678; silver salts of 3-amino-1,2,4-triazole compounds described in Japanese Patent Laid-Open No. 53-116144; silver salts of substituted or unsubstituted benzotriazole compounds; silver salts of benzotriazole compounds and fatty acids described in U.S. Pat. No. 4,500,626, columns 52 to 53; etc.

Examples of the silver salt comprising a mercapto group or a thione group without the heterocyclic skeleton include silver salts of thioglycolic acid compounds such as silver salts of an S-alkylthioglycolic acid having an alkyl group with 12 to 22 carbon atoms; silver salts of dithiocarboxylic acid compounds such as a silver salt of dithioacetic acid; silver salts of thioamide compounds; etc.

Silver salts of compounds having an imino group may be used as the above organic silver salt, and preferred examples thereof include silver salts of benzotriazole and derivatives thereof; silver salts of benzotriazole compounds such as a silver salt of methylbenzotriazole; silver salts of halogen-substituted benzotriazole compounds such as a silver salt of 5-chlorobenzotriazole; silver salts of 1,2,4triazole compounds; silver salts of 1H-tetrazole compounds described in U.S. Pat. No. 4,220,709; silver salts of imidazole and derivatives thereof; etc. Further, silver acetylide compounds disclosed in U.S. Pat. Nos. 4,761,361 and 4,775,613 may be used in the present invention. In the present invention, the silver salts of the benzotriazole derivatives having an alkyl group with 1 to 12 carbon atoms are particularly useful as the organic silver salt.

A plurality of the above-mentioned organic silver salts may be used in combination. The amount of the organic silver salt is preferably 0.01 to 10 mol, more preferably 0.01 to 1 mol, per one mol of the photosensitive silver halide. The total amount of silver in the photosensitive silver halide emulsion and the organic silver salt per 1 $m^2$ of the photosensitive material is preferably 1 to 20 $g/m^2$, more preferably 1 to 10 $g/m^2$. The organic silver salt is preferably 5 to 70 weight % based on the photosensitive silver halide grains in the photosensitive silver halide emulsion layer.

The organic silver salt used in the present invention is preferably desalted. The desalting method is not particularly limited and may preferably be a known filtration method such as a centrifugal filtration method, a vacuum filtration method, an ultrafiltration method, a washing method with water for forming flock by flocculation, etc. The ultrafiltration method disclosed in Japanese Patent Application No. 11-115457 is preferably used in the present invention.

The organic silver salt is preferably used as a solid dispersion. The solid dispersion of the organic silver salt is preferably prepared by a reaction between a solution or a suspension of an organic compound or an alkali metal salt thereof (sodium salt, potassium salt, lithium salt, etc.) and silver nitrate. The solid dispersion of the organic silver salt may be prepared by a method disclosed in Japanese Patent Laid-Open Nos. 1-100177, Japanese Patent Application Nos. 11-203413 and 11-104187, etc. A water-soluble dispersant may be added to a solution or a suspension of the organic compound or the alkali metal salt thereof, or to a aqueous silver nitrate solution. The types and amounts of the dispersants are described in Japanese Patent Application No. 11-115457, paragraph 52. In the present invention, the solid dispersion of the organic silver salt is particularly preferably prepared with pH controlled by a method disclosed in Japanese Patent Laid-Open No. 1-100177.

Preferably used to prepare a solid dispersion of an organic silver salt having a small grain size free from flocculation is a dispersing method, in which an aqueous dispersion comprising an organic silver salt as an image-forming medium and substantially free from a photosensitive silver salt is turned to a high-speed fluid, and then subjected to pressure drop. This dispersing method is disclosed in Japanese Patent Laid-Open No. 2000-292882, paragraphs 27 to 38.

The shape and size of the organic silver salt are not particularly limited. The average grain size of the organic silver salt in the organic silver salt solid dispersion is preferably 0.001 to 5.0 Em, more preferably 0.005 to 1.0 $\mu$m. The solid dispersion of the organic silver salt is preferably mono-dispersion in a particle size distribution. A percentage (variation coefficient) obtained by dividing the standard deviation of a volume-weighted average diameter of the organic silver salt by the volume-weighted average diameter is preferably 80% or less, more preferably 50% or less, particularly 30% or less.

The organic silver salt solid dispersion generally comprises an organic silver salt and water. Although the weight ratio of the organic silver salt to water is not particularly limited, the weight ratio of the organic silver salt to the entire dispersion is preferably 5 to 50 weight %, particularly 10 to 30 weight %. The amount of the dispersant is preferably as small as possible to lower the grain size of the organic silver salt, and the weight ratio of the dispersant to the organic silver salt is preferably 0.5 to 30 weight %, particularly 1 to 15 weight %. A metal ion selected from Ca, Mg and Zn, an antifoggant or a stabilizer, etc. may be added to the solid dispersion of the organic silver salt.

(C) Thermal Solvent

The thermal solvent used in the present invention is an organic material, which is in a solid state at ambient temperature, exhibits an eutectic point in combination with the other component at a temperature equal to or lower than a thermal development temperature of the silver halide photosensitive material, and is turned to a liquid state during the thermal development to promote the thermal development or thermal transfer of the dye. Usable as the thermal solvent are a compound that can be a solvent for the developing agent, a compound having a high dielectric constant and promoting the physical development of the silver salt, a compound compatible with a binder and capable of swelling it, etc.

Examples of the thermal solvents include compounds described in: U.S. Pat. Nos. 3,347,675, 3,667,959, 3,438,776 and 3,666,477; Research Disclosure No. 17643; Japanese Patent Laid-Open Nos. 51-19525, 53-24829, 53-60223, 58-118640, 58-198038, 59-229556, 59-68730, 59-84236, 60-191251, 60-232547, 60-14241, 61-52643, 62-78554, 62-42153, 62-44737, 63-53548, 63-161446, 1-224751,2-863,2-120739 and 2-123354; etc. More specifically, low-water-solubility thermal solvents suitable for the dispersion of fine crystals may be selected from urea derivatives such as phenylmethyl urea; amide derivatives such as acetoamide, stearylamide, p-toluamide and p-propanoyloxyethoxybenzamide; sulfonamide derivatives such asp-toluenesulfonic amide; polyol compounds such as high-molecular-weight polyethylene glycol; etc.

The water solubility of the thermal solvent is preferably 1 $g/m^3$ or less, more preferably 10 $g/m^3$ or less, to increase the dispersion stabilization. The melting point of the thermal solvent is preferably 90° C. or higher and lower than the thermal development temperature. The amount of the thermal solvent is preferably 3 to 30 weight %, more preferably 5 to 20 weight %, based on the total amount of the binder coated on the photograph-constituting layers on the substrate.

Specific examples TS-1 to TS-14 of the thermal solvent used in the present invention are illustrated below together with melting points thereof without intention of restricting the scope of the present invention.

TS-1

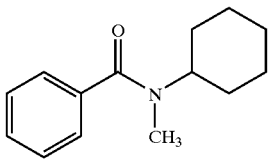

mp: 76° C.

-continued

TS-2

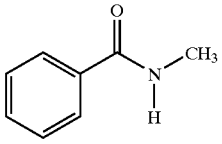

mp: 76° C.

TS-3

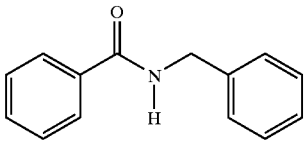

mp: 104° C.

TS-4

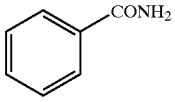

mp: 128° C.

TS-5

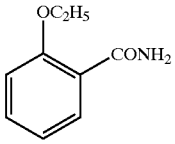

mp: 131° C.

TS-6

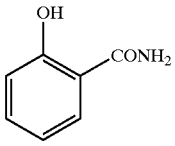

mp: 140° C.

TS-7

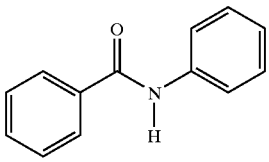

mp: 164° C.

TS-8

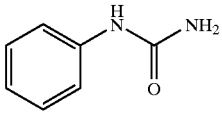

mp: 146° C.

TS-10

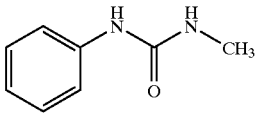

mp: 149° C.

TS-11

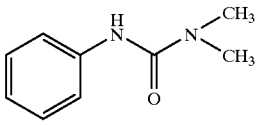

mp: 134° C.

-continued

TS-12

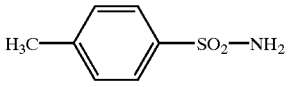

mp: 139° C.

TS-13

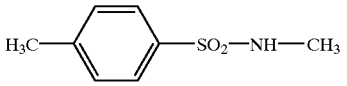

mp: 80° C.

TS-14

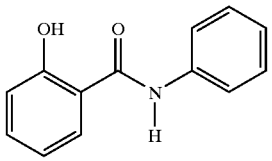

mp: 135° C.

(D) Developing Agent p-Phenylenediamine compounds, p-aminophenol compounds, etc. may be used as a developing agent. Preferred examples of the developing agents include sulfonamidephenol compounds disclosed in Japanese Patent Laid-Open Nos. 8-110608, 8-122994, 9-15806 and 9-146248, etc.; sulfonylhydrazine compounds disclosed in European Patent No. 545,491A, Japanese Patent Laid-Open Nos. 8-166664 and 8-227131, etc.; carbamoylhydrazine compounds disclosed in Japanese Patent Laid-Open No. 8-286340; sulfonylhydrazone compounds disclosed in Japanese Patent Laid-Open Nos. 8-202002, 10-186564 and 10-239793; carbamoylhydrazone compounds disclosed in Japanese Patent Laid-Open No. 8-234390; sulfamic acid compounds disclosed in Japanese Patent Publication No. 63-36487; sulfohydrazone compounds disclosed in Japanese Patent Publication No. 4-20177; 4-sulfonamidepyrazolone compounds disclosed in Japanese Patent Publication No. 5-48901; p-hydroxyphenylsulfamic acid compounds disclosed in Japanese Patent Publication No. 4-69776; sulfamic acid compounds having a benzene ring substituted by an alkoxy group disclosed in Japanese Patent Laid-Open No. 62-227141; hydrophobic salts composed of a color-developing agent having an amino group and an organic acid disclosed in Japanese Patent Laid-Open No. 3-15052; hydrazone compounds disclosed in Japanese Patent Publication No. 2-15885; ureidoaniline compounds disclosed in Japanese Patent Laid-Open No. 59-111148; sulfamoylhydrazone compounds disclosed in U.S. Pat. No. 4,430,420; aromatic primary amine derivatives having a sulfonylaminocarbonyl group or an acylaminocarbonyl group disclosed in Japanese Patent Publication No. 3-74817; compounds releasing an aromatic primary amine developing agent via a reverse Michael reaction disclosed in Japanese Patent Laid-Open No. 62-131253; aromatic primary amine derivatives having a fluorine-substituted acyl group disclosed in Japanese Patent Publication No. 5-33781; aromatic primary amine derivatives having an alkoxycarbonyl group disclosed in Japanese Patent Publication No. 5-33782; oxalic acid amide-type, aromatic primary amine derivatives disclosed in Japanese Patent Laid-Open No. 63-8645; Schiff base-type, aromatic primary amine derivatives disclosed in Japanese Patent Laid-Open No. 63-123043; etc. Particularly preferable among them are sulfonamidephenol compounds disclosed in Japanese Patent Laid-Open Nos. 8-110608, 8-122994, 8-146578, 9-15808 and 9-146248, etc.; carbamoylhydrazine compounds disclosed in Japanese Patent Laid-Open No. 8-286340; and aromatic primary amine derivatives disclosed in Japanese Patent Publication No. 3-74817 and Japanese Patent Laid-Open No. 62-131253.

Specific examples of the developing agent used in the present invention are illustrated below without intention of restricting the scope of the present invention.

First, the carbamoylhydrazine developing agents D-1 to D-24 that may be used in the present invention are illustrated below.

D-1

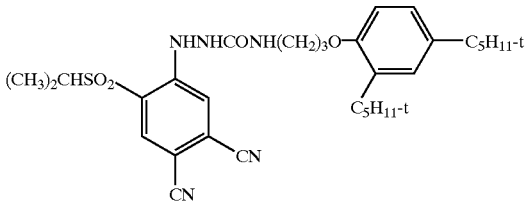

D-2

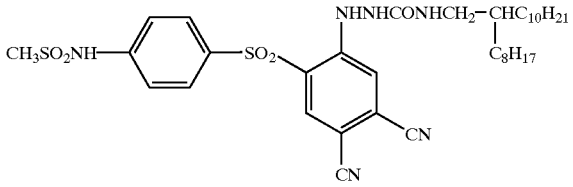

D-3

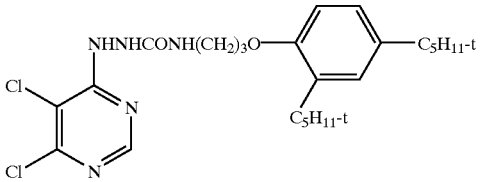

-continued
D-4
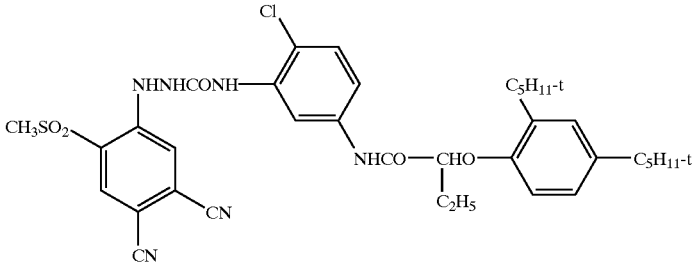
D-5
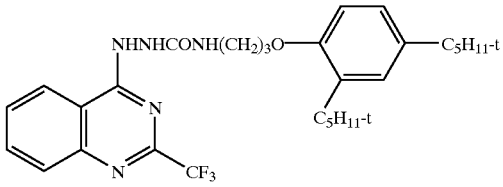
D-7
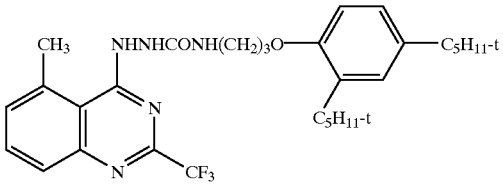
D-8
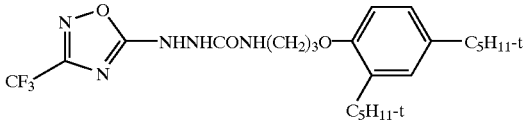
D-9
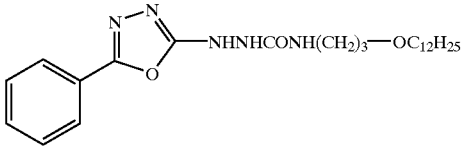
D-10
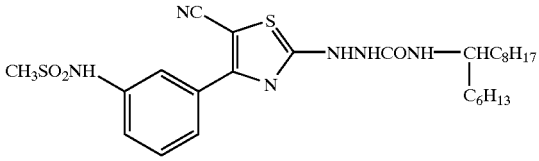
D-11
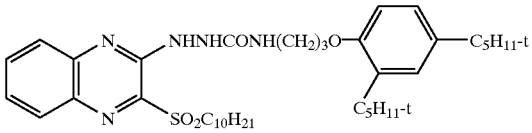
D-12
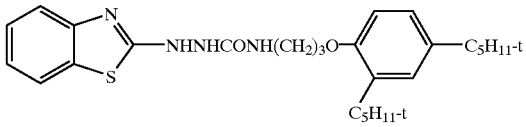
D-13
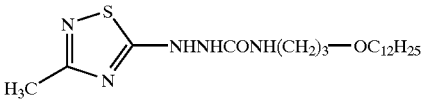
D-14
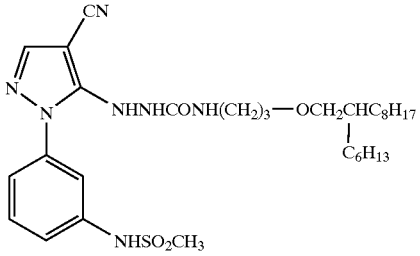
D-15
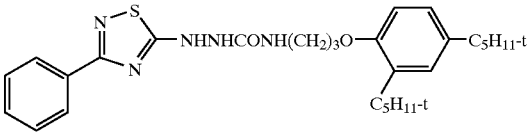
D-16
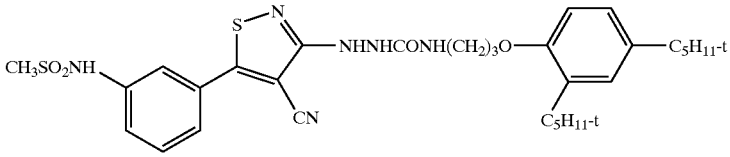

-continued

D-17

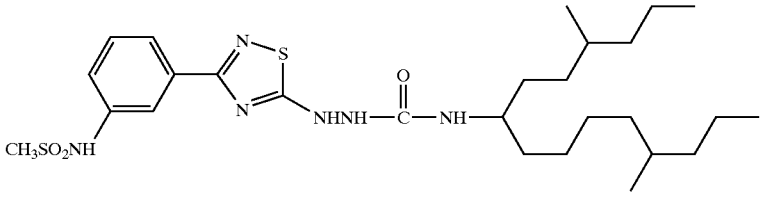

D-18

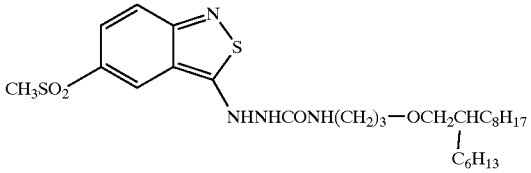

D-19

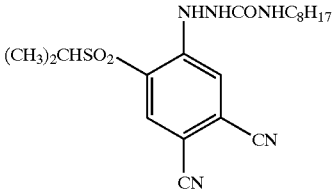

D-20

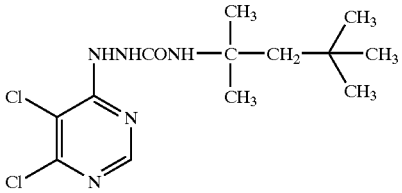

D-21

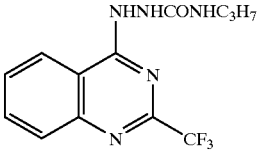

D-22

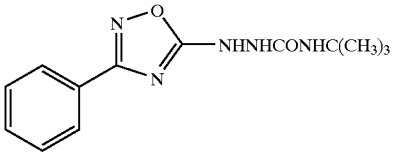

D-23

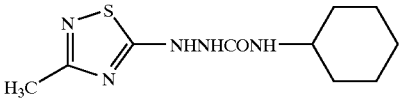

D-24

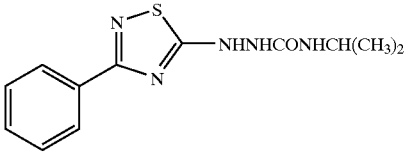

Compounds (1) to (80) disclosed in Japanese Patent Laid-Open No. 8-286340, pages 7 to 22; Compounds H-1 to H-72 disclosed in Japanese Patent Laid-Open No. 9-152700, pages 9 to 26; Compounds D-1 to D-19 disclosed in Japanese Patent Laid-Open No. 9-152701, pages 7 to 11; Compounds D-1 to D-39 disclosed in Japanese Patent Laid-Open No. 9-152702, pages 6 to 13; Compounds D-1 to D49 disclosed in Japanese Patent Laid-Open No. 9-152703, pages 7 to 17; Compounds (1) to (45) disclosed in Japanese Patent Laid-Open No. 9-152704, pages 6 to 18; Compounds (1) to (65) disclosed in Japanese Patent Laid-Open No. 9-152705, pages 5 to 17; and Compounds D-1 to D-29 disclosed in Japanese 4 Patent Laid-Open No. 9-211818, pages 7 to 15, may be also used as the carbamoylhydrazine developing agent in the present invention.

The sulfonamidephenol developing agents SA-1 to SA-10 that may be used in the present invention are illustrated below.

SA-1

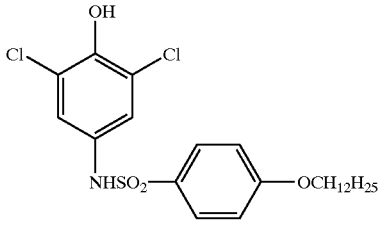

-continued

SA-2

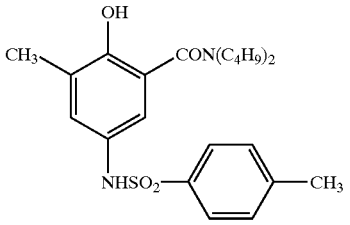

SA-3

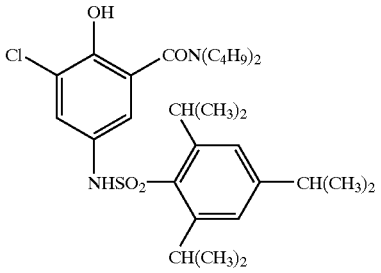

SA-4

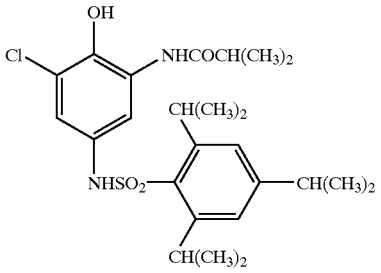

SA-5

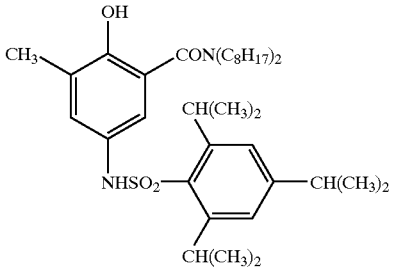

SA-6

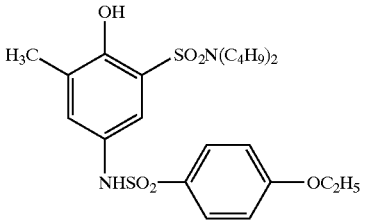

SA-7

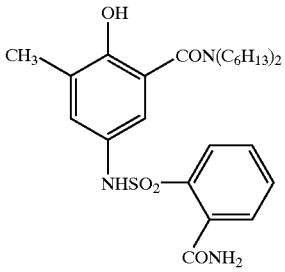

-continued

SA-8

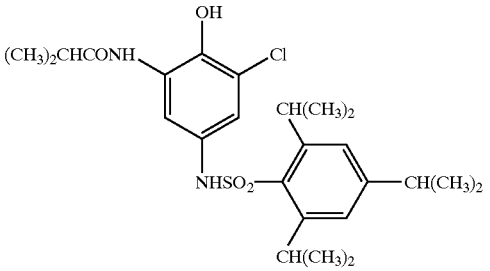

SA-9

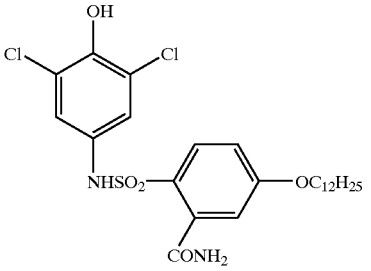

SA-10

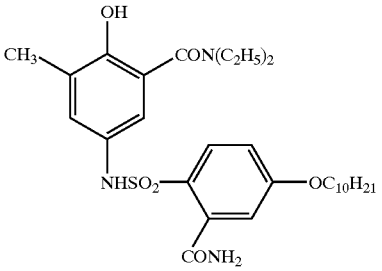

Compounds I-1 to I-23 disclosed in Japanese Patent Laid-Open No. 8-110608, pages 13 to 16; Compounds I-1 to I-21 disclosed in Japanese Patent Laid-Open No. 8-122994, page 27; Compounds D-1 to D-30 disclosed in Japanese Patent Laid-Open No. 9-15806, pages 4 to 7; Compounds D-1 to D-35 disclosed in Japanese Patent Laid-Open No. 9-146248, pages 9 to 15; Compounds D-1 to D-38 disclosed in Japanese Patent Laid-Open No. 10-186564, pages 9 to 15; Compounds D-1 to D-37 disclosed in Japanese Patent Laid-Open No. 10-239793, pages 9 to 16; Compounds D-1 to D-42 disclosed in Japanese Patent Laid-Open No. 11-125886, pages 5 to 9; Compounds D-1 to D-25 disclosed in Japanese Patent Laid-Open No. 11-143037, pages 6 to 13; and Compounds D-1 to D-56 disclosed in Japanese Patent Laid-Open No. 11-149146, pages 5 to 12 may be also used as the sulfonamidephenol developing agent in the present invention.

The developing agents of aromatic primary amine derivatives DEVP-1 to DEVP-27 and DEVP-56 to DEVP-63 that may be used in the present invention are illustrated below.

DEVP-1
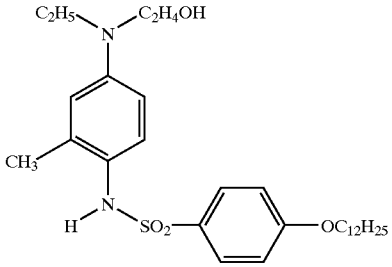
DEVP-2
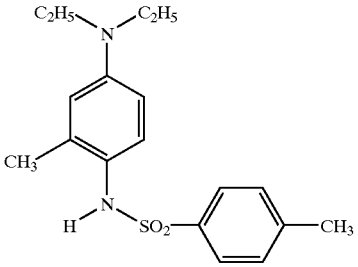
DEVP-3
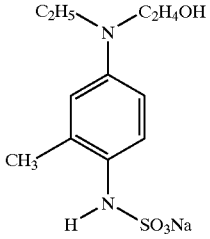
DEVP-4
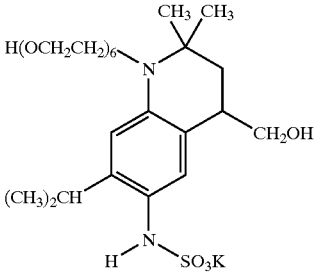
DEVP-5
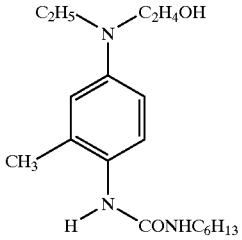
DEVP-6
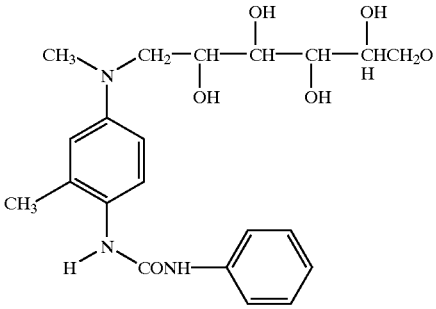
DEVP-7
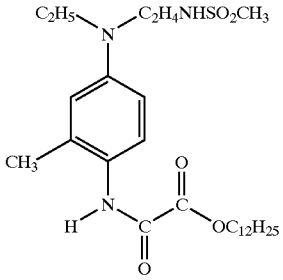
DEVP-8
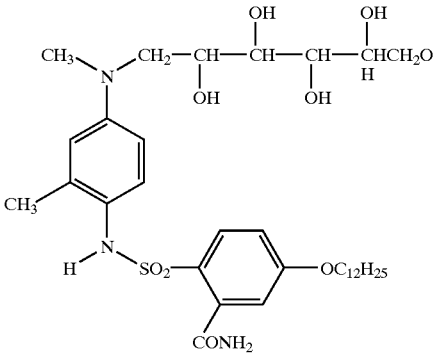
DEVP-9
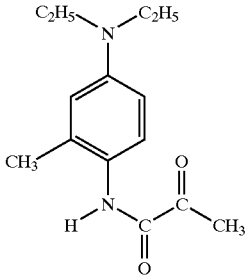
DEVP-10
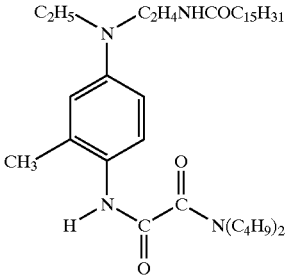

-continued
DEVP-11
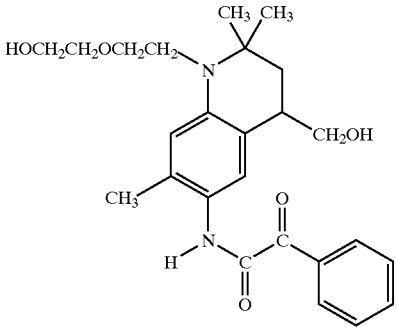
DEVP-12
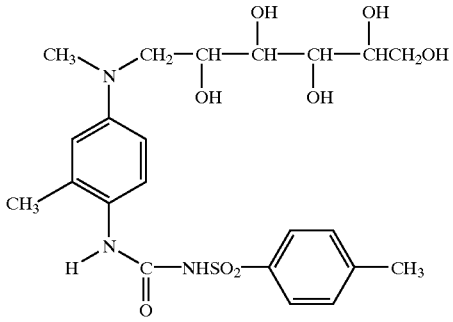
DEVP-13
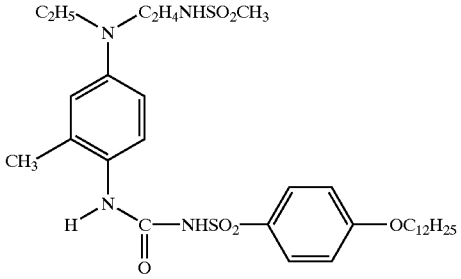
DEVP-14
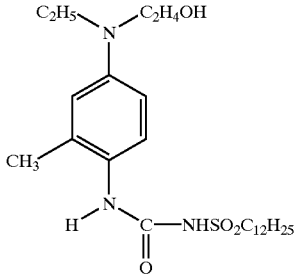
DEVP-15
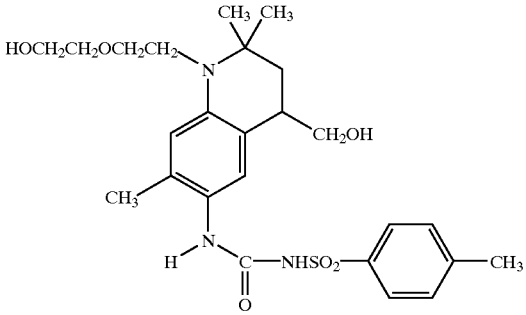
DEVP-16
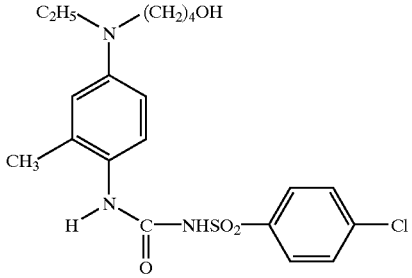
DEVP-17
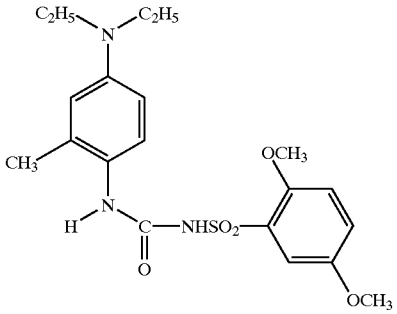
DEVP-18
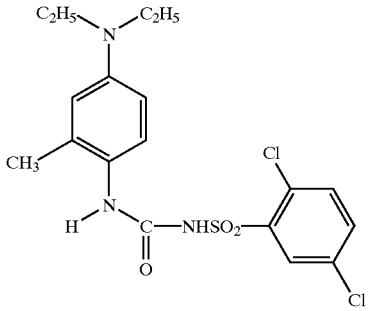
DEVP-19
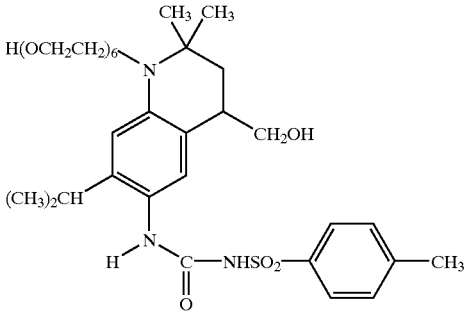
DEVP-20
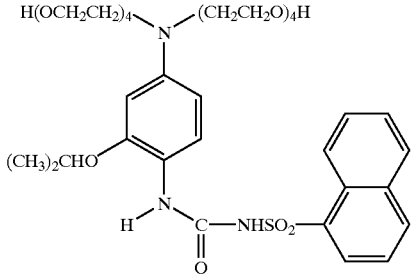

-continued
DEVP-21
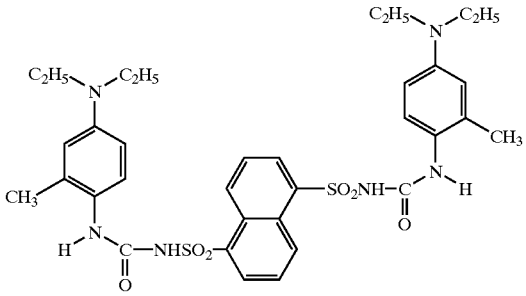
DEVP-22
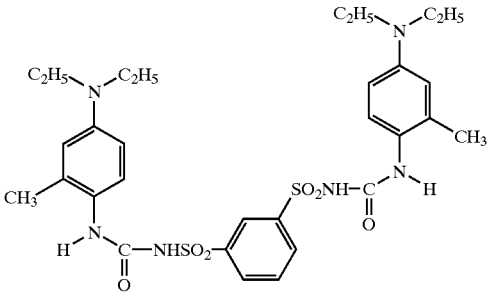
DEVP-23
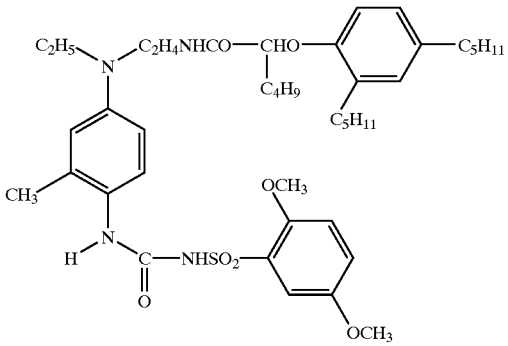
DEVP-24
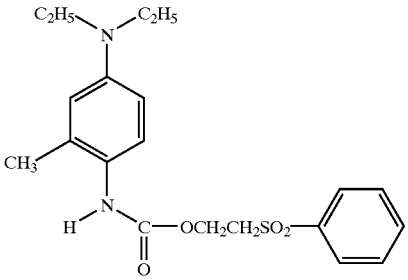
DEVP-25
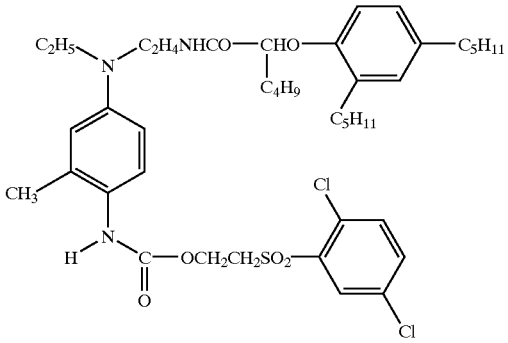
DEVP-26
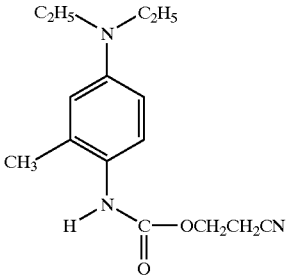
DEVP-27
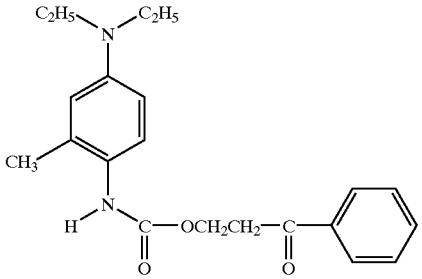
DEVP-56
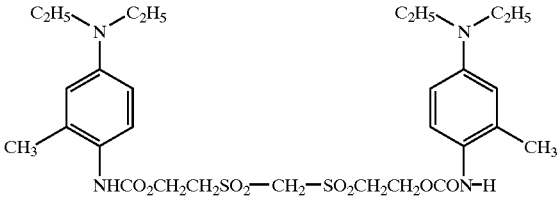

-continued

DEVP-57

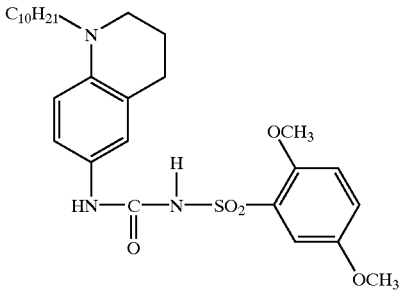

DEVP-58

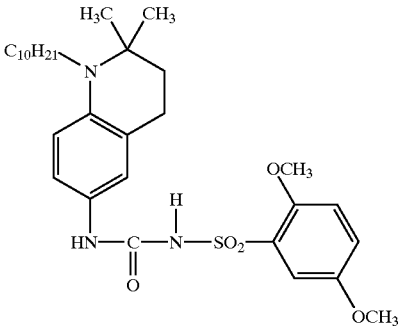

DEVP-59

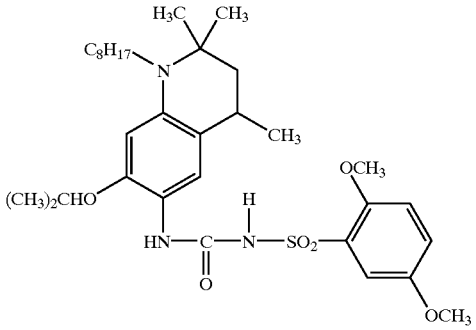

DEVP-60

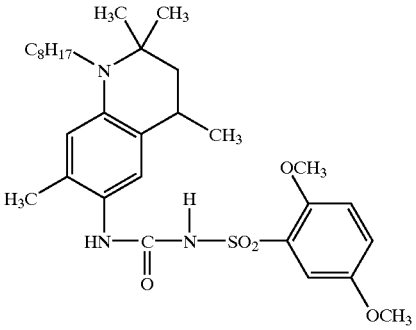

DEVP-61

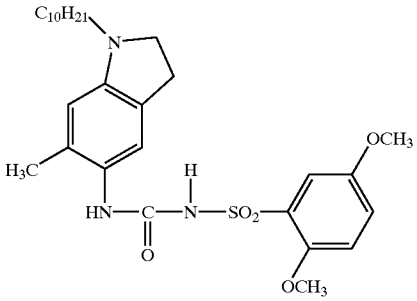

DEVP-62

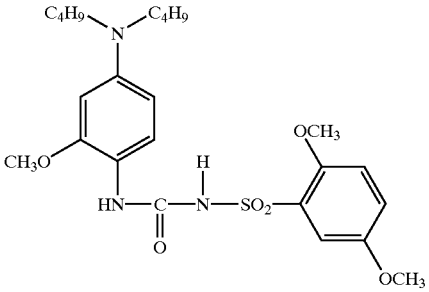

DEVP-63

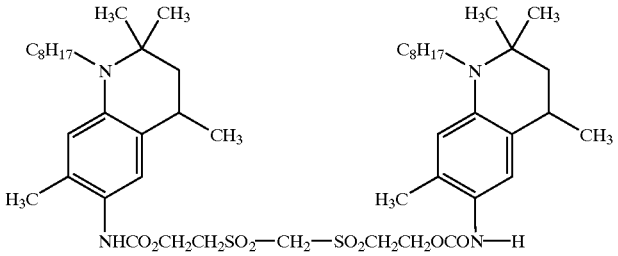

Also usable as the developing agents of aromatic primary amine derivatives are Compounds 1 to 36 disclosed in Japanese Patent Laid-Open No. 61-34540, pages 3 to 7; Compounds 1 to 32 disclosed in Japanese Patent Laid-Open No. 62-131253, pages 5 to 6; Compounds 1 to 53 disclosed in Japanese Patent Laid-Open No. 5-257225, pages 5 to 11; and Compounds 1 to 53 disclosed in Japanese Patent Laid-Open No. 5-249602, pages 5 to 12, and solid grain dispersions thereof. Preferable as the aromatic primary amine derivative developing agent is a blocked p-phenylenediamine compound, whose p-phenylenediamine moiety has a formula weight of 300 or more. Further, a derivative prepared by substituting the block group of the p-phenylenediamine compound by a hydrogen atom preferably exhibits an oxidation potential of 5 mV or less (vs. SCE) in an aqueous solution at pH of 10.

Developing agents disclosed in European Patent Publication Nos. 1,113,322, 1,113,323, 1,113,324, 1,113,325 and 1,113,326 are also preferably used in the present invention.

The developing agent may be added to the application liquid in the form of a solution, powder, a solid dispersion of fine grains, an emulsion, an oil-protected dispersion, etc. The solid dispersion of fine grains may be prepared by a known method using a ball mill, a vibration ball mill, a sand mill, a colloid mill, a jet mill, a roller mill, etc. A dispersant may be used in the preparation of the solid fine grain dispersion.

A molar ratio of the developing agent to the coupler is preferably 0.01 to 100, more preferably 0.1 to 10.

(E) Coupler

The coupler used in the present invention may be a known two-equivalent or four-equivalent coupler. Examples of the couplers known in the field of photography are disclosed in Nobuo Furutachi, "Organic Compounds For Conventional Color Photography," the Journal of Synthetic Organic Chemistry, Japan, Vol. 41, page 439, 1983; Research Disclosure No. 37038, February 1995, pages 80 to 85 and 87 to 89; etc.

Examples of the yellow image-forming couplers include pivaloylacetamide couplers; benzoylacetamide couplers; malonic diester couplers; malonic diamide couplers; dibenzoylmethane couplers; benzthiazolylacetamide couplers; malonic ester monoamide couplers; benzoxazolylacetamide couplers; benzimidazolylacetamido couplers; cycloalkylcarbonylacetamide couplers; indoline-2-yl-acetamide couplers; quinazoline-4-one-2-yl-acetamide couplers described in U.S. Pat. No. 5,021,332; benzo-1,2,4-thiadiazine-1,1-dioxide-3-yl-acetamide couplers described in U.S. Pat. No. 5,021,330; couplers described in European Patent No. 421221A; couplers described in U.S. Pat. No. 5,455,149; couplers described in European Patent Publication No. 0622673; and 3-indoloylacetamide couplers described in European Patent Publication Nos. 0953871, 0953872 and 0953873.

Examples of the magenta image-forming couplers include 5-pyrazolone couplers; 1H-pyrazolo[1,5-a]benzimidazole couplers; 1H-pyrazolo[5,1-c][1,2,4]triazole couplers; 1H-pyrazolo[1,5-b][1,2,4]triazole couplers; 1H-imidazo[1,2-b]pyrazole couplers; cyanoacetophenone couplers; active propene couplers described in WO 93/01523; enamine couplers described in WO 93/07534; 1H-imidazo[1,2-b][1,2,4]triazole couplers; and couplers described in U.S. Pat. No. 4,871,652.

Examples of the cyan image-forming couplers include phenol couplers; naphthol couplers; 2,5-diphenylimidazole couplers described in European Patent Publication No. 0249453; 1H-pyrrolo[1,2-b][1,2,4]triazole couplers; 1 H-pyrrolo[2,1-c][1,2,4]triazole couplers; pyrrole couplers described in Japanese Patent Laid-Open Nos. 4-188137 and 4-190347; 3-hydroxypyridine couplers described in Japanese Patent Laid-Open No. 1-315736; pyrrolopyrazole couplers described in U.S. Pat. No. 5,164,289; pyrroloimidazole couplers described in Japanese Patent Laid-Open No. 4-174429; pyrazolopyrimidine couplers described in U.S. Pat. No. 4,950,585; pyrrolotriazine couplers described in Japanese Patent Laid-Open No. 4-204730; couplers described in U.S. Pat. No. 4,746,602; couplers described in U.S. Pat. No. 5,104,783; couplers described in U.S. Pat. No. 5,162,196; and couplers described in European Patent No. 0556700; etc.

The amount of the coupler is preferably 0.2 to 200 mmol, more preferably 0.3 to 100 mmol, particularly 0.5 to 30 mmol, per one mol of silver in silver halide. The coupler may be used alone or in combination with the other coupler.

In the present invention, a functional coupler may be used in addition to the above-mentioned coupler contributing to coloring. Examples of the functional couplers include couplers forming dyes having appropriate diffusion properties described in U.S. Pat. No. 4,366,237, GB 2,125,570, EP 96,873B and DE 3,234,533; couplers for compensating the useless absorption of dyes, such as yellow-colored cyan couplers and yellow-colored magenta couplers described in EP 456,257A1, magenta-colored cyan couplers described in U.S. Pat. No. 4,833,069 and colorless masking couplers represented by (2) of U.S. Pat. No. 4,837,136 or formula (A) of WO 92/11575, particularly, exemplified compounds in pages 36 to 45; etc. Further, methine dye-releasing couplers described in U.S. Pat. Nos. 5,447,819 and 5,457,004, and Japanese Patent Laid-Open No. 2000-206655 are also preferably used in the present invention as yellow couplers. The compound Inv-16 described in Japanese Patent Laid-Open No. 2000-206655 and the compound I-5 described in U.S. Pat. No. 5,457,004 are illustrated below as CP-115 and CP-116, respectively.

CP-115

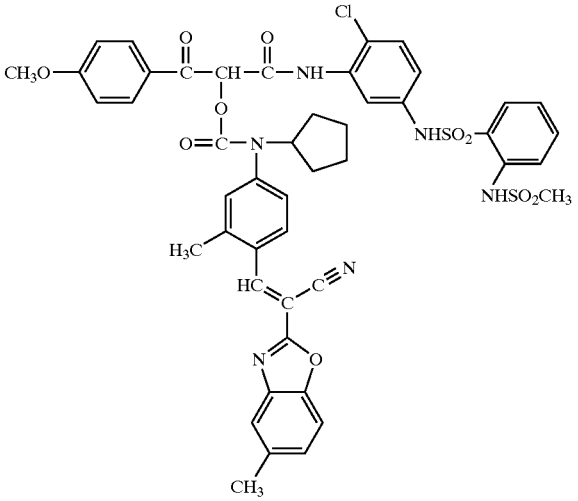

CP-116

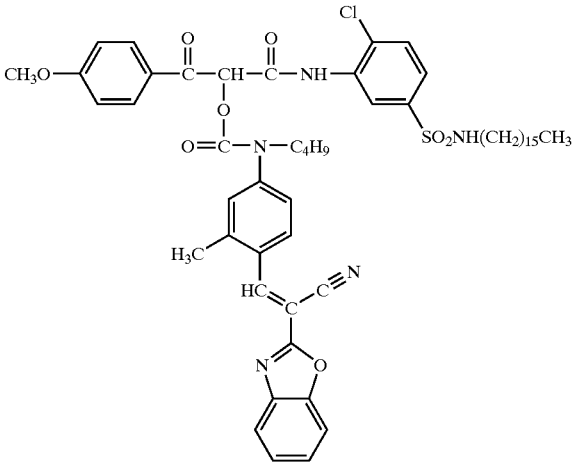

Compounds that react with an oxidized developing agent to release a photographically useful residue may be used in the present invention. Examples of such compounds include development inhibitor-releasing compounds such as compounds represented by any of formulae (I) to (IV) described in EP 378,236A1, page 11, compounds represented by formula (I) described in EP 436,938A2, page 7, compounds represented by formula (1) described in EP 568,037A and compounds represented by formula (I), (II) or (III) described in EP 440,195A2, pages 5 to 6; bleach accelerator-releasing compounds such as compounds represented by formula (I) or (I') described in EP 310,125A2, page 5, and compounds represented by formula (I) described in Japanese Patent Laid-Open No. 6-59411; ligand-releasing compounds such as compounds represented by LIG-X described in U.S. Pat. No. 4,555,478; leuco dye-releasing compounds such as compounds 1 to 6 described in columns 3 to 8 of U.S. Pat. No. 4,749,641; fluorescent dye-releasing compounds such as compounds represented by COUP-DYE described in U.S. Pat. No. 4,774,181; development accelerator- or fogging agent-releasing compounds such as compounds represented by formula (1), (2) or (3) described in U.S. Pat. No. 4,656,123, and compounds represented by ExZK-2 described in EP 450,637A2, page 75, lines 36 to 38; and compounds releasing a group acting as a dye such as compounds represented by formula (I) of U.S. Pat. No. 4,857,447, compounds represented by formula (1) of Japanese Patent Application No. 4-134523, compounds represented by formula (I), (II) or (III) described in EP 440,195A2, pages 5 and 6, compounds represented by formula (I) of Japanese Patent Application No. 4-325564 and compounds represented by LIG-X of U.S. Pat. No. 4,555,478.

The amount of each of the functional couplers and the compounds reactable with the oxidized developing agent to release the residue is preferably 0.05 to 10 mol, preferably 0.1 to 5 mol, per one mol of the above-mentioned coupler that acts to color.

Heterocyclic compounds having ClogP sufficient to improve sensitivity disclosed in EP 1016902 are preferably used in the present invention. A compound X is shown below as an example of the heterocyclic compound. Also preferably used are triazole compounds having ClogP of 4.75 to 9.0 disclosed in Japanese Patent Laid-Open No. 2001-051383; purine compounds having ClogP from 2 to less than 7.2 disclosed in Japanese Patent Laid-Open No. 2001-051384; mercapto-1,2,4-thiadiazole compounds and mercapto-1,2,4-oxadiazole compounds having ClogP from 1 to less than 7.6 disclosed in Japanese Patent Laid-Open No. 2001-051385; and tetrazole compounds having ClogP from 2 to less than 7.8 disclosed in Japanese Patent Laid-Open No. 2001-051386. These compounds may be added to the silver halide photosensitive material in the form of fine drops of a high-boiling point organic solvent in which they are dissolved, or to the binder in the form of a solution in a water-miscible solvent, like the other oil-soluble compounds such as the developing agent and the coupler. Further, the compounds may be converted to silver salts and then added to the photosensitive material. In this case, it may be added to the photosensitive material in the form of a solid dispersion.

Though the amount of the above compound may be determined in a wide range depending on use, it is generally $1\times10^{-5}$ to 1 mol per one mol of the silver halide. The amount of the above compound is preferably $10^{-3}$ to $10^{-1}$ mol per one mol of the silver halide, in the case of using the compound in a free state or in the form of an alkali metal salt, and preferably $10^{-2}$ to 1 mol per one mol of the silver halide in the case of using the compound in the form of a silver salt.

Compound X

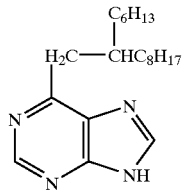

(F) Binder

The binder may be selected from known natural or synthetic resins such as gelatin, polyvinyl acetal, polyvinyl chloride, polyvinyl acetate, cellulose acetate, polyolefins, polyesters, polystyrene, polyacrylonitrile, polycarbonate, an SBR latex purified by ultrafiltration (UF), combinations thereof, etc.

The binder is preferably hydrophilic. Preferable hydrophilic binders are gelatin and combinations of gelatin and other water-soluble binders such as polyvinyl alcohol, modified polyvinyl alcohol, cellulose derivatives, polyacrylamide, etc.

The amount of the binder per 1 $m^2$ of the photograph-constituting layers is preferably 1 to 25 $g/m^2$, more preferably 3 to 20 $g/m^2$, particularly 5 to 15 $g/m^2$. The binder contains a gelatin in an amount of preferably 50 to 100 weight %, more preferably 70 to 100 weight %.

[2] Substrate

The substrate is preferably transparent and resistant to the processing temperature. The substrate may be made of a paper, a synthetic polymer, etc. described in the Society of Photographic Science of Japan, "Shashin Kogaku No Kiso, Ginen Shashin Hen (Fundamentals of Photographic Engineering, The Book of Silver Salt Photography)," Corona Co., Ltd., 1979, pages 223 to 240, etc. Examples of the substrate materials include polyethylene terephthalate, polyethylene naphthalate, polycarbonate, polyvinylchloride, polystyrene, polypropylene, polyimide, cellulose compounds such as triacetylcellulose, etc.

The substrate is preferably made of a polyester containing polyethylene naphthalate as a major component, a molar ratio of naphthalene dicarboxylic acid residues to the dicarboxylic acid residues being 50 mol % or more. The molar ratio is preferably 60 mol % or more, more preferably 70 mol % or more. Such polyester may be a copolymer or a polymer blend. The copolymer may comprise units of terephthalic acid, bisphenol A, cyclohexanedimethanol, etc. in addition to naphthalene dicarboxylic acid units and ethylene glycol units. From the viewpoint of a mechanical strength and costs, the copolymer preferably comprises the terephthalic acid units. In the polymer blend, polyethylene terephthalate (PET), polyarylate (PAr), polycarbonate (PC), polycyclohexanedimethanol terephthalate (PCT), etc. are preferably blended for compatibility. Particularly preferable among them is PET because of high mechanical strength and low cost.

When excellent resistance to heat and curling is required, substrates disclosed in Japanese Patent Laid-Open Nos. 6-41281, 6-43581, 6-51426, 6-51437 and 6-51442, Japanese Patent Application Nos. 4-251845, 4-231825, 4-253545, 4-258828, 4-240122, 4-221538, 5-21625, 5-15926, 4-331928,5-199704, 6-13455 and 6-14666, etc. are preferably used. Further, substrates made of styrene-based polymers having a syndiotactic skeleton are also preferably used in the present invention.

The thickness of the substrate is preferably 5 to 200 $\mu$m, more preferably 40 to 120 $\mu$m.

To improve the adhesion of the photograph-constituting layers to a substrate, the substrate is preferably subjected to a surface treatment. The surface treatment may be a chemical treatment, a mechanical treatment, a corona discharge treatment, a flame treatment, an ultraviolet treatment, a high-frequency wave treatment, a glow discharge treatment, an activated plasma treatment, a laser treatment, a mixed acid treatment, an ozone oxidation treatment, etc. Preferable among these surface treatments are the ultraviolet irradiation treatment, the flame treatment, the corona discharge treatment and the glow discharge treatment.

Preferably formed on the substrate is an undercoat that may be a single or more layers. Examples of binders used for the undercoat include homopolymers and copolymers prepared from such monomers as vinyl chloride, vinylidene chloride, butadiene, methacrylic acid, acrylic acid, itaconic acid and maleic anhydride; polyethylene imine; epoxy resins; grafted gelatin; nitrocellulose; gelatin; polyvinyl alcohol; modified polymers thereof, etc. To swell the substrate, resorcin or p-chlorophenol may be used. The undercoat may comprise a gelatin-hardening agent, examples of which include chromium salts such as chromium alum; aldehyde compounds such as formaldehyde and glutaric aldehyde; isocyanate compounds; active halogen compounds such as 2,4-dichloro-6-hydroxy-s-triazine; epichlorohydrin resins; active vinylsulfonic compounds, etc. The undercoat may further comprise a matting agent such as $SiO_2$, $TiO_2$, fine inorganic particles and methyl methacrylate copolymer particles (0.01 to 10 $\mu$m).

Dyes or pigments used for coloring a film constituting the substrate preferably have a gray color, taking into consideration the general properties of the silver halide photosensitive material. The dyes or pigments preferably have excellent heat resistance at a film-forming temperature and excellent compatibility with polyesters. The dyes or pigments are preferably mixtures of "Diaresin" manufactured by Mitsubishi Chemical Industries, Ltd., "Kayaset" manufactured by Nippon Kayaku Co., Ltd., etc. In particular, anthraquinone-based dyes or pigments disclosed in Japanese Patent Laid-Open No. 8-122970 are preferably used for their heat resistance.

Preferably formed on the substrate is a magnetic recording layer described in Japanese Patent Laid-Open Nos. 4-124645, 5-40321, 6-35092 and 6-317875, etc., to record photographic information. The magnetic recording layer may be formed on the substrate by applying thereto a liquid comprising magnetic particles dispersed in a binder and an aqueous or organic solvent. Materials of the magnetic particles may be ferromagnetic iron oxides such as $\gamma$-$Fe_2O_3$; Co-deposited $\gamma$-$Fe_2O_3$; Co-deposited magnetite; Co-containing magnetite; ferromagnetic chromium dioxide; ferromagnetic metals; ferromagnetic alloys; hexagonal Ba-ferrite, Sr-ferrite, Pb-ferrite, Ca-ferrite, etc. Preferable among them are Co-deposited ferromagnetic iron oxides such as Co-deposited $\gamma$-$Fe_2O_3$. The magnetic particles may be in the shape of a needle, a rice grain, a sphere, a cube, a plate, etc. The magnetic particles have a specific surface area of preferably 20 $m^2/g$ or more, particularly 30 $m^2/g$ or more in SBET. The saturation magnetization ($\sigma s$) of the ferromagnetic material is preferably $3.0\times10^4$ to $3.0\times10^5$ A/m, particularly $4.0\times10^4$ to $2.5\times10^5$ A/m. The ferromagnetic particles may be surface-treated with silica and/or alumina, or with an organic substance. As described in Japanese Patent Laid-Open No. 6-161032, the magnetic particles may be surface-treated with a silane coupling agent or a titanium coupling agent. Further, magnetic particles covered with an inorganic or organic substance described in Japanese Patent Laid-Open Nos. 4-259911 and 5-81652 may be used in the present invention.

The surface conditions of the substrate may be improved, for example, by coating electrically conductive, fine, inorganic particles of $SnO_2$, $Sb_2O_5$, etc. The edges of the substrate are preferably knurled and slightly raised to prevent the shape of the core at its cut edge from being transferred to the substrate. An ultraviolet absorbent may be incorporated into the substrate. Also, a dye or a pigment such as "Diaresin" manufactured by Mitsubishi Chemical Industries, Ltd. and "Kayaset" manufactured by Nippon Kayaku Co., Ltd. may be incorporated into the substrate to prevent light pumping.

The substrate may be coated with a back layer comprising an anti-static agent, a slipping agent, etc.

To make the polyester substrate more resistant to curling, the polyester substrate is preferably subjected to a heat treatment. The heat treatment is carried out at a temperature in a range of preferably from 40° C. to Tg, more preferably from Tg-20° C. to Tg. The heat treatment may be carried out at a constant temperature in the above range or while cooling. The heat treatment is carried out preferably for 0.1 to 1,500 hours, more preferably for 0.5 to 200 hours. The substrate may be heat-treated in the state of a roll or a web being conveyed. Though the heat treatment may be carried out at any stage, for example, after the formation of the substrate, after the surface treatment, after coating the back layer, after coating the undercoat, etc., it is preferably carried out after forming the back layer comprising the antistatic agent.

[3] Others

Though a base is generally needed for the development of conventional silver halide photosensitive materials for shooting, the first and second silver halide photosensitive materials of the present invention do not necessarily contain a base. A base may be used for the purposes of the acceleration of development, reaction between the developing agent and the coupler, the color development of the resultant dye, etc. in the present invention.

The base may be inorganic or organic. Examples of such bases include hydroxides, phosphates, carbonates, borates and organic acid salts of alkaline metals or alkaline earth metals described in Japanese Patent Laid-Open No. 62-209448; acetylides of alkaline metals or alkaline earth metals described in Japanese Patent Laid-Open No. 63-25208; ammonia; aliphatic or aromatic amine compounds such as primary amine compounds, secondary amine compounds, tertiary amine compounds, polyamine compounds, hydroxylamine compounds and heterocyclic amine compounds; amidine compounds; bis-, tris- or tetra-amidine compounds; guanidine compounds; mono-, bis-, tris- or tetra-guanidine water-insoluble compounds; hydroxides of quaternary ammonium; etc. Decarboxylation-type precursors, decomposition-type precursors, reaction-type precursors, complex salt-forming precursors, etc. may be used as precursors for the bases. Examples of the bases and the base precursors are described in "Kochi Gijutsu (Known Technology)," No. 5, Mar. 22, 1991, AZTEC Corporation, pages 55 to 88.

In the present invention, the base may be prepared from a combination of a basic metal compound with poor water solubility and a compound that can react with the metal ion of the basic metal compound to form a complex in water, as described in EP 210,660 and U.S. Pat. No. 4,740,445. In a preferred example of this combination, fine zinc hydroxide particles are used for the silver halide photosensitive material, and a picolinic acid salt such as guanidine picolinate is used for development.

A base precursor that is heated to form (or release) a base in the thermal development process is preferably used for the first and second silver halide photosensitive materials. A typical example of such base precursors is a thermal decomposition-type (decarboxylation-type) base precursor of a salt prepared from a carboxylic acid and a base. When the decarboxylation-type base precursor is heated, the carboxyl group is decomposed by a decarboxylation reaction to release a base. The carboxylic acid may be sulfonylacetic acid, propiolic acid, etc., which are easily decarboxylated. The sulfonylacetic acid and the propiolic acid preferably have an aromatic group such as an aryl group and an unsaturated heterocyclic group that accelerates the decarboxylation. The base precursors of the sulfonyl acetic acid salt are described in Japanese Patent Laid-Open No. 59-168441, and the base precursors of the propiolic acid salt are described in Japanese Patent Laid-Open No. 59-180537.

The base composing the decarboxylation-type base precursor is preferably an organic base, more preferably amidine, guanidine or a derivative thereof. The organic base is preferably a diacidic base, a triacidic base or a tetracidic base, more preferably a diacidic base, particularly a diacidic base of an amidine derivative or a guanidine derivative.

The precursors of the diacidic base, the triacidic base and the tetracidic base of the amidine derivative are described in Japanese Patent Publication No. 7-59545. The precursors of the diacidic base, the triacidic base and the tetracidic base of the guanidine derivative are described in Japanese Patent Publication No. 8-10321.

The diacidic base of the amidine derivative or the guanidine derivative is composed of: (A) two amidine moieties or two guanidine moieties, (B) a substituent in the amidine moieties or the guanidine moieties, and (C) a divalent group linking the amidine moieties or the guanidine moieties. Examples of the substituents (B) include alkyl groups that may be cyclic, alkenyl groups, alkynyl groups, aralkyl groups and heterocyclic groups. A plurality of substituents may be bonded to each other to form nitrogen-containing heterocycles. The divalent linking group (C) is preferably an alkylene group or a phenylene group. Preferred examples of the diacidic base precursors of the amidine or guanidine derivatives include BP-1 to BP-41 disclosed in Japanese Patent Laid-Open No. 11-231457, pages 19 to 26. Particularly preferable among them are salts of p-(phenylsulfonyl)-phenylsulfonyl acetic acid such as BP-9, BP-32, BP-35, BP-40 and BP-41 shown below.

(BP-9)

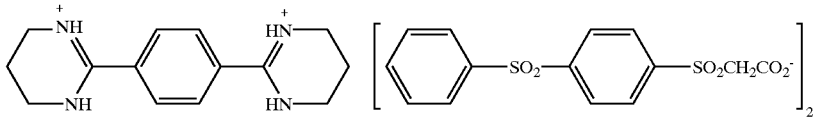

(BP-32)

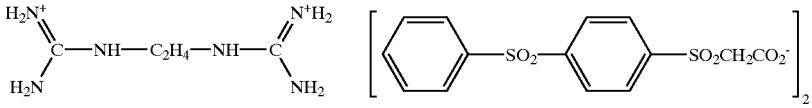

(BP-35)

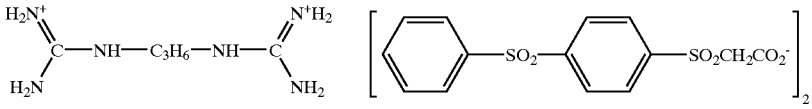

(BP-40)

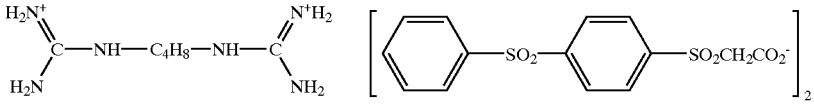

(BP-41)

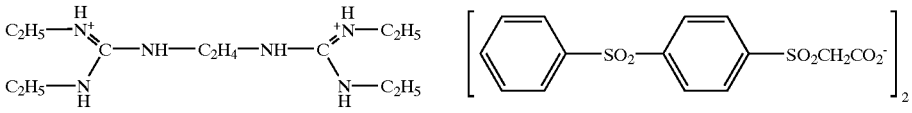

A molar ratio of the base precursor to the developing agent is preferably 0.01 to 10, more preferably 0.05 to 5. The base precursor is dispersed preferably in the form of fine solid particles.

A film patrone (or a film cartridge) for the first and second silver halide photosensitive materials of the present invention may be made of a metal, a synthetic plastic, etc. The film patrone may have a structure feeding a film out by rotating a spool. The film patrone may also have a structure in which a film front edge is accommodated in the film patrone body and fed through a port of the film patrone by rotating a spool shaft in a film-feeding direction. These film patrones are disclosed in U.S. Pat. No. 4,834,306 and 5,226,613, etc.

The first and second silver halide photosensitive material according to the present invention may be preferably used for a film unit with a lens described in Japanese Patent Publication No. 2-32615, Japanese Utility Model Publication No. 3-39784, etc. The film unit generally comprises a taking lens and a shutter enclosed in an injection-molded plastic housing, with an unexposed silver halide photosensitive material for color or monochrome photographing incorporated therein in a light-tight manner. The film unit is sent to a processing laboratory after shooting, where the film is removed from the unit, developed and printed.

[4] Method for Forming Image

The first and second silver halide photosensitive materials according to the present invention may be used as heat-developable photosensitive materials that are developed at a development temperature of 100° C. or higher. The silver halide photosensitive material may be heated by bringing it into contact with a heated block or plate; by using a hot plate, a hot presser, a hot roller, a hot drum, a halogen lamp heater, an infrared or far-infrared lamp heater, etc.; or by passing it through a high-temperature atmosphere, etc. In addition to usual electric heaters and lamp heaters, a heated liquid, a dielectric heater, a microwave heater, etc. may be used as a heat source. The first and second silver halide photosensitive materials of the present invention are preferably heat-developed in contact with the heat source such as a hot roller or a hot drum. Such thermal development is described in Japanese Patent Publication No. 5-56499, Japanese Patent No. 684453, Japanese Patent Laid-Open Nos. 9-292695 and 9-297385, WO95/30934, etc. Non-contact-type thermal development methods described in Japanese Patent Laid-Open No. 7-13294, WO97/28489, WO97/28488, WO97/28487, etc. may also be used in the present invention. The developing temperature after the exposure is preferably 100 to 350° C., more preferably 100 to 200° C., particularly 130 to 180° C. The developing period is preferably 1 to 60 seconds, more preferably 5 to 60 seconds, particularly 5 to 30 seconds.

An electroconductive heating element layer may be formed in the silver halide photosensitive material and/or a processing member thereof as a heating means for the thermal development. The heating element layer described in Japanese Patent Laid-Open No. 61-145544, etc. may be used in the present invention.

Generally, the film of the silver halide photosensitive material is separated from the film patrone or cartridge to be thermally developed after shooting. A method disclosed in Japanese Patent Laid-Open No. 2000-171961 is also preferably used in the present invention, in which the thermal development is carried out while pulling the film out of a thrust cartridge and the developed film is reset in the thrust cartridge after the development is finished. Further, the entire patrone or cartridge containing the silver halide photosensitive material may be heated to thermally develop the photosensitive material.

In the present invention, it is not necessary to remove the developed silver and the undeveloped silver halide after the development. To reduce image-reading load and to improve image-keeping properties, an image may be obtained after the developed silver and the undeveloped silver halide are removed or processed to reduce optical load. The process for reducing optical load may be, for example, complexing or solubilization of the silver halide, thereby reducing light scattering by the silver halide grains. The process may be carried out during or after the development. To remove the developed silver or to complex or solubilize the silver halide in the photosensitive material after the development, the silver halide photosensitive material may be soaked in a liquid comprising a silver-oxidizing agent, a re-halogenation agent or a solvent for a silver halide, or such a liquid may be sprayed or applied to the photosensitive material. It is also possible to remove the developed silver and to complex or solubilize the silver halide, by attaching a processing member containing such a liquid to the photosensitive material and heating it.

In the present invention, the image formed on the thermally developed photosensitive material may be read and converted to a digital signal. The image may be read by a known image input device. The image input device is described in detail in Takao Ando, "Fundamentals of Digital Image Input," Corona Co., Ltd., 1998, pages 58 to 98. The image input device should take vast image information efficiently, and are classified to a linear sensor type and an area sensor type in terms of the arrangement of extremely small point sensors. The point sensors in the linear sensor are arranged linearly, and either one of the silver halide photosensitive material and the linear sensor should be scanned to take image information on a sheet. Thus, although it takes longer time to read the image, the linear sensor can be produced at a low cost. On the other hand, because the area sensor can read the image information without scanning, it is high in an information-reading speed. However, the area sensor is expensive because it uses a large sensor. Which sensor is used may be determined depending on its purposes.

Usable as the above sensors are electron tube-type sensors such as an image pickup tube, an image tube, etc., and solid image pickup-type sensors such as a CCD sensor, a MOS sensor, etc. Preferable from the viewpoint of cost and simplicity in handling are the solid image pickup-type sensors, particularly the CCD sensor. An apparatus comprising such an image input device may be a digital still camera, a drum scanner, a flatbed scanner, a film scanner, etc. Among them, the film scanner is preferable to read image at high quality with ease.

Preferred examples of the film scanners are a scanner comprising a linear CCD, such as "Film Scanner LS-1000" manufactured by Nikon Corporation, "Duo Scan HiD" manufactured by Agfa-Gevaert Japan, Ltd., and "Flextight Photo" manufactured by Imacon, Inc.; a scanner comprising an area CCD, such as "RFS3570" manufactured by Eastman Kodak Company; etc. An image input device comprising an area CCD, which is installed in a digital printing system "Frontier" manufactured by Fuji Photo Film Co., Ltd., is also preferably used in the present invention. An image input device of "Frontier F350" described in Yoshio Ozawa, "Fuji Photo Film Research Report," No. 45, pages 35 to 41 can rapidly read image information with high quality by a linear CCD sensor, thus particularly suitable for reading the photosensitive material of the present invention.

The image formed on the silver halide photosensitive material may be treated by an image-treating method described in Japanese Patent Laid-Open No. 6-139323, in which a subject image formed on a color negative is converted to image data by a scanner, etc. and the color of the subject is faithfully reproduced from the demodulated color information of the negative film. Usable as the image-treating method to reduce granulation or noise of the digitalized image and to increase the sharpness are a method described in Japanese Patent Laid-Open No. 10-243238, in which weighting of edge and noise, a subdivision treatment, etc. are carried out based on sharpness-enhanced image data, smoothed image data and edge-detected data; and a method described in Japanese Patent Laid-Open No. 10-243239, in which the edge component is evaluated based on the sharpness-enhanced image data and the smoothed image data to achieve the weighting, the subdivision, etc.

To correct the change of color reproducibility in a final print depending on the storage and development conditions of the photosensitive material, etc., a method described in Japanese Patent Laid-Open No. 10-255037 may be used in the present invention. This method comprises the steps of: exposing patches of 4 or more stages or colors on the unexposed portions of the photosensitive material; developing the photosensitive material; measuring the concentrations of the patches to obtain a look-up table and a color-conversion matrix for the correction; correcting the colors of the image using the look-up table conversion or the matrix operation. To convert the color reproductive region of the image data, for example, a method described in Japanese Patent Laid-Open No. 10-229502 may be used, in which image data are expressed by color signals generating a color visually recognized as a neutral color when the numerals of respective components are arranged in order, and the color signals are decomposed to chromatic color components and achromatic color components, which are separately treated.

An image-processing method described in Japanese Patent Laid-Open No. 11-69277 may be used to eliminate the deterioration of image quality resulting from the aberration of a camera lens and reduction in peripheral lamination in image taken by the camera. In this method, a grating correction pattern for producing data for correcting the deterioration In of image quality is recorded on the film in advance, and image and the correction pattern are read by a film scanner after shooting to produce data for correcting deterioration factors by a camera lens, which is used to correct the digital image data.

Excess sharpness in a skin color and a blue sky color results in large granular noise, giving unpleasant impression.

Thus, the level of sharpness in a skin color and a blue sky color in the image is preferably controlled, and usable for this purpose is, for instance, a method described in Japanese Patent Laid-Open No. 11-103393, in which a sharpness-emphasizing processing using an un-sharp masking (USM) is performed with a USM coefficient as a function of (B−A)(R−A). The skin color, the grass green color and the sky blue color are important in color reproduction and thus require selective color-reproducing treatment. As for the reproduction of brightness, it appears visually preferable that the skin color is finished brighter and the sky blue color is finished darker. The reproduction of important colors with visually preferable brightness may be achieved by a method described in Japanese Patent Laid-Open No. 11-177835, in which chrominance signals of each pixel are converted by using a coefficient that is comparatively small when hue corresponding to chrominance signal is yellowish red, and comparatively large when the hue is cyan blue such as (R-G) and (R-B).

Usable to compress color image data is a method described in Japanese Patent Laid-Open No. 11-113023, in which signals of each pixel are separated into a luminance component and a chrominance component, and a hue template having a numeric pattern most adapted to a concerned chrominance component is selected from a plurality of a hue templates prepared for the chrominance component in advance, thereby coding the chrominance information. To perform image emphasis in a treatment for increasing saturation or sharpness without decoloration, highlight jump, paint-out of colors in a high-density portion and the formation of data outside a defined region, image-processing method and apparatus described in Japanese Patent Laid-Open No. 1-177832 may be used in the present invention. In this method, the density data of colors are converted to exposure density data using characteristic curves, the exposure density data are subjected to image processing including the color emphasis, and the processed exposure density data are converted to processed density data using characteristic curves.

The present invention will be specifically described below with reference to Examples without intention of restricting the scope of the present invention.

EXAMPLE 1

1. Production of Silver Halide Color Photosensitive Material (a) Preparation of Silver Iodobromide Emulsion $H_2SO_4$ was added to 1000 ml of an aqueous solution containing 3 g of oxidized gelatin having an average molecular weight of 15,000 and 0.37 g of potassium bromide, to control the pH of the aqueous solution to 2. Added to this solution were 15 ml of an aqueous silver nitrate solution (0.3 M) and 15 ml of an aqueous potassium bromide solution (0.3 M) simultaneously by a double-jet method over 30 seconds, while stirring the aqueous solution at 40° C. An aqueous NaOH solution (1 N) was then added to the resultant reaction solution to control its pH at 8.0, and potassium bromide was added thereto to control its pAg at 9.9. The resultant solution was heated at 75° C. over 45 minutes. 6 ml of an aqueous solution containing 3 mg of sodium benzenethiosulfonate was added to the reaction solution after 5 minutes from the addition of the aqueous NaOH solution.

35 g of succinated gelatin was added to the reaction solution, and 921 ml of an aqueous silver nitrate solution (1.2 M) and 800 ml of an aqueous potassium bromide solution (1.4 M) were then added thereto over 33 minutes while maintaining the pAg at 8.58. The flow rate of each of the aqueous silver nitrate solution and the aqueous potassium bromide solution was increased such that the flow rate at the time of completion was as high as 7.2 times that at start.

The reaction solution was cooled to 40° C., and 100 ml of an aqueous solution containing 0.025 mol of a salt of sodium p-iodoacetoamide benzenesulfonate and water was added thereto to control the pH of the reaction solution to 9.0. The thus obtained reaction solution was mixed with 50 ml of an aqueous solution containing 4.3 g of sodium sulfite, maintained at 40° C. for 3 minutes, and heated to 55° C. The pH of the reaction solution was controlled to 5.8, and 0.8 mg of sodium benzenethiosulfonate, 0.04 mg of potassium hexachloroiridate (IV) and 5.5 g of potassium bromide were then added to the reaction solution. The resultant mixture was maintained at 55° C. for 1 minute. An aqueous potassium bromide solution was added to this solution to control its pAg at 8.8, and 115 ml of an aqueous silver nitrate solution (1.8 M) and 131 ml of an aqueous potassium bromide solution (1.8 M) containing 8.9 mg of potassium hexacyanoferrate (II) were added thereto, to prepare an emulsion.

The emulsion was cooled down to 35° C., washed by a flocculation method using "DEMOL N" manufactured by Kao Corporation as a h 10 flocculent, and desalted. A delimed gelatin in an amount of 7 weight % was added to the resulting emulsion. Further added to the resulting emulsion were the following compounds (1) and (2), calcium nitrate and a 2-% aqueous solution of zinc nitrate $6H_2O$ to control the pH at 6.2, to prepare a silver iodobromide emulsion A-1.

Compound (1)

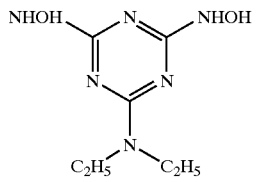

Compound (2)

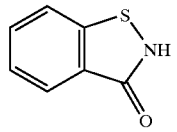

In the silver iodobromide emulsion A-1, more than 99% of the total projected area of the silver iodobromide grains were occupied by hexagonal tabular silver iodobromide grains. The hexagonal tabular silver iodobromide grains had an average equivalent sphere diameter defined as an average diameter of spheres having equivalent grain volumes of 0.86 μm, an average thickness of 0.17 μm, an average equivalent circle diameter of 1.55 μm, and an average aspect ratio of 9.

A silver iodobromide emulsion A-2 was prepared in the same manner as in the preparation of the silver iodobromide emulsion A-1, except that the number of nuclei was changed by controlling the amounts of silver nitrate and potassium bromide added at the initial stage of grain formation, that the amounts of potassium hexachloroiridate (IV) and potassium hexacyanoferrate (II) were controlled inversely to that of the silver iodobromide grains, and that the amount of the sodium p-iodoacetoamide benzenesulfonate-water salt was controlled in proportion to the circumference length of the silver iodobromide grains. The silver iodobromide emulsion A-2 was composed of hexagonal tabular silver iodobromide grains having an average equivalent sphere diameter of 0.52 μm, an average thickness of 0.10 μm, an average equivalent circle diameter of 0.94 μm and an average aspect ratio of 10.

The silver iodobromide emulsion A-1 was mixed with $8.2\times10^{-4}$ mol of the following blue-sensitizing dye (1) at 60° C. and then with potassium thiocyanate, chlorauric acid, sodium thiosulfate and mono(pentafluorophenyl) diphenylphosphine selenide for spectral sensitization and chemical sensitization. A molar ratio of the blue-sensitizing dye (1) to the silver iodobromide emulsion A-1 was $2.5\times10^{-4}$ mol/mol-Ag. After the spectral sensitization and the chemical sensitization, the following stabilizer S1 was added to the sensitized emulsion to prepare a blue-sensitive silver iodobromide emulsion A-1b. A molar ratio of the stabilizer S1 to the silver iodobromide emulsion A-1 was $2.0\times10^{-4}$ mol/mol-Ag. Further, a blue-sensitive silver iodobromide emulsion A-2b was prepared in the same manner as in the blue-sensitive silver iodobromide emulsion A-1b, except that the silver iodobromide emulsion A-2 was used in place of the silver iodobromide emulsion A-1, and that the amounts of the blue-sensitizing dye (1), potassium thiocyanate, chlorauric acid, sodium thiosulfate and mono (pentafluorophenyl)diphenylphosphine selenide were changed.

Blue-Sensitizing Dye (1)

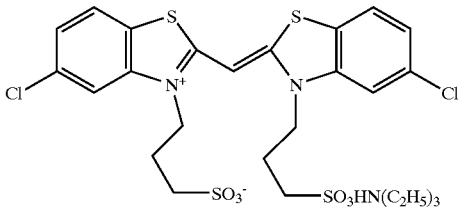

-continued

Stabilizer S1

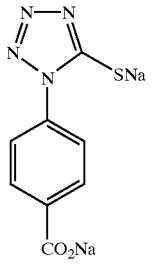

Green-sensitive silver iodobromide emulsions A-1 g and A-2g were prepared in the same manner as in the preparation of the blue-sensitive silver iodobromide emulsions A-1b and A-2b, except for using the following green-sensitizing dyes (1), (2) and (3) in place of the blue-sensitizing dye (1). Red-sensitive silver iodobromide emulsions A-1r and A-2r were prepared in the same manner as in the preparation of the blue-sensitive silver iodobromide emulsions A-1b and A-2b, except for using the following red-sensitizing dyes (1), (2) and (3) in place of the blue-sensitizing dye (1). Molar ratios of the green-sensitizing dyes (1), (2) and (3) to the silver iodobromide emulsion A-1 were $5.5\times10^{-4}$ mol/mol-Ag, $1.3\times10^{-4}$ mol/mol-Ag and $4.8\times10^{-5}$ mol/mol-Ag, respectively. Molar ratios of the red-sensitizing dyes (1), (2) and (3) to the silver iodobromide emulsion A-1 were $2.5\times10^{-4}$ mol/mol-Ag, $6.3\times10^{-5}$ mol/mol-Ag and $3.1\times10^{-4}$ mol/mol-Ag, respectively.

Green-Sensitizing Dye (1)

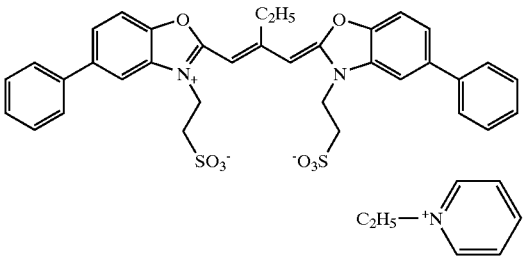

Green-Sensitizing Dye (2)

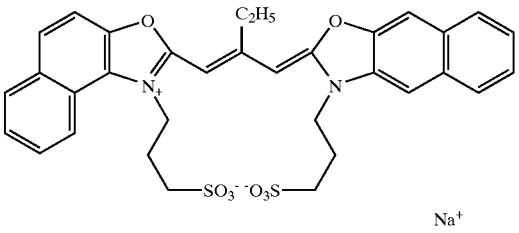

Green-Sensitizing Dye (3)

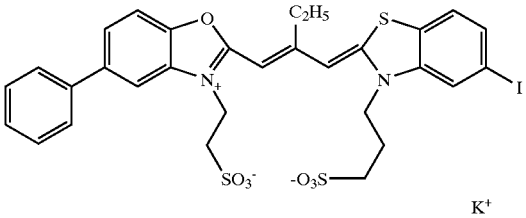

Red-Sensitizing Dye (1)

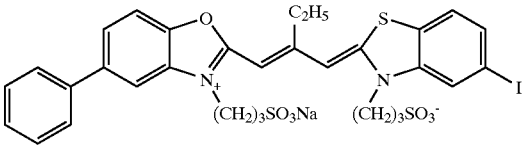

Red-Sensitizing Dye (2)

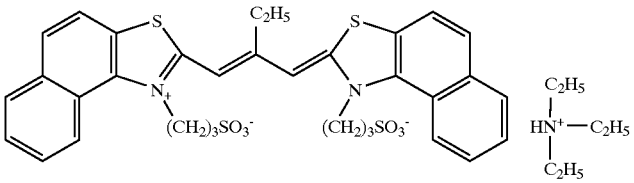

-continued

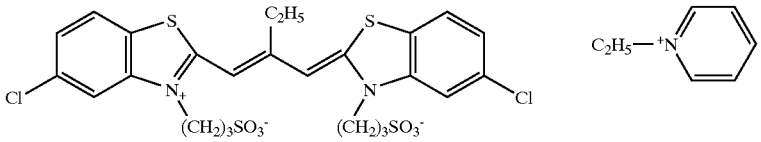

Red-Sensitizing Dye (3)

(b) Preparation of [111] High-Silver Chloride Emulsion 1200 ml of an aqueous solution containing 2.1 g of cross-linked, deionized, alkali-treated, high-molecular bone gelatin and 2 g of sodium chloride was charged into a reaction vessel and maintained at 35° C. Added thereto were 60 ml of an aqueous solution containing 7.2 g of silver nitrate and 60 ml of an aqueous solution containing 2.6 g of sodium chloride simultaneously over 1 minute while strongly stirring the solution.

One minute after the addition, 80 ml of an aqueous solution containing 0.494 g of the following crystal habit-controlling agent (1) was added to the resultant reaction solution, and after 1 minute, 60 ml of a sodium chloride 10% aqueous solution was added thereto. The resulting reaction solution was heated to 75° C. over 50 minutes, and after 10 minutes, 450 ml of an aqueous solution containing 45 g of phthalated gelatin was added thereto. After 3 minutes, 40 ml of an aqueous solution containing the following crystal habit-controlling agent (1) was added to the reaction solution, and after 1 minute, 768 ml of an aqueous solution containing 113 g of silver nitrate and 786 ml of an aqueous solution containing 32 g of sodium chloride and 15 g of potassium bromide were added thereto simultaneously at a initial rate of 2.85 ml/min and at an acceleration of 0.818 ml/min$^2$.

The resultant reaction solution was cooled down to 40° C., and 340 ml of a 1-% aqueous potassium bromide solution was added thereto over 3 minutes, and after 5 minutes, 30 ml of an aqueous solution containing 11 g of silver nitrate and 30 ml of an aqueous solution containing 3.9 g of sodium chloride, 0.02 g of potassium ferrocyanide and 1.6 g of potassium iodide were added thereto over 5 minutes. After 3 minutes, 159 ml of a 2-mM solution of the following blue-sensitizing dye (2) in water/methanol (water/methanol=1/1) was added thereto, and the resultant solution was heated to 75° C. and maintained at that temperature for 15 minutes.

The reaction solution was cooled to 35° C., desalted by the following flocculent (1), and subjected to a dispersion treatment using 67 g of deionized, alkali-treated bone gelatin, 30 ml of a 2-% aqueous solution of zinc nitrate-$6H_2O$, the Compound (1) and phenoxyethanol while controlling the pH at 6.3 and the pAg at 7.7. Sodium benzenethiosulfonate, a mixture of sodium thiosulfate and the following Compound (3) acting as a tellurium sensitizer (molar ratio: 1/1), and chlorauric acid were then added successively to the resulting dispersion to perform chemical sensitization at 60° C., thereby providing a blue-sensitive, [111] high-silver chloride emulsion B-1b. 80 ml of a 2-mM solution of the following blue-sensitizing dye (3) in water/methanol (water/methanol=1/1) was added to the mixture 15 minutes before finishing the chemical sensitization. The chemical sensitization was stopped by the following stabilizer S2.

The blue-sensitive, [111] high-silver chloride emulsion B-1b comprised [111] tabular silver chlorobromide grains having an average equivalent sphere diameter of 0.9 μA, an average thickness of 0.16 μn, an average equivalent circle diameter of 1.75 μm, an average aspect ratio of 11 and a silver bromide content of 20 mol %.

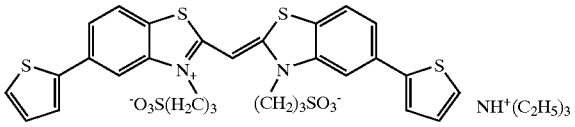

Crystal Habit-Controlling Agent (1)

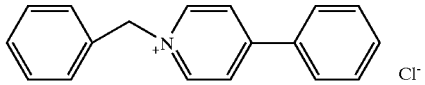

Flocculent (1)

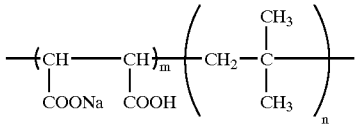

Compound (3)

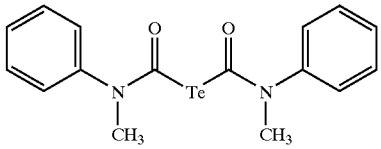

Blue-Sensitizing Dye (3)

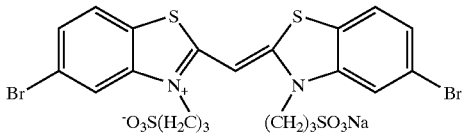

Stabilizer S2

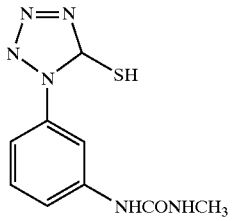

A blue-sensitive, [111] high-silver chloride emulsion B-2b was prepared in the same manner as in the preparation of the blue-sensitive [111] high-silver chloride emulsion B-1b, except that the number of nuclei was changed by controlling the amounts of silver nitrate and sodium chloride added at the initial stage of grain-formation, and that the amounts of the crystal habit-controlling agent (1) and the blue-sensitizing dyes (2) and (3) were changed. The blue-sensitive [111] high-silver chloride emulsion B-2b was composed of hexagonal tabular high-silver chloride grains having an average equivalent sphere diameter of 0.55 μm, an average thickness of 0.11 μm, an average equivalent circle diameter of 1.0 μm and an average aspect ratio of 9.

Green-sensitive [111] high-silver chloride emulsions B-1 g and B-2g were prepared in the same manner as in the preparation of the blue-sensitive [111] high-silver chloride emulsions B-1b and B-2b except for using the green-sensitizing dyes (1), (2) and (3) in place of the blue sensitizing dyes (2) and (3). Red-sensitive, [111] high-silver chloride emulsions B-1r and B-2r were prepared in the same manner as in the preparation of the blue-sensitive, [111] high-silver chloride emulsions B-1b and B-2b except for using the red-sensitizing dyes (1), (2) and (3) in place of the blue-sensitizing dyes (2) and (3). The amounts of the green-sensitizing dyes (1), (2) and (3) and the red-sensitizing dyes (1), (2) and (3) added were the same as those in the preparation of the green-sensitive silver iodobromide emulsions A-1 g and A-2g and the red-sensitive silver iodobromide emulsions A-1r and A-2r.

(c) Preparation of [100] high-silver chloride emulsion 1000 ml of an aqueous gelatin solution at pH of 4.6 containing 21 g of deionized, alkali-treated bone gelatin, 0.8 g of sodium chloride and 3.8 ml of sulfuric acid (1N) was charged into a reaction vessel and heated to 42° C. 30 ml of an aqueous solution containing 11 g of silver nitrate, and 30 ml of an aqueous solution containing 0.4 g of potassium bromide and 3.7 g of sodium chloride were added thereto simultaneously over 45 seconds while strongly stirring the solution.

After the addition, the thus obtained reaction solution was stirred for 10 minutes and cooled to 30° C. over 3 minutes. 50 ml of an aqueous solution containing 1.1 g of potassium bromide was added to the reaction solution over 30 seconds at the start of cooling. 92 ml of an aqueous solution containing 33.8 g of silver nitrate, and 92 ml of an aqueous solution containing 11.68 g of sodium chloride were then added simultaneously to the reaction solution over 2 minutes and 15 seconds, and the resultant solution was stirred for 1 minute. 17 ml of a 10-% aqueous sodium chloride solution and 5 ml of a 1-N aqueous sodium hydroxide solution were added thereto to control the pH at 6.5, and the resulting mixture was then heated to 65° C. and aged for 3 minutes.

To the mixture thus obtained were added 600 ml of an aqueous solution containing 120 g of silver nitrate and 600 ml of an aqueous solution containing 4.2 g of potassium bromide and 39.1 g of sodium chloride over 40 minutes while maintaining the silver potential (vs. SCE) of 120 mV. The flow rate of the aqueous solutions added was finally doubled from the initial flow rate of 10 ml/min.

The resultant mixture were then mixed with 75 ml of an aqueous solution containing 15 g of silver nitrate, and 75 ml of an aqueous solution containing 0.3 g of potassium iodide, 0.5 g of potassium bromide, 4.9 g of sodium chloride and 0.02 g of potassium ferrocyanide over 10 minutes while maintaining the silver potential (vs. SCE) of 120 mV. Further added thereto was 102 ml of an aqueous solution containing 9 g of delimed gelatin. 10 minutes after the addition, the mixture was cooled to 35° C. and desalted by a flocculation method using "DEMOL N" manufactured by Kao Corporation as a flocculent, to prepare a [100] high-silver chloride emulsion C-1.

The [100] high-silver chloride emulsion C-1 comprised [100] tabular silver chlorobromide grains having an average equivalent sphere diameter of 0.93 μm, an average thickness of 0.18 μm, an average equivalent circle diameter of 1.75 μm, an average aspect ratio of 9 and a silver bromide content of 5 mol %.

A [100] high-silver chloride emulsion C-2 was prepared in the same manner as in the preparation of the [100] high-silver chloride emulsion C-1, except that the amounts of silver nitrate, potassium bromide and sodium chloride added at the initial stage of grain formation were changed, and that the number of nuclei was changed by controlling the amount of potassium bromide added at the second stage. The [100] high-silver chloride emulsion C-2 comprised hexagonal tabular silver iodobromide grains having an average equivalent sphere diameter of 0.6 μm, an average thickness of 0.12 μm and an average aspect ratio of 9.

The [100] high-silver chloride emulsion C-1 was subjected to a chemical sensitization by successively adding sodium benzenethiosulfonate, 360 ml of a 2-mM solution of the blue-sensitizing dye (2) in water/methanol (water/methanol=7/3), $10^{-3}$ mol of KI per one mol of the silver halide, a mixture of sodium thiosulfate and a tellurium sensitizer (molar ratio: 1/1), chlorauric acid, a ribonucleic acid decomposition product, and 80 ml of a 2-mM solution of the blue-sensitizing dye (2) in water/methanol (water/methanol=1 μl) at 60° C. The chemical sensitization was stopped by the stabilizer S1 to prepare a blue-sensitive [100] high-silver chloride emulsion C-1b. A blue-sensitive [100] high-silver chloride emulsion C-2b was prepared in the same manner as in the preparation of the blue-sensitive [100] high-silver chloride emulsion C-1b, except for using the [100] high-silver chloride emulsion C-2 in place of the [100] high-silver chloride emulsion C-1 and changing the amounts of the blue-sensitizing dye (2), KI, etc.

Green-sensitive [100] high-silver chloride emulsions C-1 g and C-2g were prepared in the same manner as in the preparation of the blue-sensitive [100] high-silver chloride emulsions C-1b and C-2b, except for using the green-sensitizing dyes (1), (2) and (3) in place of the blue-sensitizing dye (2). Red-sensitive [100] high-silver chloride emulsions C-1r and C-2r were prepared in the same manner as in the preparation of the blue-sensitive [100] high-silver chloride emulsions C-1b and C-2b, except for using the red-sensitizing dyes (1), (2) and (3) in place of the blue-sensitizing dye (2). The amounts of the green-sensitizing dyes (1), (2) and (3) and the red-sensitizing dyes (1), (2) and (3) were the same as those in the preparation of the green-sensitive silver iodobromide emulsions A-1 g and A-2g and the red-sensitive silver iodobromide emulsions A-1r and A-2r.

(d) Preparation of Silver 5-Butylbenzotriazole Emulsion 1.0 g of 5-butylbenzotriazole, 0.24 g of sodium hydroxide and 25 g of a lime-treated gelatin were dissolved in 700 ml of water and stirred at 60° C. A solution of 5 g of 5-butylbenzotriazole and 1.2 g of sodium hydroxide in 150 ml of water, and a solution of 5 g of silver nitrate in 150 ml of water were simultaneously added to the resulting solution over 4 minutes.

The mixture thus obtained was stirred for 5 minutes, and a solution of 5 g of 5-butylbenzotriazole and 1.2 g of sodium hydroxide in 150 ml of water, and a solution of 5 g of silver nitrate in 150 ml of water were added simultaneously thereto over 6 minutes, to prepare an emulsion.

"DEMOL N," manufactured by Kao Corporation was added to the emulsion to control its pH to precipitate the emulsion, and excess salts were removed. The pH of the emulsion was then controlled to 6.0 to prepare a silver 5-butylbenzotriazole emulsion with a yield of 470 g.

(e) Preparation of Dispersion of Base Precursor of Fine Solid Grains 64 g of a base precursor BP-35 and 10 g of "DEMOL N" manufactured by Kao Corporation were mixed with 220 ml of distilled water, and bead-dispersed by a sand-mill "¼ Gallon Sand-Grinder Mill" manufactured by IMEX Co. to prepare a dispersion of fine solid grains of a base precursor having an average grain diameter of 0.2 μm.

(f) Preparation of Dispersion of Fine Solid Grains of Dye 9.6 g of the following cyanine dye compound 13 and 5.8 g of sodium p-dodecylbenzenesulfonate were mixed with 305 ml of distilled water, and bead-dispersed by a sand-mill "1/4 Gallon Sand-Grinder Mill" manufactured by IMEX Co. to prepare a dispersion of fine solid grains of dye having an average grain diameter of 0.2 μm.

Cyanine Dye Compound 13

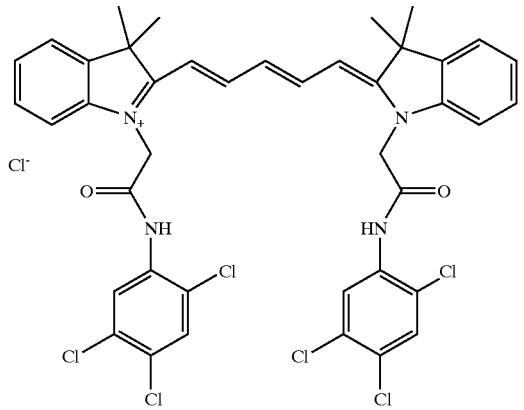

(g) Preparation of Application Liquid for Antihalation Layer 17 g of gelatin, 9.6 g of polyacrylamide, 70 g of the dispersion of fine solid grains of the base precursor, 56 g of the dispersion of fine solid grains of dye, 1.5 g of fine polymethyl methacrylate grains having an average grain size of 6.5 μm, 0.03 g of benzoisothiazolinone, 2.2 g of poly (sodium ethylenesulfonate), and 844 ml of water were mixed with each other to prepare an application liquid for an antihalation layer.

(h) Preparation of Substrate 100 parts by weight of polyethylene-2,6-naphthalene dicarboxylate (PEN) and 2 parts by weight of an ultraviolet absorbent "Tinuvin P. 326" manufactured by Ciba-Geigy were uniformly mixed, and melted at 300° C. The melted mixture was extruded through a T-die, stretched 3.3 times in a longitudinal direction and 4.0 times in a transverse direction at 140° C., and subjected to thermal fixing at 250° C. for 6 seconds, to prepare a PEN film having a thickness of 90 μm. Added to the PEN film were suitable amounts of a blue dyestuff, a magenta dyestuff and a yellow dyestuff [I-1, I-4, I-6, I-24, I-26, I-27 and II-5 described in Kokaigiho (Journal of Technical Disclosure), Kogi No. 94-6023]. The PEN film was then wound around a stainless steel winding core having a diameter of 30 cm and subject to thermal history at 110° C. for 48 hours, to prepare a substrate free from curling.

(i) Undercoat Layer

Four cylindrical electrodes each having a diameter of 2 cm and a length of 40 cm were fixed onto an insulating plate in a vacuum tank at an interval of 10 cm, and the substrate was disposed such that it ran 15 cm apart from the cylindrical electrodes. A heat roll equipped with a thermoregulator having a diameter of 50 cm was mounted just in front of the cylindrical electrodes, and the substrate was in contact with the heat roll in a range of ¾ of a periphery thereof.

The substrate of 90 μm in thickness and 30 cm in width was moved and heated by the heat roll so that the temperature on the substrate surface was 115° C. between the heat roll and the electrode zone. The heated substrate was conveyed at a rate of 15 cm per second and subjected to a glow discharge treatment.

| | |
|---|---|
| Pressure in vacuum tank: | 26.5 Pa, |
| Partial pressure of $H_2O$ in atmospheric gas: | 75%, |
| Discharge frequency: | 30 kHz, |
| Output: | 2500 W, and |
| Strength of treatment: | 0.5 kV · A · min./m$^2$. |

As the electrodes for a vacuum glow discharge, those described in Japanese Patent Laid-Open No. 7-003056 were used.

One surface of the glow-treated PEN substrate (on the side of the photosensitive silver halide emulsion layer) was coated with an application liquid having the following composition and dried at 115° C. for 3 minutes, to form an undercoat having a thickness of 0.02 μm.

| Composition of Application Liquid for Undercoat | |
|---|---|
| Gelatin | 83 parts by weight |
| Water | 291 parts by weight |
| Salicylic Acid | 18 parts by weight |
| Colloidal Silica "Aerosil R972" Manufactured by Nippon Aerosil Co., Ltd. | 1 part by weight |
| Methanol | 6900 parts by weight |
| n-Propanol | 830 parts by weight |
| Polyamide-Epichlorohydrin Resin Described in Japanese Patent Laid-Open No. 51-3619 | 25 parts by weight |

(j) Antistatic layer (first back layer)

A mixture of 40 parts by weight of conductive fine particles "SN-100" manufactured by Ishihara Sangyo Kaisha, Ltd. and 60 parts by weight of water was roughly dispersed by a stirrer while adding an aqueous solution of 1 N sodium hydroxide thereto. The mixture was dispersed by a horizontal-type sand mill to prepare a dispersion (pH of 7.0) of conductive fine particles having an average diameter of 0.06 μm in terms of secondary particles.

A rear surface of the surface-treated PEN substrate was then coated with an application liquid having the following composition so that the amount of the conductive fine particles coated was 270 mg/m$^2$, and dried at 115° C. for 3 minutes, to form an antistatic layer (first back layer).

| Composition of Application Liquid for Antistatic Layer | |
|---|---|
| Conductive Fine Particles "SN-100" Manufactured by Ishihara Sangyo Kaisha, Ltd. | 270 parts by weight |
| Gelatin | 23 parts by weight |
| Surfactant "LEODOL TW-L 120" Manufactured by Kao Corporation | 6 parts by weight |
| Hardener "DENACOL EX-521" manufactured by NAGASE KASEI Chemicals Ltd. | 9 parts by weight |
| Water | 5000 parts by weight |

(k) Magnetic Recording Layer (Second Back Layer)

Magnetic particles of Co-deposited γ-$Fe_2O_3$ "CSF-4085 V2" manufactured by Toda Kogyo Co., Ltd. were coated with a silane coupling agent "X-12-641" manufactured by Shin-Etsu Chemical Co., Ltd. in an amount of 16 weight %.

The CSF-4085 V2 treated with X-12-641 was used to prepare an application liquid having the following composition, which was applied to the above antistatic layer such that amount of the CSF-4085 V2 treated with X-12-641 was 62 mg/m$^2$, and dried at 115° C. for 1 minute, to form a magnetic recording layer (second back layer). The magnetic particles and the following abrasives were dispersed by a method described in Japanese Patent Laid-Open No. 6-035092.

| Composition of Application Liquid for Magnetic Recording Layer | |
|---|---|
| Diacetyl Cellulose (Binder) | 1140 parts by weight |
| Magnetic Particles "CSF-4085 V2" Treated with "X-12-641" | 62 parts by weight |
| Abrasives of Alumina "AKP-50" Manufactured by Sumitomo Chemical Co., Ltd. | 40 parts by weight |
| Hardener "Millionate MR-400" Manufactured by Nippon Polyurethane Industry Co., Ltd. | 71 parts by weight |
| Cyclohexanone | 12000 parts by weight |
| Methylethyl Ketone | 12000 parts by weight |

Increase in color density of DB of the magnetic recording layer by X-light (blue filter) was approximately 0.1, and the magnetic recording layer had a saturated magnetizing moment of 4.2 emu/g, coercivity of $7.3\times10^4$ A/m and a rectangularity of 65%.

(I) Third Back Layer

A wax (1-2) of n-$C_{17}H_{35}COOC_{40}H_{81}$, was emulsified in water by a high-pressure homogenizer to prepare an aqueous dispersion of wax having a concentration of 10 weight % and a weight average diameter of 0.25 $\mu$m.

The resultant dispersion was used to prepare an application liquid having the following composition, which was applied to the above magnetic recording layer such that amount of the wax (1-2) was 27 mg/m$^2$, and dried at 115° C. for 1 minute, to form a third back layer.

| Composition of Application Liquid for Third Back Layer | |
|---|---|
| Aqueous Wax Dispersion | 270 parts by weight |
| Pure Water | 176 parts by weight |
| Ethanol | 7123 parts by weight |
| Cyclohexanone | 841 parts by weight |

(m) Preparation of Microcrystal Dispersion

A microcrystalline developing agent dispersion, a microcrystalline coupler dispersion and a microcrystal dispersion in a thermal solvent were prepared as follows.

50 g of a predetermined compound (each of the developing agent, the coupler and the thermal solvent) was mixed with a 10-weight % aqueous solution of 30 g of a modified polyvinyl alcohol "POVAL MP203" manufactured by Kuraray Co., Ltd., and then well mixed with 0.5 g of Alkanol XC and 100 g of water to form a slurry. The slurry was conveyed by a diaphragm pump to a horizontal-type sand mill ("UVM-2" manufactured by IMEX Co.) packed with zirconium beads having an average diameter of 0.5 mm and dispersed therein for 6 hours. The slurry was then mixed with water such that the concentration of the predetermined compound was adjusted to 10 weight %, to prepare a microcrystal dispersion.

The microcrystal dispersion comprised grains having an average size of 0.40 $\mu$m and a maximum size of 2.0 $\mu$m or less. The resultant microcrystal dispersion was filtrated by a polypropylene filter having a pore size of 10.0 $\mu$m to remove foreign matter such as dust, and stored. The microcrystal dispersion was filtrated again by the polypropylene filter immediately before use.

(n) Production of Comparative Silver Halide Color Photosensitive Material

Using the above-mentioned emulsions, application liquids, substrate and microcrystal dispersions, a comparative silver halide color photosensitive material 101 having photograph-constituting layers having the structure shown in Table 1 was produced. The structures of the additives shown in Table 1 are illustrated below. The total thickness of the substrate provided with the undercoat layer, the antistatic layer, the magnetic recording layer and the third back layer was 96 $\mu$m.

TABLE 1

| Layer | Additives | Amount (mg/m$^2$) |
|---|---|---|
| Protective Layer | Lime-Treated Gelatin | 914 |
| | Matting Agent (Silica) | 50 |
| | Surfactant (q) | 30 |
| | Surfactant (r) | 40 |
| | Water-Soluble Polymer (s) | 15 |
| | Hardening Agent (t) | 110 |
| Intermediate Layer | Lime-Treated Gelatin | 461 |
| | Surfactant (r) | 5 |
| | Formalin Scavenger (u) | 300 |
| | Water-Soluble Polymer (s) | 15 |
| High-sensitivity, Yellow Color-Forming Layer | Lime-Treated Gelatin | 1750 |
| | Emulsion A-1b (Amount of Silver) | 550 |
| | Silver 5-Butylbenzotriazole | 165 |
| | Yellow Coupler Y-1 | 179 |
| | Color-Developing Agent DDEV-1 | 215 |
| | Antifoggant (d) | 6.2 |
| | Surfactant (y) | 27 |
| | Thermal Solvent TS-12 | 350 |
| Low-sensitivity, Yellow Color-Forming Layer | Lime-Treated Gelatin | 1680 |
| | Emulsion A-2b (Amount of Silver) | 240 |
| | Silver 5-Butylbenzotriazole | 206 |
| | Yellow Coupler Y-1 | 448 |
| | Color-Developing Agent DDEV-1 | 539 |
| | Antifoggant (d) | 5.4 |
| | Surfactant (y) | 30 |
| | Thermal Solvent TS-12 | 336 |
| Intermediate Layer | Lime-Treated Gelatin | 560 |
| | Surfactant (y) | 15 |
| | Water-Soluble Polymer (s) | 15 |
| High-sensitivity, Magenta Color-Forming Layer | Lime-Treated Gelatin | 781 |
| | Emulsion A-1g (Amount of Silver) | 488 |
| | Silver 5-Butylbenzotriazole | 62 |
| | Magenta Coupler M-1 | 47 |
| | Color-Developing Agent DDEV-1 | 81 |
| | Antifoggant (d) | 5.5 |
| | Surfactant (y) | 8 |
| | Thermal Solvent TS-12 | 156 |
| Low-sensitivity, Magenta Color-Forming Layer | Lime-Treated Gelatin | 711 |
| | Emulsion A-2g (Amount of Silver) | 240 |
| | Silver 5-Butylbenzotriazole | 155 |
| | Magenta Coupler M-1 | 234 |
| | Color-Developing Agent DDEV-1 | 407 |
| | Antifoggant (d) | 5.4 |
| | Surfactant (y) | 29 |
| | Thermal Solvent TS-12 | 142 |
| Intermediate Layer | Lime-Treated Gelatin | 850 |
| | Surfactant (y) | 15 |
| | Formalin Scavenger (u) | 300 |
| | Water-Soluble Polymer (s) | 15 |
| High-sensitivity, Cyan Color-Forming Layer | Lime-Treated Gelatin | 842 |
| | Emulsion A-1r (Amount of Silver) | 550 |
| | Silver 5-Butylbenzotriazole | 59 |
| | Cyan Coupler C-1 | 19 |
| | Color-Developing Agent DDEV-1 | 77 |
| | Antifoggant (d) | 6.2 |
| | Surfactant (y) | 5 |
| | Thermal Solvent TS-12 | 168 |
| Low-sensitivity, Cyan Color-Forming Layer | Lime-Treated Gelatin | 825 |
| | Emulsion A-2r (Amount of Silver) | 300 |
| | Silver 5-Butylbenzotriazole | 157 |
| | Cyan Coupler C-1 | 99 |
| | Color-Developing Agent DDEV-1 | 411 |
| | Antifoggant (d) | 6.8 |
| | Surfactant (y) | 17 |
| | Thermal Solvent TS-12 | 165 |
| Antihalation Layer | Lime-Treated Gelatin | 3000 |
| | Surfactant (y) | 30 |

TABLE 1-continued
| Layer | Additives | Amount (mg/m$^2$) |
|---|---|---|
| | Base Precursor BP-35 | 2000 |
| | Cyanine Dye Compound 13 | 182 |
TABLE 1-continued
| Layer | Additives | Amount (mg/m$^2$) |
|---|---|---|
| | Surfactant (r) | 120 |
| | Water-Soluble Polymer (s) | 15 |
DDEV-1
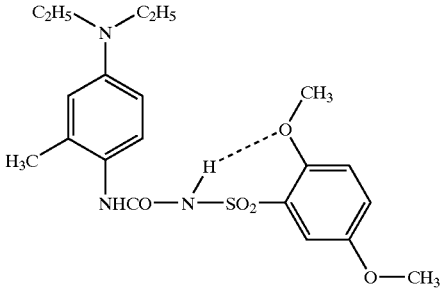
Y-1
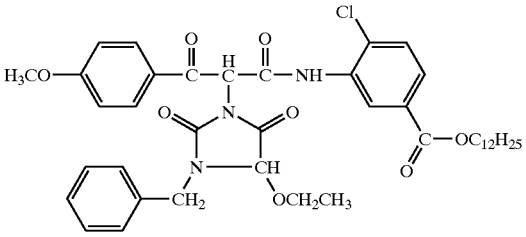
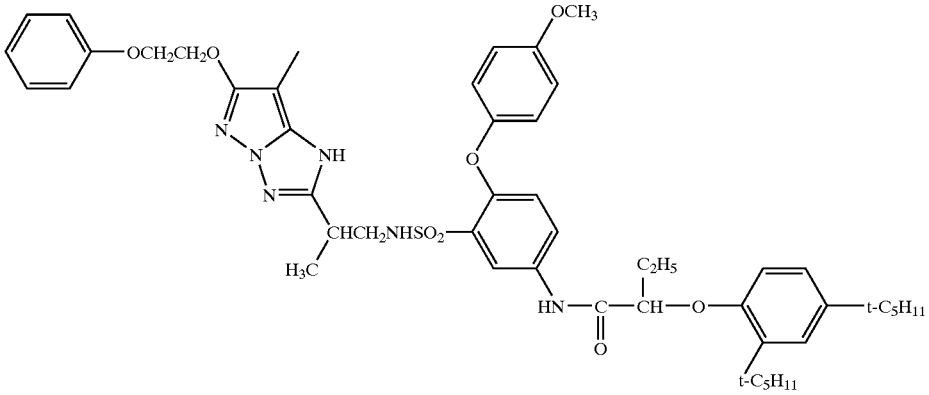
C-1
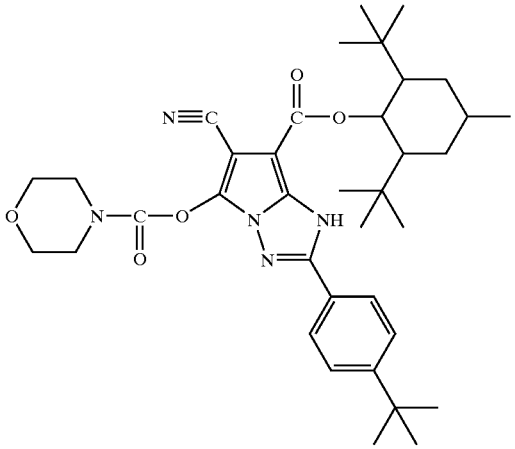
Antifoggant (d)
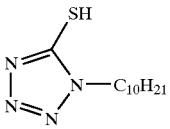
Surfactant (q)
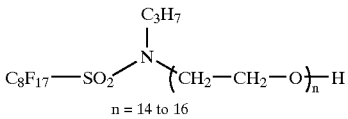
Surfactant (r)
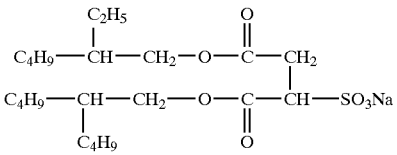

-continued

Water-Soluble Polymer (s)

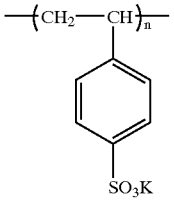

Hardening Agent (t)

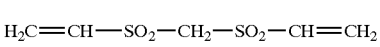

Formalin Scavenger (u)

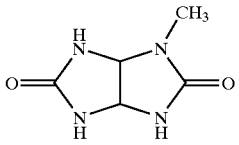

(o) Production of Silver Halide Color Photosensitive Materials 102 and 103

Silver halide color photosensitive materials 102 and 103 of the present invention were produced in the same manner as in the comparative silver halide color photosensitive material 101, except for changing the emulsions for color-forming layers photosensitive silver halide emulsion layers) as shown in Table 2.

TABLE 2

| Photosensitive Material | High-sensitivity, Yellow Color-Forming Layer | Low-sensitivity, Yellow Color-Forming Layer | High-sensitivity, Magenta Color-Forming Layer |
|---|---|---|---|
| 101 | A-1b | A-2b | A-1g |
| 102 | B-1b | B-2b | B-1g |
| 103 | C-1b | C-2b | C-1g |

| Photosensitive Material | Low-sensitivity, Magenta Color-Forming Layer | High-sensitivity, Cyan Color-Forming Layer | Low-sensitivity, Cyan Color-Forming Layer |
|---|---|---|---|
| 101 | A-2g | A-1r | A-2r |
| 102 | B-2g | B-1r | B-2r |
| 103 | C-2g | C-1r | C-2r |

2. Evaluation

A sample was cut from each of the comparative silver halide color photosensitive material 101 and the silver halide color photosensitive materials 102 and 103 of the present invention, exposed to a white light of 500 lux for 1/100 second through a continuous optical wedge, and heated at 160° C. for 15 seconds by a heat drum for thermal development, according to a method for obtaining ISO sensitivity (ANSI PH2.27).

The developed silver halide photosensitive material was measured with respect to a transmission density by blue, green and red filters to obtain a characteristic curve. The minimum density $D_{min}$ of each silver halide photosensitive material corresponding to the color formation of yellow, magenta and cyan is shown in Table 3. Also determined was a relative sensitivity, an inverse number of the amount of light exposure corresponding to a density that was 0.2 higher than the minimum density. The relative sensitivity of each photosensitive material is also shown as "S0.2" in Table 3, in such a relative value that the relative sensitivity of the silver halide photosensitive material 101 was 100. The maximum density of each of blue, green and red was 2.8 or more in every photosensitive materials 101 to 103.

TABLE 3

| Photosensitive | Yellow Color Formation | | Magenta Color Formation | | Cyan Color Formation | |
|---|---|---|---|---|---|---|
| Material | $D_{min}$ | S0.2 | $D_{min}$ | S0.2 | $D_{min}$ | S0.2 |
| 101 | 1.1 | 100 | 1.51 | 100 | 1.25 | 100 |
| 102 | 0.82 | 95 | 1.19 | 132 | 0.97 | 115 |
| 103 | 0.78 | 105 | 1.23 | 120 | 0.84 | 132 |

As shown in Table 3, the silver halide color photosensitive materials 102 and 103 of the present invention exhibited minimum densities lower than those of the comparative silver halide color photosensitive material 101 using the silver iodobromide emulsion, proving that the silver halide color photosensitive materials of the present invention had high sensitivity.

The minimum density of the developed silver halide color photosensitive material is affected by an antihalation dye, an undeveloped silver halide containing a sensitizing dye, a developed silver and a colored dye. The contribution of the silver halide can be evaluated by observing fixation in the thermally developed silver halide photosensitive material. The contribution of the antihalation dye can be evaluated by measuring a density of a fixed, undeveloped silver halide photosensitive material. The sum of the density of the colored dye and the density of the developed silver (a so-called fog density) can be determined from difference between the density of a fixed, thermally developed silver halide photosensitive material and the density of a fixed, undeveloped silver halide photosensitive material.

The silver halide color photosensitive materials 101 to 103 were fixed to obtain the effects of the antihalation dye. As a result, the contribution of the antihalation dye for the minimum density of each silver halide photosensitive material was 0.46 for blue density, 0.93 for green density and 0.57 for red density. The fixing process was carried out at 30° C. for 2 minutes by "Super Fuji Fix" manufactured by Fuji Photo Film Co., Ltd. After the fixing process, each silver halide photosensitive material was washed with flowing water for 3 minutes.

The fog densities of the silver halide color photosensitive materials 101 to 103 were all in a range of 0.1 to 0.2. The high-silver chloride grains acted to reduce the minimum density in the silver halide color photosensitive materials 102 and 103 of the present invention.

Each of the silver halide color photosensitive materials 101 to 103 was then converted to a 135-sized, roll film (12EX). The roll film was Iy incorporated into a single-lens reflex camera "Nikon FM2" manufactured by Nikon Corporation for shooting. The shooting was performed under the conditions of using a lens with a focal distance of 50 mm, a lens aperture of 8 and a shutter speed of 1/250 second. Next, each silver halide photosensitive material was thermally developed at 160° C. for 15 seconds by a heat drum process to form an image.

The thus obtained image was read by "Film Scanner LS-1000" manufactured by Nikon Corporation without sharpness emphasis. The read image was directly printed out in an A5 size by "Pictrography 3000 Printer" manufactured by Fuji Photo Film Co., Ltd., and the granulation of the output image was evaluated by visual observation. As a result, the image formed by the comparative silver halide color photosensitive material 101 did not deserve of looking, and the image formed by the silver halide photosensitive materials 102 and 103 of the present invention was excellent in quality. This is due to the fact that image-reading load was reduced because of low haze of the high-silver chloride emulsion.

EXAMPLE 2

1. Production of silver halide color photosensitive material

Using the emulsions, the substrate, etc. prepared in Example 1, a single-layer-type, silver halide color photosensitive material 201 of the present invention having compositions shown in Table 4 was produced.

TABLE 4

| Layer | Additives | Amount (mg/m$^2$) |
|---|---|---|
| Protective Layer | Lime-Treated Gelatin | 914 |
| | Matting Agent (Silica) | 50 |
| | Surfactant (q) | 30 |
| | Surfactant (r) | 40 |
| | Water-Soluble Polymer (s) | 15 |
| | Hardening Agent (t) | 20 |
| Magenta Color-Forming Layer | Lime-Treated Gelatin | 1562 |
| | Emulsion B-1g (Amount of Silver) | 976 |
| | Silver 5-Butylbenzotriazole | 124 |
| | Magenta Coupler M-1 | 94 |
| | Color-Developing Agent DDEV-1 | 163 |
| | Antifoggant (d) | 22.0 |
| | Surfactant (y) | 16 |
| | Thermal Solvent TS-12 | 625 |

An emulsion B-1 g (1) was prepared in the same manner as in the green-sensitive [111] high-silver chloride emulsion B-1 g, except that the tellurium compound [Compound (3)] was not used for the chemical sensitization. An emulsion B-1 g (2) was prepared in the same manner as in the green-sensitive [111] high-silver chloride emulsion B-1g, except for using mono(pentafluorophenyl) diphenylphosphine selenide in place of the tellurium compound.

An emulsion C-1g (1) was prepared in the same manner as in the green-sensitive [100] high-silver chloride emulsion C-1 g, except that the tellurium compound was not used for the chemical sensitization. An emulsion C-1 g (2) was prepared in the same manner as in the green-sensitive [100] high-silver chloride emulsion C-1 g, except for using mono (pentafluorophenyl) diphenylphosphine selenide in place of the tellurium compound.

The amounts of sodium benzenethiosulfonate, sodium thiosulfate, chlorauric acid, etc. were controlled to optimize the chemical sensitization.

Single-layer-type, silver halide color photosensitive materials 202 to 206 according to the present invention were produced in the same manner as in the photosensitive material 201, except for changing the emulsion for the magenta color-forming layer as shown in Table 5.

TABLE 5

| Photosensitive Material | Emulsion |
|---|---|
| 201 | B-1g |
| 202 | B-1g (1) |
| 203 | B-1g (2) |
| 204 | C-1g |
| 205 | C-1g (1) |
| 206 | C-1g (2) |

2. Evaluation

A sample was cut from each of the silver halide color photosensitive materials 201 to 206 of the present invention, exposed to a white light of 500 lux for 1/100 second by "SC52" manufactured by Fuji Photo Film Co., Ltd. through a continuous optical wedge, and heated at 160° C. for 15 seconds by a heat drum for thermal development, according to a method for obtaining ISO sensitivity (ANSI PH2.27).

The developed silver halide photosensitive material was measured with respect to a transmission density by a green-filter to obtain a characteristic curve. The minimum density $D_{min}$ of each silver halide photosensitive material corresponding to magenta color formation is shown in Table 6. The relative sensitivity of each photosensitive material is also shown as "S0.2" in Table 6, in such a relative value that the relative value of the silver halide photosensitive material 201 was 100.

TABLE 6

| Photosensitive Material | Magenta Color Formation | |
|---|---|---|
| | $D_{min}$ | S0.2 |
| 201 | 0.3 | 100 |
| 202 | 0.25 | 87 |
| 203 | 0.35 | 95 |
| 204 | 0.28 | 95 |
| 205 | 0.22 | 91 |
| 206 | 0.33 | 95 |

It is clear from Table 6 that the silver halide color photosensitive material of the present invention can preferably be improved in sensitivity without causing fogging by chemical sensitization with a tellurium compound. It is also clear that the chemical sensitization with a selenium compound tends to increase the fogging, and that the chemical sensitization with only a sulfur compound results in decrease in sensitivity though no fogging appears.

EXAMPLE 3

1. Production of Silver Halide Color Photosensitive Material (a) Preparation of Silver Benzotriazole Emulsion 0.68 g of benzotriazole, 0.24 g of sodium hydroxide and 25 g of lime-treated gelatin were dissolved in 700 ml of water and stirred while maintaining the temperature at 60° C. A solution of 3.4 g of benzotriazole and 1.2 g of sodium hydroxide in 150 ml of water and a solution of 5 g of silver nitrate in 150 ml of water were added simultaneously to the resultant solution over 4 minutes.

The mixture thus obtained was stirred for 5 minutes, and mixed with a solution of 3.4 g of benzotriazole and 1.2 g of sodium hydroxide in 150 ml of water and a solution of 5 g of silver nitrate in 150 ml of water simultaneously over 6 minutes, to prepare an emulsion. "DEMOL N" manufactured by Kao Corporation was added to the emulsion to control its pH, to precipitate the emulsion and remove excess salts. The pH of the emulsion was then controlled to 6.0 to prepare a silver benzotriazole emulsion with a yield of 476 g.

(b) Preparation of Silver 5-Methylbenzotriazole Emulsion 0.76 g of 5-methylbenzotriazole, 0.24 g of sodium hydroxide and 25 g of lime-treated gelatin were dissolved in 700 ml of water and stirred while maintaining the temperature at 60° C. A solution of 3.8 g of 5-methylbenzotriazole and 1.2 g of sodium hydroxide in 150 ml of water and a solution of 5 g of silver nitrate in 150 ml of water were added to the resultant solution simultaneously over 4 minutes.

The mixture thus obtained was stirred for 5 minutes, and then mixed with a solution of 3.8 g of 5-methylbenzotriazole and 1.2 g of sodium hydroxide in 150 ml of water and a solution of 5 g of silver nitrate in 150 ml of water simultaneously over 6 minutes, to prepare an emulsion.

"DEMOL N" manufactured by Kao Corporation was added to the emulsion to control its pH, to precipitate the emulsion and remove excess salts. The pH of the emulsion was then controlled to 6.0 to prepare a silver 5-methylbenzotriazole emulsion with a yield of 479 g.

(c) Preparation of Silver 5-Ethylbenzotriazole Emulsion 0.84 g of 5-ethylbenzotriazole, 0.24 g of sodium hydroxide and 25 g of lime-treated gelatin were dissolved in 700 ml of water and stirred while maintaining the temperature at 60° C. A solution of 4.2 g of 5-ethylbenzotriazole and 1.2 g of sodium hydroxide in 150 ml of water and a solution of 5 g of silver nitrate in 150 ml of water were added simultaneously to the resultant solution over 4 minutes.

The mixture thus obtained was stirred for 5 minutes, and then mixed with a solution of 4.2 g of 5-ethylbenzotriazole and 1.2 g of sodium hydroxide in 150 ml of water and a solution of 5 g of silver nitrate in 150 ml of water simultaneously over 6 minutes, to prepare an emulsion.

"DEMOL N" manufactured by Kao Corporation was added to the emulsion to control its pH, to precipitate the emulsion and remove excess salts. The pH of the emulsion was then controlled to 6.0 to prepare a silver 5-ethylbenzotriazole emulsion with a yield of 481 g.

(d) Production of Silver Halide Color Photosensitive Material

Silver halide color photosensitive materials 301 to 306 of the present invention were produced in the same manner as in the silver halide color photosensitive materials 201 and 204, except for changing the organic silver salt as shown in Table 7.

TABLE 7

| Photosensitive Material | Emulsion | Organic Silver Salt |
|---|---|---|
| 201 | B-1g | Silver 5-Butylbenzotriazole |
| 301 | B-1g | Silver Benzotriazole |
| 302 | B-1g | Silver 5-Methylbenzotriazole |
| 303 | B-1g | Silver 5-Ethylbenzotriazole |
| 204 | C-1g | Silver 5-Butylbenzotriazole |
| 304 | C-1g | Silver Benzotriazole |
| 305 | C-1g | Silver 5-Methylbenzotriazole |
| 306 | C-1g | Silver 5-Ethylbenzotriazole |

2. Evaluation

A sample was cut from each of the silver halide color photosensitive materials 201, 202 and 301 to 306 of the present invention, and the minimum density $D_{min}$ and S0.2 corresponding to magenta color formation of each silver halide photosensitive material were measured in the same manner as in Example 2. The results are shown in Table 8.

TABLE 8

| Photosensitive Material | Magenta Color Formation | |
|---|---|---|
| | $D_{min}$ | S0.2 |
| 201 | 0.3 | 100 |
| 301 | 0.2 | 60 |
| 302 | 0.25 | 63 |
| 303 | 0.28 | 87 |
| 204 | 0.28 | 95 |
| 304 | 0.15 | 52 |
| 305 | 0.2 | 58 |
| 306 | 0.33 | 83 |

It is clear from Table 8 that the silver halide color photosensitive material of the present invention preferably comprises a silver salt of a benzotriazole derivative having an alkyl group with fewer carbon atoms as the organic silver salt for sensitivity.

EXAMPLE 4

1. Production of Silver Halide Color Photosensitive Material

A silver halide emulsion composed of high-silver chloride tabular grains was prepared by a method described in Examples of U.S. Pat. No. 5,840,475 as follows.

(a) Preparation of Silver Iodochloride (111) Tabular Grain Emulsion 3.9 L of an aqueous solution containing 9.3 g of sodium chloride, 2.84 g of 7-azaindole, 80 g of lime-treated bone gelatin and distilled water was charged into a reaction vessel and maintained at 50° C. After the pH of the solution was adjusted to 5.5, a 2-M aqueous silver nitrate solution was added thereto over 36 seconds at a rate of 8 ml/min while strongly stirring, to form nuclei.

Immediately thereafter, an aqueous silver nitrate solution was added to the resultant reaction mixture under the conditions shown in the following table, to form silver halide grains. A 4-M aqueous sodium chloride solution was also added to the reaction mixture simultaneously such that the pC1 of the reaction mixture was adjusted to 1.5.

| Grain Growth | Silver Nitrate Solution | Initial Flow Rate | Final Flow Rate | Adding Time |
|---|---|---|---|---|
| I | 2 M | 8 ml/min | 16 ml/min | 2.8 minutes |
| II | 4 M | 8 ml/min | 30 ml/min | 15 minutes |
| III | 4 M | 30 ml/min | 30 ml/min | 14 minutes |

1 minute after the grain growth, a 4-M aqueous silver nitrate solution was added to the resultant reaction mixture over 2.4 minutes at a rate of 23 ml/minute. An aqueous solution containing sodium chloride (3.6 M) and potassium iodide (0.4 M) was added to the reaction mixture simultaneously such that the pC1 of the reaction mixture was adjusted to 1.5. The aqueous solution of sodium chloride and potassium iodide further comprised potassium hexacyanoruthenium at a concentration of $3\times10^{-5}$ based on the entire silver halide. After the formation of grains, the resultant solution was precipitated, washed with water and desalted.

The resultant emulsion contained tabular grains having an average diameter of circles equivalent to the projected area of 0.86 $\mu$m, an average thickness of 0.0 $\mu$m and a major crystal face of (111) at a ratio of 70% or more per the total projected area. This emulsion was identified as B-3.

The temperature and time of forming grains were then controlled to form an emulsion B-4 containing tabular grains having an average diameter of circles equivalent to the projected area of 1.58 μn, an average thickness of 0.119 μm and a major crystal face of (111) at a ratio of 70% or more per the total projected area.

The temperature and time of forming grains were further controlled to form an emulsion B-5 containing tabular grains having an average diameter of circles equivalent to the projected area of 2.85 μm, an average thickness of 0.131 μm and a major crystal face of (111) at a ratio of 70% or more per the total projected area.

These emulsions were subjected to chemical sensitization and spectral sensitization in the same manner as in B-1 and B-2 of Example 1 in to prepare blue-sensitive emulsions B-3b, B-4b and B-5b, green-sensitive emulsions B-3g, B-4g and B-5g, and red-sensitive emulsions B-3r, B-4r and B-5r.

(b) Preparation of Silver Iodochloride (100) Tabular Grain Emulsion 4.5 L of an aqueous solution containing 1.48 g of sodium chloride, 0.28 g of potassium iodide, 38.8 g of oxidation-treated, lime-treated gelatin and distilled water was charged into a reaction vessel and maintained at 35° C. A 4-M aqueous silver nitrate solution containing 0.32 g/L of mercuric chloride (solution 1), and a 4-M aqueous sodium chloride solution were added thereto over 30 seconds at a rate of 21 ml/min while strongly stirring, to form nuclei.

Immediately thereafter, 9.1 L of a solution containing 0.39 g/L of sodium chloride and 0.12 g/L of potassium iodide was added to the resultant reaction mixture and left to stand for 8 minutes. The above solution 1 as then added to the reaction mixture under the conditions shown in the following table, to form silver halide grains. A 4-M aqueous sodium chloride solution was also added to the reaction mixture simultaneously such that the pC1 of the reaction mixture was adjusted to

| Grain Growth | Initial Flow Rate | Final Flow Rate | Adding Time |
|---|---|---|---|
| I | 14 ml/min | 14 ml/min | 5 minutes |
| II | 14 ml/min | 42 ml/min | 52 minutes |

When the above step II of grain growth was completed, a 4-M aqueous sodium chloride solution was added to the resultant mixture over 5 minutes at a rate of 14 m/minute and left to stand for 30 minutes. The solution 1 was added to the resultant mixture over 5 minutes at a rate of 14 ml/minute, and 70 ml of an aqueous solution containing 5.25 g of potassium iodide was then added thereto and left to stand for 20 minutes. The above solution 1 was then added to the resultant solution over 8 minutes at a rate of 14 ml/minute, while adjusting the pC1 to 2.2 by adding a 4-M aqueous sodium chloride solution further comprising potassium hexacyanoruthenium at a concentration of $3\times10^{-5}$based on the entire silver halide. After the formation of grains, the resultant solution was precipitated, washed with water and desalted.

The resultant emulsion contained tabular grains having an average diameter of circles equivalent to the projected area of 0.56 μm, an average thickness of 0.09 μm and a major crystal face of (111) at a ratio of 70% or more per the total projected area. This emulsion was identified as C-3.

The temperature and time of forming grains were then controlled to form an emulsion CA containing tabular grains having an average diameter of circles equivalent to the projected area of 1.60 μm, an average thickness of 0.114 μm and a major crystal face of (111) at a ratio of 70% or more per the total projected area.

The temperature and time of forming grains were further controlled to form an emulsion C-5 containing tabular grains having an average diameter of circles equivalent to the projected area of 2.90 μA, an average thickness of 0.121 μm and a major crystal face of (111) at a ratio of 70% or more per the total projected area.

These emulsions were subjected to chemical sensitization and spectral sensitization in the same manner as in C-1 and C-2 of Example 1 to prepare blue-sensitive emulsions C-3b, C-4b and C-5b, green-sensitive emulsions C-3g, C-4g and C-5g, and red-sensitive emulsions C-3r, C-4r and C-5r.

(c) Preparation of Emulsion of Thin Tabular Silver Iodobromide Grains 930 ml of a solution containing 0.37 g of gelatin having an average molecular weight of 15,000, 0.37 g of oxidized gelatin having an average molecular weight of 15,000 and 0.7 g of potassium bromide in distilled water was charged into a reaction vessel and heated to 38° C. 30 ml of an aqueous solution containing 0.34 g of silver nitrate, and 30 ml of an aqueous solution containing 0.24 g of potassium bromide were added to the resultant mixture over 20 seconds while strongly stirring. The mixture was left at 40° C. for 1 minute after the addition and heated to 75° C. Added thereto were 27.0 g of a gelatin whose amino group was modified by trimellitic acid and 200 ml of distilled water. Thereafter, 160 ml of an aqueous solution containing 23.36 g of silver nitrate and 120 ml of an aqueous solution containing 16.37 g of potassium bromide and 6.0 g of gelatin having a molecular weight of 20,000 were simultaneously charged into a stirring apparatus separate from the reaction vessel to prepare fine silver bromide grains having an average size of 0.015 μm, which were soon added to the reaction vessel over 80 minutes. In the course of adding the fine silver bromide grains, silver potential was maintained at −30 mV relative to a saturated calomel electrode in the reaction vessel.

Next, 750 ml of an aqueous solution containing 119.01 g of silver nitrate, and an aqueous solution containing potassium iodide and potassium bromide at a molar ratio of potassium iodide/potassium bromide of 3/97 and at a concentration of potassium bromide of 18% were simultaneously charged into a stirring apparatus separate from the reaction vessel to prepare fine silver bromide grains having an average size of 0.015 μm, which were soon added to the reaction vessel over 120 minutes in the same manner as above. In the course of adding the fine silver bromide grains, silver potential was maintained at −50 mV relative to a saturated calomel electrode in the reaction vessel. Further, 120 ml of an aqueous solution containing 16.99 g of silver nitrate, and a 20-% aqueous potassium bromide solution were added to the resultant mixture over 10 minutes while controlling the silver potential of the reaction mixture relative to a saturated calomel electrode to 0 mV in the first 5 minutes and to 120 mV in the last 5 minutes.

After the completion of addition, the mixture was maintained at 75° C. for 1 minute and cooled to 50° C. 34.4 ml of a 0.3-% aqueous potassium iodide solution was added thereto over 10 minutes. Immediately thereafter, 75 ml of an aqueous solution containing 8.88 g of silver nitrate, 75 ml of an aqueous solution containing 7.57 g of sodium chloride, 2.61 g of potassium bromide and 12 mg of potassium hexacyanoruthenium, and a solution containing 0.00832 mol of fine silver iodide grains were simultaneously added to the resulting mixture. The mixture was then cooled and desalted by a known method, and 7 weight % of gelatin was added to the resultant mixture to adjust its pH to 6.2.

The resultant emulsion contained tabular grains having an average diameter of circles equivalent to the projected area of 3.39 μm, an average grain thickness of 0.041 μm and a major crystal face of (111) at a ratio of 70% or more to the total projected area of the entire silver halide grains. This emulsion was identified as D. The electron-microscopic observation of the grains contained in the emulsion D revealed that protrusions with an epitaxial structure were formed at corners of hexagonal tabular grain bodies.

5.6 ml of a 1-% aqueous potassium iodide solution was added to the emulsion D at 40° C. $5.6\times10^{-4}$ mol/mol-Ag of the following spectral sensitization dye, the following Compound I, potassium thiocyanate, chlorauric acid, sodium thiosulfate and mono(pentafluorophenyl)diphenylphosphine selenide were then added thereto to perform spectral sensitization and chemical sensitization. After the sensitization, a stabilizer S was added to the resultant emulsion to prepare a blue-sensitive emulsion Db. The amount of the chemical sensitizer was controlled such that the chemical sensitization was optimized.

Sensitization Dye I for Blue-Sensitive Emulsion $5.6\times10^{4}$ Mol Per 1 Mol-Ag of Emulsion D

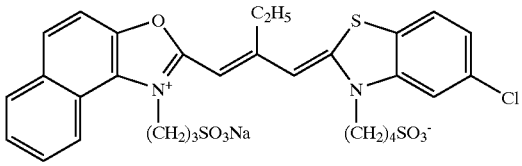

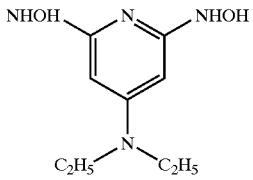

Compound I

Stabilizer S (Mixture of Following Compounds)

$1.5\times10^{-4}$ Mol Per 1 Mol-Ag of Emulsion D

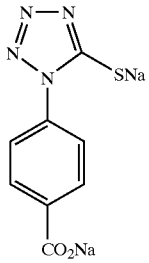

$6\times10^{-5}$ Mol Per 1 Mol-Ag of Emulsion D

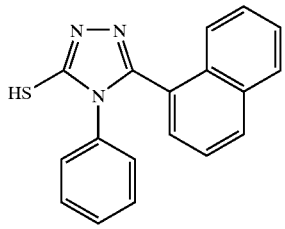

A green-sensitive emulsion Dg and red-sensitive emulsion Dr were prepared in the same manner as in the blue-sensitive emulsion Db, except for using the following spectral sensitization dyes.

Sensitizaton Dye I for Green-Sensitive Emulsion 1.2×10–3 Mol Per 1 Mol-Ag of Emulsion D

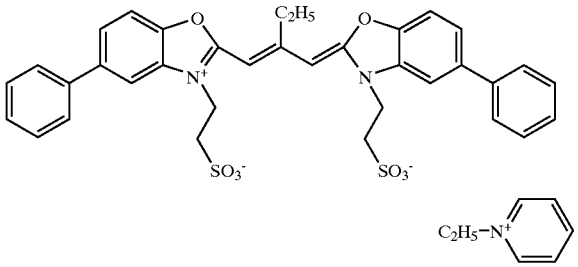

Sensitization Dye II for Green-Sensitive Emulsion $2.8\times10^{-4}$ Mol Per 1 Mol-Ag of Emulsion D

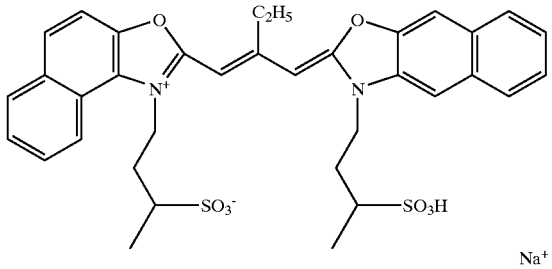

Sensitization Dye III for Green-Sensitive Emulsion $1.0\times10^{-4}$ Mol Per 1 Mol-Ag of Emulsion D

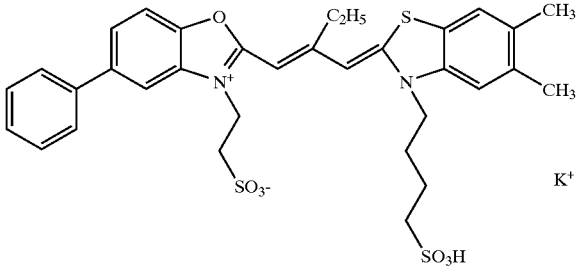

Sensitization Dye I for Red-Sensitive Emulsion
$5.5\times10^{-4}$ Mol Per 1 Mol-Ag of Emulsion D

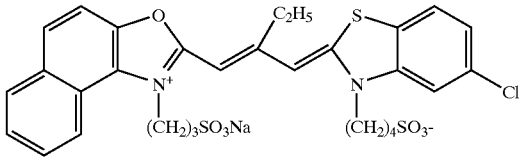

Sensitization Dye II for Red-Sensitive Emulsion
$1.4\times10^{-4}$ Mol Per 1 Mol-Ag of Emulsion D

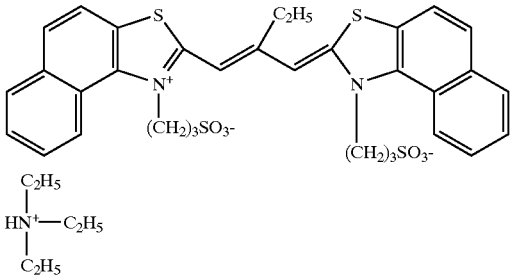

Sensitization Dye III for Red-Sensitive Emulsion
$6.8\times_{10}4$ Mol Per 1 Mol-Ag of Emulsion D

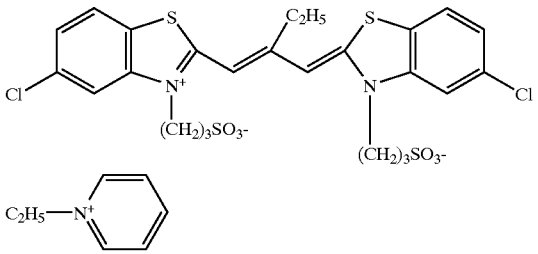

(d) Preparation of Silver Salt of 1-phenyl-5-mercaptotetrazole 431 g of a lime-treated gelatin and 6569 ml of distilled water were charged into a reaction vessel. A solution B was then prepared by mixing 320 g of 1-phenyl-5-mercaptotetrazole with 2044 ml of distilled water and 790 g of a 2.5-M aqueous sodium hydroxide solution. The solution B was added to the resulting mixture in the reaction vessel, and nitric acid or sodium hydroxide was added thereto, if necessary, to control its pAg at 7.25 and its pH at 8.00.

To the mixture was added 3200 ml of a 0.54-M aqueous silver nitrate solution at a rate of 250 ml/minutes while strongly stirring, and the solution B was simultaneously added to the mixture near the stirrer while controlling the pAg of the mixture to 7.25. The mixture was then concentrated by ultrafiltration to prepare a dispersion containing fine grains of a silver salt of 1-phenyl-5-mercaptotetrazole.

(e) Preparation of Silver Benzotriazole 0.34 g of benzotriazole, 0.24 g of sodium hydroxide and 25 g of a phthalated gelatin were dissolved in 700 ml of water and stirred at 60° C. A solution of 3.4 g of benzotriazole and 1.2 g of sodium hydroxide in 150 ml of water and a solution of 5 g of silver nitrate in 150 ml of water were then added simultaneously to the resultant mixture near the stirrer over 4 minutes. After stirring for 5 minutes, a solution of 3.4 g of benzotriazole and 1.2 g of sodium hydroxide in 150 ml of water and a solution of 5 g of silver nitrate in 150 ml of water were added simultaneously to the mixture near the stirrer over 6 minutes. The pH of the emulsion thus obtained was controlled for precipitation to remove excess salts. The pH was adjusted to 6.0 to prepare a silver benzotriazole emulsion with a yield of 470 g.

(f) Preparation of Emulsified Dispersion Comprising Coupler 8.95 g of the following yellow coupler (CPY-1), 0.90 g of the development accelerator (X), 4.54 g of the high-boiling point organic solvent (e), 4.54 g of the high-boiling point organic solvent (f) and 50.0 ml of ethyl acetate were dissolved at 60° C. The resulting solution was mixed with 200 g of an aqueous solution containing 18.0 g of a lime-treated gelatin and 0.8 g of sodium dodecylbenzenesulfonate, and emulsified by a Dissolver stirrer at 10,000 rpm for 20 minutes. After dispersion, distilled water was added to the resultant mixture to make the total amount of 300 g and stirred at 2,000 rpm for 10 minutes.

Another emulsion was prepared in the same manner except for using 8.95 g of the following yellow coupler (CPY-2) in place of 8.95 g of the yellow coupler (CPY-1).

Yellow Coupler (CPY-1)

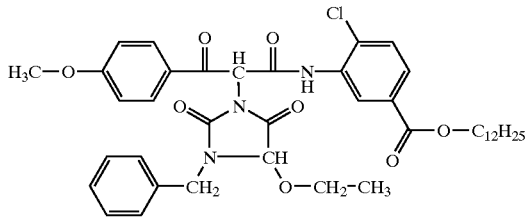

Yellow Coupler (CPY-2)

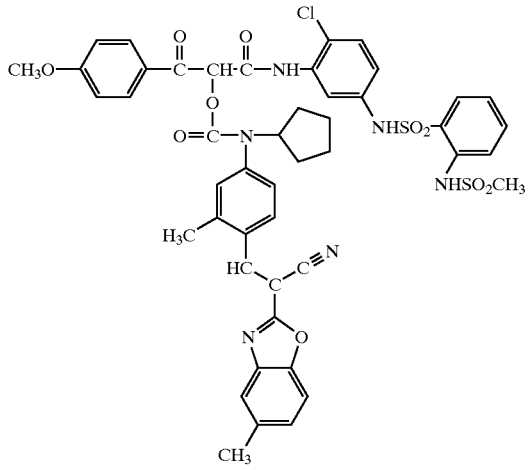

-continued

Development Accelerator (X)

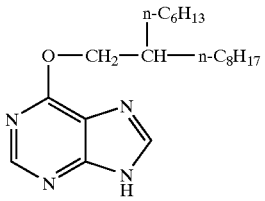

High-Boiling Point Organic Solvent (e)

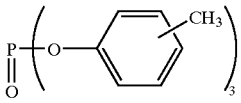

High-Boiling Point Organic Solvent (f)

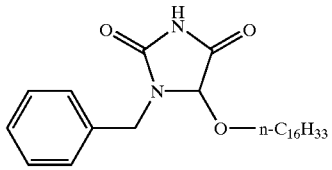

Emulsions comprising a magenta or cyan coupler were prepared in the same manner as above. 4.68 g of the following magenta coupler (CPM-1), 2.38 g of the magenta coupler (CPM-2) and 0.71 g of the development accelerator (X) were dissolved in 7.52 g of the high-boiling point organic solvent (e) and 38.0 ml of ethyl acetate at 60° C. The resulting solution was mixed with 150 g of an aqueous solution containing 12.2 g of a lime-treated gelatin and 0.8 g of sodium dodecylbenzenesulfonate, and emulsified at 10,000 rpm for 20 minutes by the Dissolver stirrer. After dispersion, distilled water was added to the resultant mixture to make the total amount 300 g, and stirred at 2,000 rpm for 10 minutes to prepare an emulsion.

Another emulsion was prepared in the same manner except for using 4.68 g of the magenta coupler (CPM-3) and 2.38 g of the magenta coupler (CPM-2) in place of 4.68 g of the magenta coupler (CPM-1) and MU 2.38 g of the magenta coupler (CPM-2).

Magenta Coupler (CPM-1)

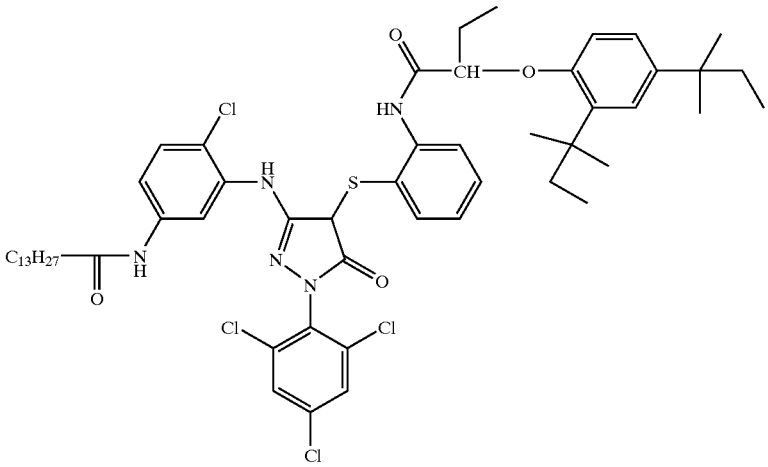

Magenta Coupler (CPM-2)

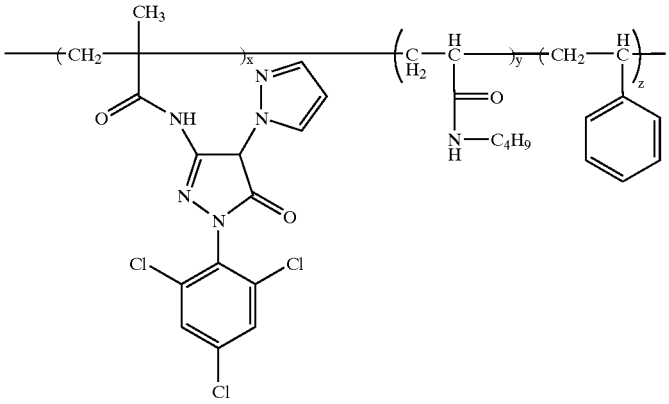

-continued

Magenta Coupler (CPM-3)

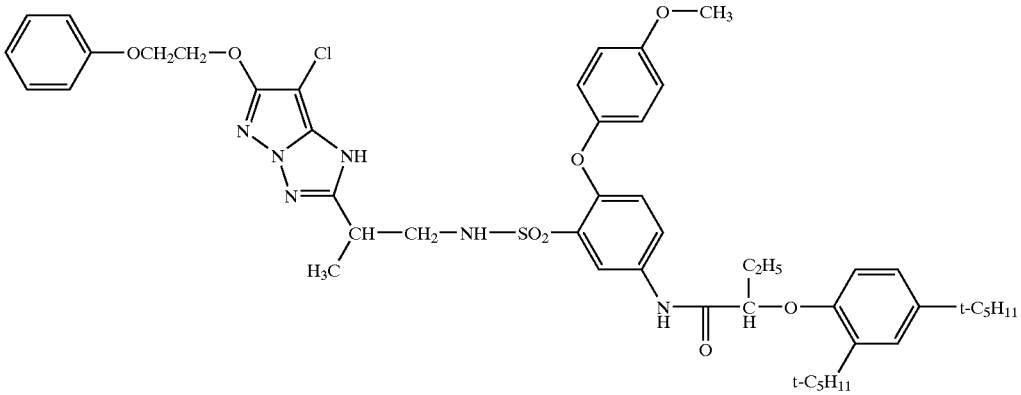

7.32 g of the following cyan coupler (CPC-1), 3.10 g of the cyan coupler (CPC-2) and 1.04 g of the development accelerator (X) were dissolved in 11.62 g of the high-boiling point organic solvent (e) and 38.0 ml of ethyl acetate at 60° C. The resulting solution was mixed with 150 g of an aqueous solution containing 12.2 g of a lime-treated gelatin and 0.8 g of sodium dodecylbenzenesulfonate, and emulsified at 10,000 rpm for 20 minutes by the Dissolver stirrer. After dispersion, distilled water was added to the resultant mixture to make the total amount 300 g, and stirred at 2,000 rpm for 10 minutes to prepare an emulsion.

Another emulsion was prepared in the same manner except for using 7.32 g of the cyan coupler (CPC-3) and 3.10 g of the cyan coupler (CPC-4) in place of 7.32 g of the cyan coupler (CPC-1) and 3.10 g of the cyan coupler (CPC-2).

Cyan Coupler (CPC-1)

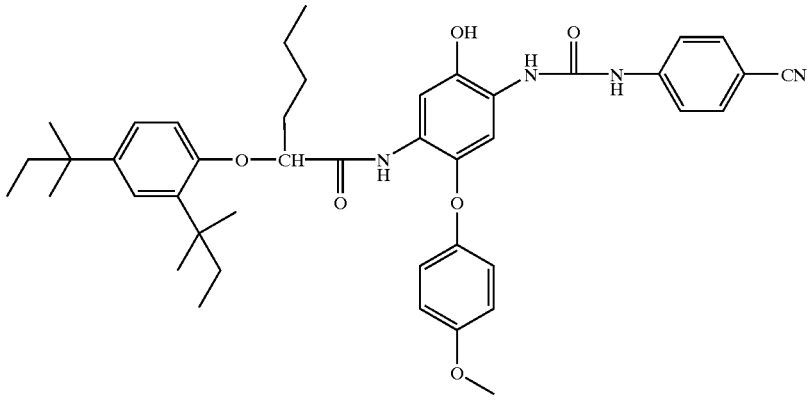

Cyan Coupler (CPC-2)

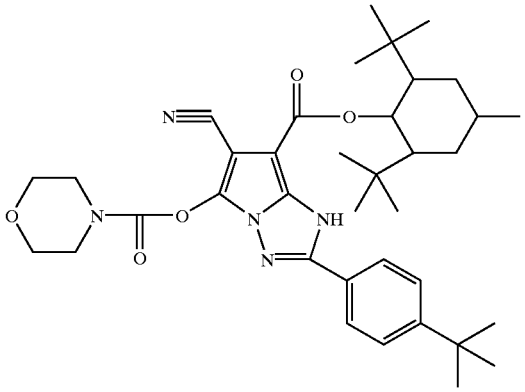

Cyan Coupler (CPC-3)

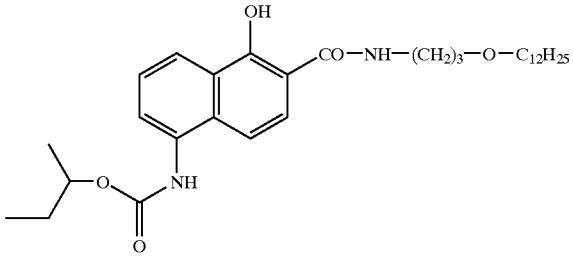

-continued

Cyan Coupler (CPC-4)

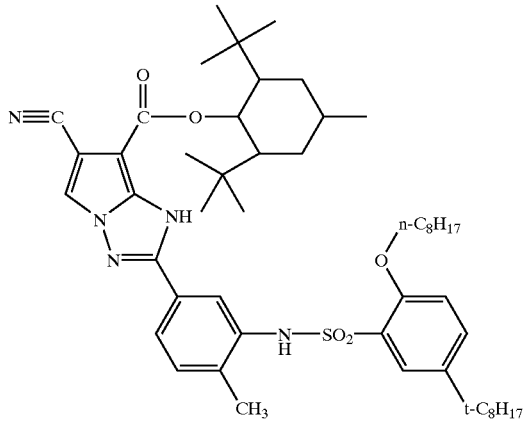

(g) Preparation of Developing Agent Dispersion

A microcrystal dispersion of the following developing agent DEV(1) was prepared as follows. 1.0 g of "Surfactant 10G" manufactured by Arch Chemicals and 100 g of water were added to a mixture of 50 g of the developing agent DEV(1) and 30 g of a 10 weight % aqueous solution of a modified polyvinyl alcohol "POVAL MP203" manufactured by Kuraray Co., Ltd. and well mixed to prepare a slurry.

The slurry was conveyed by a diaphragm pump to a horizontal-type sand mill ("UVM-2" manufactured by IMEX Co.) packed with zirconium beads having an average diameter of 0.5 mm, in which it was dispersed for 6 hours. Water was then added to the slurry to adjust the concentration of the developing agent DEV(1) to 10 weight %, to prepare a microcrystal dispersion. The microcrystal dispersion comprised grains having the median size of 0.50 μm and the maximum grain size of 1.5 μm or less. The resultant microcrystal dispersion was filtrated by a polypropylene filter having a pore size of 10.0 μm to remove foreign matter such as dust, and stored. The microcrystal dispersion was filtrated again by the polypropylene filter immediately before using.

A microcrystal dispersion of the following developing agent DEV(2) was prepared as follows. 0.5 g of Alkanol XC and 100 g of water were added to a mixture of 50 g of the developing agent DEV(2) and 30 g of a 10-weight % aqueous solution of modified polyvinyl alcohol "POVAL MP203" manufactured by Kuraray Co., Ltd. and well mixed to prepare a slurry. The slurry was conveyed by a diaphragm pump to a horizontal-type sand mill ("UVM-2" manufactured by IMEX Co.) packed with zirconium beads having an average diameter of 0.5 mm, in which it was dispersed for 6 hours. Water was then added to the slurry to adjust the concentration of the developing agent DEV(2) to 10 weight %, to prepare a microcrystal dispersion comprising grains having a median size of 0.30 μm and a maximum grain size of 1.0 μm or less. The resultant microcrystal dispersion was filtrated by a polypropylene filter having a pore size of 10.0 μm to remove foreign matter such as dust, and stored. The microcrystal dispersion was filtrated again by the polypropylene filter immediately before using.

DEV(1)

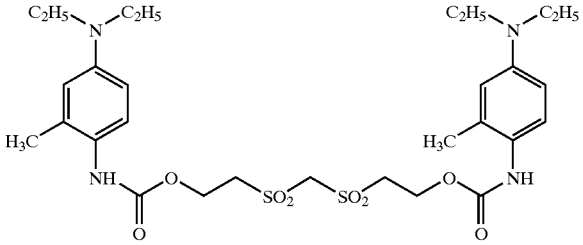

DEV(2)

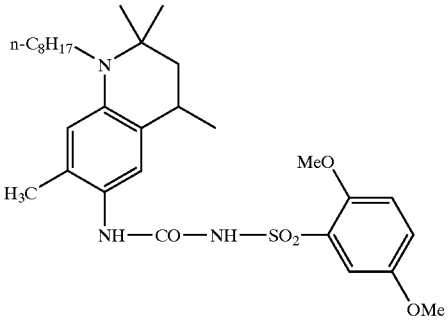

The solid dispersions of the developing agents were mixed at a weight ratio of 1:1 to form each photosensitive layer of a silver halide photosensitive material.

A dispersion of a heat-decolorable dye for coloring an intermediate layer as a filter layer or an antihalation layer was also prepared.

(h) Preparation of Dye Dispersion For Yellow Filter Layer 10 g of the following leuco dye L1, 40 g of stearyl alcohol and 10 g of the following developer (SD-1) were dissolved in 200 ml of ethyl acetate. The resulting solution was mixed with 150 g of 600 g of an aqueous solution containing 2.0 g of the surfactant (r), and emulsified at 10,000 rpm for 20 minutes by the Dissolver stirrer. After dispersion, the resultant mixture was stirred at 50° C. for 30 minutes in a nitrogen flow to remove ethyl acetate, and 30 g of a lime-treated gelatin was added to the mixture. Distilled water was added thereto to make the total amount 750 g, and stirred at 2,000 rpm for 10 minutes to prepare an emulsion.

Other dye dispersions for the magenta filter layer and the antihalation layer were prepared in the same manner as above except for using the following leuco dye L2 or L3 in place of the leuco dye L1.

Leuco Dye L1

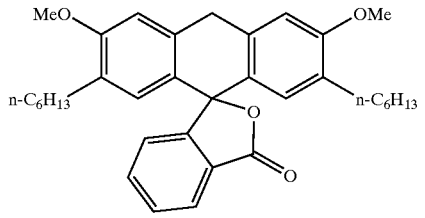

Developer (SD-1)

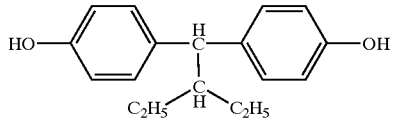

Leuco Dye L2

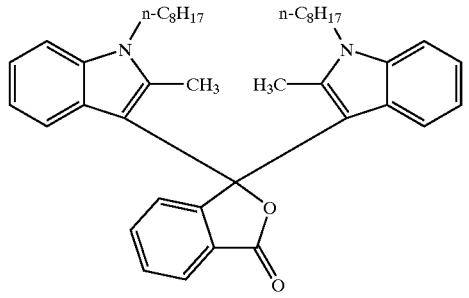

Leuco Dye L3

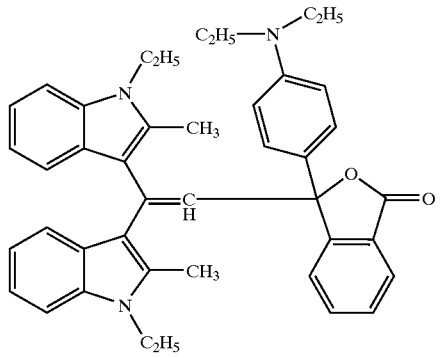

(i) Production of Silver Halide Color Photosensitive Materials 401 to 410

Using the above emulsions, etc., multi-layered, silver halide color photosensitive materials 401 to 408 having structures shown in Table 9 were produced. Each high-sensitivity layer of the silver halide photosensitive materials 405 to 408 comprised an emulsion of tabular silver iodobromide grains. The silver halide grains in each medium-sensitive layer exhibited a refractive index of 2.08 determined by component analysis, and an average thickness of 0.119 $\mu$m (photosensitive materials 405 and 406) or 0.114 m (photosensitive materials 407 and 408). The silver iodobromide grains in each high-sensitivity layer exhibited a refractive index of 2.24 determined by component analysis, and an average thickness of 0.041 $\mu$m. It was thus found that the photosensitive materials satisfied the conditions defined by the following equation (1) with no of 2.24, n2 of 2.08, a of 0.041 and b of 0.119 or 0.114.

$$n2 \leqq n1, \text{ and } a \leqq b \times (n2/n1) \quad (1).$$

Further, the temperature and time for forming grains were controlled in the preparation method of the silver iodobromide emulsion A-1 in Example 1, to form an emulsion E containing tabular grains having an average diameter of circles equivalent to the projected area of 2.98 $\mu$m, an average thickness of 0.184 $\mu$m and a major crystal face of (111) at a ratio of 70% or more per the total projected area. The emulsion E was subjected to the same chemical sensitization and spectral sensitization as in the emulsion D to prepare a blue-sensitive emulsion Eb, a green-sensitive emulsion Eg and a red-sensitive emulsion Er. Furthermore, the emulsions Db, Dg and Dr of the silver halide photosensitive materials 407 and 408 were changed to the emulsions Eb, Eg and Er, respectively, to prepare comparative silver halide photosensitive materials 409 and 410 that did not satisfy the condition of the equation (1).

The structures of the components shown in Table 9 are illustrated below.

TABLE 9

| Layer | Silver Halide Photosensitive Material 401 | mg/m$^2$ | Silver Halide Photosensitive Material 402 | mg/m$^2$ |
|---|---|---|---|---|
| Protective Layer | Lime-Treated Gelatin | 914 | Lime-Treated Gelatin | 914 |
| | Matting Agent (Silica) | 50 | Matting Agent (Silica) | 50 |
| | Surfactant (a) | 30 | Surfactant (a) | 30 |
| | Surfactant (b) | 40 | Surfactant (b) | 40 |
| | Water-Soluble Polymer (c) | 15 | Water-Soluble Polymer (c) | 15 |
| | Hardening Agent (t) | 110 | Hardening Agent (t) | 110 |
| Intermediate Layer | Lime-Treated Gelatin | 461 | Lime-Treated Gelatin | 461 |
| | Surfactant (b) | 5 | Surfactant (b) | 5 |
| | Salicylanilide | 200 | Salicylanilide | 200 |
| | Formalin Scavenger (d) | 150 | Formalin Scavenger (d) | 150 |
| | Water-Soluble Polymer (c) | 15 | Water-Soluble Polymer (c) | 15 |
| High-sensitivity, Yellow Color-Forming Layer | Lime-Treated Gelatin | 1750 | Lime-Treated Gelatin | 1750 |
| | Emulsion B-5b (Amount of Silver) | 550 | Emulsion B-5b (Amount of Silver) | 550 |
| | Silver Benzotriazole (Amount of Silver) | 165 | Silver Benzotriazole (Amount of Silver) | 165 |
| | Silver Salt of 1-Phenyl-5-Mercaptotetrazole | 437 | 1-Dodecyl-5-Mercaptotetrazole | 12 |
| | Yellow Coupler (CPY-1) | 179 | Yellow Coupler (CPY-1) | 179 |
| | DEV (1)/(2) | 230 | DEV (1)/(2) | 230 |
| | Development Accelerator (X) | 17.9 | Development Accelerator (X) | 17.9 |
| | High-boiling point organic solvent (e) | 90 | High-boiling point organic solvent (e) | 90 |
| | High-boiling point organic solvent (f) | 115 | High-boiling point organic solvent (f) | 115 |
| | Surfactant (g) | 27 | Surfactant (g) | 27 |
| | Salicylanilide | 200 | Salicylanilide | 200 |
| | Water-Soluble Polymer (c) | 1 | Water-Soluble Polymer (c) | 1 |
| Medium-Sensitivity, Yellow Color-Forming Layer | Lime-Treated Gelatin | 1470 | Lime-Treated Gelatin | 1470 |
| | Emulsion B-4b (Amount of Silver) | 263 | Emulsion B-4b (Amount of Silver) | 263 |

TABLE 9-continued

| | | | | |
|---|---|---|---|---|
| | Silver Benzotriazole (Amount of Silver) | 79 | Silver Benzotriazole (Amount of Silver) | 79 |
| | Silver Salt of 1-Phenyl-5-Mercaptotetrazole | 209 | 1-Dodecyl-5-Mercaptotetrazole | 6 |
| | Yellow Coupler (CPY-2) | 269 | Yellow Coupler (CPY-2) | 269 |
| | DEV (1)/(2) | 380 | DEV (1)/(2) | 380 |
| | Development Accelerator (X) | 26.9 | Development Accelerator (X) | 26.9 |
| | High-boiling point organic solvent (e) | 134 | High-boiling point organic solvent (e) | 134 |
| | High-boiling point organic solvent (f) | 190 | High-boiling point organic solvent (f) | 190 |
| | Surfactant (g) | 26 | Surfactant (g) | 26 |
| | Salicylanilide | 300 | Salicylanilide | 300 |
| | Water-Soluble Polymer (c) | 2 | Water-Soluble Polymer (c) | 2 |
| Low-sensitivity, Yellow Color-Forming Layer | Lime-Treated Gelatin | 1680 | Lime-Treated Gelatin | 1680 |
| | Emulsion B-3b (Amount of Silver) | 240 | Emulsion B-3b (Amount of Silver) | 240 |
| | Silver Benzotriazole (Amount of Silver) | 72 | Silver Benzotriazole (Amount of Silver) | 72 |
| | Silver Salt of 1-Phenyl-5-Mercaptotetrazole | 191 | 1-Dodecyl-5-Mercaptotetrazole | 5 |
| | Yellow Coupler (CPY-2) | 448 | Yellow Coupler (CPY-2) | 448 |
| | DEV (1)/(2) | 590 | DEV (1)/(2) | 590 |
| | Development Accelerator (X) | 44.8 | Development Accelerator (X) | 44.8 |
| | High-boiling point organic solvent (e) | 224 | High-boiling point organic solvent (e) | 224 |
| | High-boiling point organic solvent (f) | 295 | High-boiling point organic solvent (f) | 295 |
| | Surfactant (g) | 30 | Surfactant (g) | 30 |
| | Salicylanilide | 600 | Salicylanilide | 600 |
| | Water-Soluble Polymer (c) | 3 | Water-Soluble Polymer (c) | 3 |
| Intermediate Layer (Yellow Filter Layer) | Lime-Treated Gelatin | 560 | Lime-Treated Gelatin | 560 |
| | Surfactant (b) | 15 | Surfactant (b) | 15 |
| | Surfactant (g) | 60 | Surfactant (g) | 60 |
| | Stearyl Alcohol | 1200 | Stearyl Alcohol | 1200 |
| | Leuco Dye L1 | 300 | Leuco Dye L1 | 300 |
| | Developer (SD-1) | 300 | Developer (SD-1) | 300 |
| | Water-Soluble Polymer (c) | 15 | Water-Soluble Polymer (c) | 15 |
| High-sensitivity, Magenta Color-Forming Layer | Lime-Treated Gelatin | 781 | Lime-Treated Gelatin | 781 |
| | Emulsion B-5g (Amount of Silver) | 488 | Emulsion B-5g (Amount of Silver) | 488 |
| | Silver Benzotriazole (Amount of Silver) | 146 | Silver Benzotriazole (Amount of Silver) | 146 |
| | Silver Salt of 1-Phenyl-5-Mercaptotetrazole | 388 | 1-Dodecyl-5-Mercaptotetrazole | 11 |
| | Magenta Coupler (CPM-1) | 47 | Magenta Coupler (CPM-1) | 47 |
| | Magenta Coupler (CPM-2) | 24 | Magenta Coupler (CPM-2) | 24 |
| | DEV (1)/(2) | 74 | DEV (1)/(2) | 74 |
| | Development Accelerator (X) | 4.7 | Development Accelerator (X) | 4.7 |
| | High-boiling point organic solvent (e) | 75 | High-boiling point organic solvent (e) | 75 |
| | Surfactant (g) | 8 | Surfactant (g) | 8 |
| | Salicylanilide | 100 | Salicylanilide | 100 |
| | Water-Soluble Polymer (c) | 8 | Water-Soluble Polymer (c) | 8 |
| Medium-Sensitivity, Magenta Color-Forming Layer | Lime-Treated Gelatin | 659 | Lime-Treated Gelatin | 659 |
| | Emulsion B-4g (Amount of Silver) | 492 | Emulsion B-4g (Amount of Silver) | 492 |
| | Silver Benzotriazole (Amount of Silver) | 148 | Silver Benzotriazole (Amount of Silver) | 148 |
| | Silver Salt of 1-Phenyl-5-Mercaptotetrazole | 391 | 1-Dodecyl-5-Mercaptotetrazole | 11 |
| | Magenta Coupler (CPM-3) | 94 | Magenta Coupler (CPM-3) | 94 |
| | Magenta Coupler (CPM-2) | 48 | Magenta Coupler (CPM-2) | 48 |
| | DEV (1)/(2) | 140 | DEV (1)/(2) | 140 |
| | Development Accelerator (X) | 14.1 | Development Accelerator (X) | 14.1 |
| | High-boiling point organic solvent (e) | 150 | High-boiling point organic solvent (e) | 150 |
| | Surfactant (g) | 11 | Surfactant (g) | 11 |
| | Salicylanilide | 80 | Salicylanilide | 80 |
| | Water-Soluble Polymer (c) | 14 | Water-Soluble Polymer (c) | 14 |
| Low-sensitivity, Magenta Color-Forming Layer | Lime-Treated Gelatin | 711 | Lime-Treated Gelatin | 711 |
| | Emulsion B-3g (Amount of Silver) | 240 | Emulsion B-3g (Amount of Silver) | 240 |
| | Silver Benzotriazole (Amount of Silver) | 72 | Silver Benzotriazole (Amount of Silver) | 72 |
| | Silver Salt of 1-Phenyl-5-Mercaptotetrazole | 191 | 1-Dodecyl-5-Mercaptotetrazole | 5 |
| | Magenta Coupler (CPM-3) | 234 | Magenta Coupler (CPM-3) | 234 |
| | Magenta Coupler (CPM-2) | 119 | Magenta Coupler (CPM-2) | 119 |
| | DEV (1)/(2) | 349 | DEV (1)/(2) | 349 |
| | Development Accelerator (X) | 35.3 | Development Accelerator (X) | 35.3 |
| | High-boiling point organic solvent (e) | 376 | High-boiling point organic solvent (e) | 376 |
| | Surfactant (g) | 29 | Surfactant (g) | 29 |
| | Salicylanilide | 80 | Salicylanilide | 80 |
| | Water-Soluble Polymer (c) | 14 | Water-Soluble Polymer (c) | 14 |
| Intermediate Layer (Magenta Filter Layer) | Lime-Treated Gelatin | 850 | Lime-Treated Gelatin | 850 |
| | Surfactant (g) | 15 | Surfactant (g) | 15 |
| | Surfactant (h) | 24 | Surfactant (h) | 24 |
| | Stearyl Alcohol | 300 | Stearyl Alcohol | 300 |
| | Leuco Dye L2 | 75 | Leuco Dye L2 | 75 |
| | Developer (SD-1) | 75 | Developer (SD-1) | 75 |
| | Formalin Scavenger (d) | 300 | Formalin Scavenger (d) | 300 |
| | Water-Soluble Polymer (c) | 15 | Water-Soluble Polymer (c) | 15 |
| High-sensitivity, Cyan Color-Forming Layer | Lime-Treated Gelatin | 842 | Lime-Treated Gelatin | 842 |
| | Emulsion B-5r (Amount of Silver) | 550 | Emulsion B-5r (Amount of Silver) | 550 |
| | Silver Benzotriazole (Amount of Silver) | 165 | Silver Benzotriazole (Amount of Silver) | 165 |
| | Silver Salt of 1-Phenyl-5- | 437 | 1-Dodecyl-5-Mercaptotetrazole | 12 |

TABLE 9-continued

| | | | | |
|---|---|---|---|---|
| | Mercaptotetrazole | | | |
| | Cyan Coupler (CPC-1) | 19 | Cyan Coupler (CPC-1) | 19 |
| | Cyan Coupler (CPC-2) | 44 | Cyan Coupler (CPC-2) | 44 |
| | DEV (1)/(2) | 91 | DEV (1)/(2) | 91 |
| | Development Accelerator (X) | 6.2 | Development Accelerator (X) | 6.2 |
| | High-boiling point organic solvent (e) | 70 | High-boiling point organic solvent (e) | 70 |
| | Surfactant (g) | 5 | Surfactant (g) | 5 |
| | Salicylanilide | 80 | Salicylanilide | 80 |
| | Water-Soluble Polymer (c) | 18 | Water-Soluble Polymer (c) | 18 |
| Medium-Sensitivity, Cyan Color-Forming Layer | Lime-Treated Gelatin | 475 | Lime-Treated Gelatin | 475 |
| | Emulsion B-4r (Amount of Silver) | 600 | Emulsion B-4r (Amount of Silver) | 600 |
| | Silver Benzotriazole (Amount of Silver) | 180 | Silver Benzotriazole (Amount of Silver) | 180 |
| | Silver Salt of 1-Phenyl-5-Mercaptotetrazole | 477 | 1-Dodecyl-5-Mercaptotetrazole | 13 |
| | Cyan Coupler (CPC-3) | 56 | Cyan Coupler (CPC-3) | 56 |
| | Cyan Coupler (CPC-4) | 131 | Cyan Coupler (CPC-4) | 131 |
| | DEV (1)/(2) | 209 | DEV (1)/(2) | 209 |
| | Development Accelerator (X) | 18.7 | Development Accelerator (X) | 18.7 |
| | High-boiling point organic solvent (e) | 209 | High-boiling point organic solvent (e) | 209 |
| | Surfactant (g) | 10 | Surfactant (g) | 10 |
| | Salicylanilide | 50 | Salicylanilide | 50 |
| | Water-Soluble Polymer (c) | 15 | Water-Soluble Polymer (c) | 15 |
| Low-sensitivity, Cyan Color-Forming Layer | Lime-Treated Gelatin | 825 | Lime-Treated Gelatin | 825 |
| | Emulsion B-3r (Amount of Silver) | 300 | Emulsion B-3r (Amount of Silver) | 300 |
| | Silver Benzotriazole (Amount of Silver) | 90 | Silver Benzotriazole (Amount of Silver) | 90 |
| | Silver Salt of 1-Phenyl-5-Mercaptotetrazole | 239 | 1-Dodecyl-5-Mercaptotetrazole | 7 |
| | Cyan Coupler (CPC-3) | 99 | Cyan Coupler (CPC-3) | 99 |
| | Cyan Coupler (CPC-4) | 234 | Cyan Coupler (CPC-4) | 234 |
| | DEV (1)/(2) | 373 | DEV (1)/(2) | 373 |
| | Development Accelerator (X) | 33.2 | Development Accelerator (X) | 33.2 |
| | High-boiling point organic solvent (e) | 372 | High-boiling point organic solvent (e) | 372 |
| | Surfactant (g) | 17 | Surfactant (g) | 17 |
| | Salicylanilide | 100 | Salicylanilide | 100 |
| | Water-Soluble Polymer (c) | 10 | Water-Soluble Polymer (c) | 10 |
| Antihalation Layer | Lime-Treated Gelatin | 440 | Lime-Treated Gelatin | 440 |
| | Surfactant (g) | 14 | Surfactant (g) | 14 |
| | Stearyl Alcohol | 2400 | Stearyl Alcohol | 2400 |
| | Leuco Dye L3 | 600 | Leuco Dye L3 | 600 |
| | Developer (SD-1) | 600 | Developer (SD-1) | 600 |
| | Surfactant (b) | 120 | Surfactant (b) | 120 |
| | Water-Soluble Polymer (c) | 15 | Water-Soluble Polymer (c) | 15 |

TABLE 9-continued

Transparent PEN Substrate (96 mm)

| Layer | Silver Halide Photosensitive Material 403 | mg/m$^2$ | Silver Halide Photosensitive Material 404 | mg/m$^2$ |
|---|---|---|---|---|
| Protective Layer | Lime-Treated Gelatin | 914 | Lime-Treated Gelatin | 914 |
| | Matting Agent (Silica) | 50 | Matting Agent (Silica) | 50 |
| | Surfactant (a) | 30 | Surfactant (a) | 30 |
| | Surfactant (b) | 40 | Surfactant (b) | 40 |
| | Water-Soluble Polymer (c) | 15 | Water-Soluble Polymer (c) | 15 |
| | Hardening Agent (t) | 110 | Hardening Agent (t) | 110 |
| Intermediate Layer | Lime-Treated Gelatin | 461 | Lime-Treated Gelatin | 461 |
| | Surfactant (b) | 5 | Surfactant (b) | 5 |
| | Salicylanilide | 200 | Salicylanilide | 200 |
| | Formalin Scavenger (d) | 150 | Formalin Scavenger (d) | 150 |
| | Water-Soluble Polymer (c) | 15 | Water-Soluble Polymer (c) | 15 |
| High-sensitivity, Yellow Color-Forming Layer | Lime-Treated Gelatin | 1750 | Lime-Treated Gelatin | 1750 |
| | Emulsion C-5b (Amount of Silver) | 550 | Emulsion C-5b (Amount of Silver) | 550 |
| | Silver Benzotriazole (Amount of Silver) | 165 | Silver Benzotriazole (Amount of Silver) | 165 |
| | Silver Salt of 1-Phenyl-5-Mercaptotetrazole | 437 | 1-Dodecyl-5-Mercaptotetrazole | 12 |
| | Yellow Coupler (CPY-1) | 179 | Yellow Coupler (CPY-1) | 179 |
| | DEV (1)/(2) | 230 | DEV (1)/(2) | 230 |
| | Development Accelerator (X) | 17.9 | Development Accelerator (X) | 17.9 |
| | High-boiling point organic solvent (e) | 90 | High-boiling point organic solvent (e) | 90 |
| | High-boiling point organic solvent (f) | 115 | High-boiling point organic solvent (f) | 115 |
| | Surfactant (g) | 27 | Surfactant (g) | 27 |
| | Salicylanilide | 200 | Salicylanilide | 200 |
| | Water-Soluble Polymer (c) | 1 | Water-Soluble Polymer (c) | 1 |
| Medium-Sensitivity, Yellow Color-Forming Layer | Lime-Treated Gelatin | 1470 | Lime-Treated Gelatin | 1470 |
| | Emulsion C-4b (Amount of Silver) | 263 | Emulsion C-4b (Amount of Silver) | 263 |
| | Silver Benzotriazole (Amount of Silver) | 79 | Silver Benzotriazole (Amount of Silver) | 79 |
| | Silver Salt of 1-Phenyl-5-Mercaptotetrazole | 209 | 1-Dodecyl-5-Mercaptotetrazole | 6 |
| | Yellow Coupler (CPY-2) | 269 | Yellow Coupler (CPY-2) | 269 |
| | DEV (1)/(2) | 380 | DEV (1)/(2) | 380 |
| | Development Accelerator (X) | 26.9 | Development Accelerator (X) | 26.9 |
| | High-boiling point organic solvent (e) | 134 | High-boiling point organic solvent (e) | 134 |
| | High-boiling point organic solvent (f) | 190 | High-boiling point organic solvent (f) | 190 |
| | Surfactant (g) | 26 | Surfactant (g) | 26 |
| | Salicylanilide | 300 | Salicylanilide | 300 |
| | Water-Soluble | 2 | Water-Soluble | 2 |

TABLE 9-continued

| | | | | |
|---|---|---|---|---|
| | Polymer (c) | | Polymer (c) | |
| Low-sensitivity, Yellow Color-Forming Layer | Lime-Treated Gelatin | 1680 | Lime-Treated Gelatin | 1680 |
| | Emulsion C-3b (Amount of Silver) | 240 | Emulsion C-3b (Amount of Silver) | 240 |
| | Silver Benzotriazole (Amount of Silver) | 72 | Silver Benzotriazole (Amount of Silver) | 72 |
| | Silver Salt of 1-Phenyl-5-Mercaptotetrazole | 191 | 1-Dodecyl-5-Mercaptotetrazole | 5 |
| | Yellow Coupler (CPY-2) | 448 | Yellow Coupler (CPY-2) | 448 |
| | DEV (1)/(2) | 590 | DEV (1)/(2) | 590 |
| | Development Accelerator (X) | 44.8 | Development Accelerator (X) | 44.8 |
| | High-boiling point organic solvent (e) | 224 | High-boiling point organic solvent (e) | 224 |
| | High-boiling point organic solvent (f) | 295 | High-boiling point organic solvent (f) | 295 |
| | Surfactant (g) | 30 | Surfactant (g) | 30 |
| | Salicylanilide | 600 | Salicylanilide | 600 |
| | Water-Soluble Polymer (c) | 3 | Water-Soluble Polymer (c) | 3 |
| Intermediate Layer (Yellow Filter Layer) | Lime-Treated Gelatin | 560 | Lime-Treated Gelatin | 560 |
| | Surfactant (b) | 15 | Surfactant (b) | 15 |
| | Surfactant (g) | 60 | Surfactant (g) | 60 |
| | Stearyl Alcohol | 1200 | Stearyl Alcohol | 1200 |
| | Leuco Dye L1 | 300 | Leuco Dye L1 | 300 |
| | Developer (SD-1) | 300 | Developer (SD-1) | 300 |
| | Water-Soluble Polymer (c) | 15 | Water-Soluble Polymer (c) | 15 |
| High-sensitivity, Magenta Color-Forming Layer | Lime-Treated Gelatin | 781 | Lime-Treated Gelatin | 781 |
| | Emulsion C-5g (Amount of Silver) | 488 | Emulsion C-5g (Amount of Silver) | 488 |
| | Silver Benzotriazole (Amount of Silver) | 146 | Silver Benzotriazole (Amount of Silver) | 146 |
| | Silver Salt of 1-Phenyl-5-Mercaptotetrazole | 388 | 1-Dodecyl-5-Mercaptotetrazole | 11 |
| | Magenta Coupler (CPM-1) | 47 | Magenta Coupler (CPM-1) | 47 |
| | Magenta Coupler (CPM-2) | 24 | Magenta Coupler (CPM-2) | 24 |
| | DEV (1)/(2) | 74 | DEV (1)/(2) | 74 |
| | Development Accelerator (X) | 4.7 | Development Accelerator (X) | 4.7 |
| | High-boiling point organic solvent (e) | 75 | High-boiling point organic solvent (e) | 75 |
| | Surfactant (g) | 8 | Surfactant (g) | 8 |
| | Salicylanilide | 100 | Salicylanilide | 100 |
| | Water-Soluble Polymer (c) | 8 | Water-Soluble Polymer (c) | 8 |
| Medium-Sensitivity, Magenta Color-Forming Layer | Lime-Treated Gelatin | 659 | Lime-Treated Gelatin | 659 |
| | Emulsion C-4g (Amount of Silver) | 492 | Emulsion C-4g (Amount of Silver) | 492 |
| | Silver Benzotriazole (Amount of Silver) | 148 | Silver Benzotriazole (Amount of Silver) | 148 |
| | Silver Salt of 1-Phenyl-5-Mercaptotetrazole | 391 | 1-Dodecyl-5-Mercaptotetrazole | 11 |
| | Magenta Coupler (CPM-3) | 94 | Magenta Coupler (CPM-3) | 94 |
| | Magenta Coupler (CPM-2) | 48 | Magenta Coupler (CPM-2) | 48 |

TABLE 9-continued

| | | | | |
|---|---|---|---|---|
| | DEV (1)/(2) | 140 | DEV (1)/(2) | 140 |
| | Development Accelerator (X) | 14.1 | Development Accelerator (X) | 14.1 |
| | High-boiling point organic solvent (e) | 150 | High-boiling point organic solvent (e) | 150 |
| | Surfactant (g) | 11 | Surfactant (g) | 11 |
| | Salicylanilide | 80 | Salicylanilide | 80 |
| | Water-Soluble Polymer (c) | 14 | Water-Soluble Polymer (c) | 14 |
| Low-sensitivity, Magenta Color-Forming Layer | Lime-Treated Gelatin | 711 | Lime-Treated Gelatin | 711 |
| | Emulsion C-3g (Amount of Silver) | 240 | Emulsion C-3g (Amount of Silver) | 240 |
| | Silver Benzotriazole (Amount of Silver) | 72 | Silver Benzotriazole (Amount of Silver) | 72 |
| | Silver Salt of 1-Phenyl-5-Mercaptotetrazole | 191 | 1-Dodecyl-5-Mercaptotetrazole | 5 |
| | Magenta Coupler (CPM-3) | 234 | Magenta Coupler (CPM-3) | 234 |
| | Magenta Coupler (CPM-2) | 119 | Magenta Coupler (CPM-2) | 119 |
| | DEV (1)/(2) | 349 | DEV (1)/(2) | 349 |
| | Development Accelerator (X) | 35.3 | Development Accelerator (X) | 35.3 |
| | High-boiling point organic solvent (e) | 376 | High-boiling point organic solvent (e) | 376 |
| | Surfactant (g) | 29 | Surfactant (g) | 29 |
| | Salicylanilide | 80 | Salicylanilide | 80 |
| | Water-Soluble Polymer (c) | 14 | Water-Soluble Polymer (c) | 14 |
| Intermediate Layer (Magenta Filter Layer) | Lime-Treated Gelatin | 850 | Lime-Treated Gelatin | 850 |
| | Surfactant (g) | 15 | Surfactant (g) | 15 |
| | Surfactant (h) | 24 | Surfactant (h) | 24 |
| | Stearyl Alcohol | 300 | Stearyl Alcohol | 300 |
| | Leuco Dye L2 | 75 | Leuco Dye L2 | 75 |
| | Developer (SD-1) | 75 | Developer (SD-1) | 75 |
| | Formalin Scavenger (d) | 300 | Formalin Scavenger (d) | 300 |
| | Water-Soluble Polymer (c) | 15 | Water-Soluble Polymer (c) | 15 |
| High-sensitivity, Cyan Color-Forming Layer | Lime-Treated Gelatin | 842 | Lime-Treated Gelatin | 842 |
| | Emulsion C-5r (Amount of Silver) | 550 | Emulsion C-5r (Amount of Silver) | 550 |
| | Silver Benzotriazole (Amount of Silver) | 165 | Silver Benzotriazole (Amount of Silver) | 165 |
| | Silver Salt of 1-Phenyl-5-Mercaptotetrazole | 437 | 1-Dodecyl-5-Mercaptotetrazole | 12 |
| | Cyan Coupler (CPC-1) | 19 | Cyan Coupler (CPC-1) | 19 |
| | Cyan Coupler (CPC-2) | 44 | Cyan Coupler (CPC-2) | 44 |
| | DEV (1)/(2) | 91 | DEV (1)/(2) | 91 |
| | Development Accelerator (X) | 6.2 | Development Accelerator (X) | 6.2 |
| | High-boiling point organic solvent (e) | 70 | High-boiling point organic solvent (e) | 70 |
| | Surfactant (g) | 5 | Surfactant (g) | 5 |
| | Salicylanilide | 80 | Salicylanilide | 80 |
| | Water-Soluble Polymer (c) | 18 | Water-Soluble Polymer (c) | 18 |
| Medium-Sensitivity, Cyan Color-Forming Layer | Lime-Treated Gelatin | 475 | Lime-Treated Gelatin | 475 |
| | Emulsion C-4r (Amount of Silver) | 600 | Emulsion C-4r (Amount of Silver) | 600 |
| | Silver | 180 | Silver | 180 |

TABLE 9-continued

| | | | | |
|---|---|---|---|---|
| | Benzotriazole (Amount of Silver) | | Benzotriazole (Amount of Silver) | |
| | Silver Salt of 1-Phenyl-5-Mercaptotetrazole | 477 | 1-Dodecyl-5-Mercaptotetrazole | 13 |
| | Cyan Coupler (CPC-3) | 56 | Cyan Coupler (CPC-3) | 56 |
| | Cyan Coupler (CPC-4) | 131 | Cyan Coupler (CPC-4) | 131 |
| | DEV (1)/(2) | 209 | DEV (1)/(2) | 209 |
| | Development Accelerator (X) | 18.7 | Development Accelerator (X) | 18.7 |
| | High-boiling point organic solvent (e) | 209 | High-boiling point organic solvent (e) | 209 |
| | Surfactant (g) | 10 | Surfactant (g) | 10 |
| | Salicylanilide | 50 | Salicylanilide | 50 |
| | Water-Soluble Polymer (c) | 15 | Water-Soluble Polymer (c) | 15 |
| Low-sensitivity, Cyan Color-Forming Layer | Lime-Treated Gelatin | 825 | Lime-Treated Gelatin | 825 |
| | Emulsion C-3r (Amount of Silver) | 300 | Emulsion C-3r (Amount of Silver) | 300 |
| | Silver Benzotriazole (Amount of Silver) | 90 | Silver Benzotriazole (Amount of Silver) | 90 |
| | Silver Salt of 1-Phenyl-5-Mercaptotetrazole | 239 | 1-Dodecyl-5-Mercaptotetrazole | 7 |
| | Cyan Coupler (CPC-3) | 99 | Cyan Coupler (CPC-3) | 99 |
| | Cyan Coupler (CPC-4) | 234 | Cyan Coupler (CPC-4) | 234 |
| | DEV (1)/(2) | 373 | DEV (1)/(2) | 373 |
| | Development Accelerator (X) | 33.2 | Development Accelerator (X) | 33.2 |
| | High-boiling point organic solvent (e) | 372 | High-boiling point organic solvent (e) | 372 |
| | Surfactant (g) | 17 | Surfactant (g) | 17 |
| | Salicylanilide | 100 | Salicylanilide | 100 |
| | Water-Soluble Polymer (c) | 10 | Water-Soluble Polymer (c) | 10 |
| Antihalation Layer | Lime-Treated Gelatin | 440 | Lime-Treated Gelatin | 440 |
| | Surfactant (g) | 14 | Surfactant (g) | 14 |
| | Stearyl Alcohol | 2400 | Stearyl Alcohol | 2400 |
| | Leuco Dye L3 | 600 | Leuco Dye L3 | 600 |
| | Developer (SD-1) | 600 | Developer (SD-1) | 600 |
| | Surfactant (b) | 120 | Surfactant (b) | 120 |
| | Water-Soluble Polymer (c) | 15 | Water-Soluble Polymer (c) | 15 |
| Transparent PEN Substrate (96 mm) | | | | |

| Layer | Silver Halide Photosensitive Material 405 | mg/m$^2$ | Silver Halide Photosensitive Material 406 | mg/m$^2$ |
|---|---|---|---|---|
| Protective Layer | Lime-Treated Gelatin | 914 | Lime-Treated Gelatin | 914 |
| | Matting Agent (Silica) | 50 | Matting Agent (Silica) | 50 |
| | Surfactant (a) | 30 | Surfactant (a) | 30 |
| | Surfactant (b) | 40 | Surfactant (b) | 40 |
| | Water-Soluble Polymer (c) | 15 | Water-Soluble Polymer (c) | 15 |
| | Hardening Agent (t) | 110 | Hardening Agent (t) | 110 |
| Intermediate Layer | Lime-Treated Gelatin | 461 | Lime-Treated Gelatin | 461 |
| | Surfactant (b) | 5 | Surfactant (b) | 5 |
| | Salicylanilide | 200 | Salicylanilide | 200 |
| | Formalin | 150 | Formalin | 150 |
| | Scavenger (d) | | Scavenger (d) | |
| | Water-Soluble Polymer (c) | 15 | Water-Soluble Polymer (c) | 15 |

TABLE 9-continued

| | | | | |
|---|---|---|---|---|
| High-sensitivity, Yellow Color-Forming Layer | Lime-Treated Gelatin | 1750 | Lime-Treated Gelatin | 1750 |
| | Emulsion Db (Amount of Silver) | 550 | Emulsion Db (Amount of Silver) | 550 |
| | Silver Benzotriazole (Amount of Silver) | 165 | Silver Benzotriazole (Amount of Silver) | 165 |
| | Silver Salt of 1-Phenyl-5-Mercaptotetrazole | 437 | 1-Dodecyl-5-Mercaptotetrazole | 12 |
| | Yellow Coupler (CPY-1) | 179 | Yellow Coupler (CPY-1) | 179 |
| | DEV (1)/(2) | 230 | DEV (1)/(2) | 230 |
| | Development Accelerator (X) | 17.9 | Development Accelerator (X) | 17.9 |
| | High-boiling point organic solvent (e) | 90 | High-boiling point organic solvent (e) | 90 |
| | High-boiling point organic solvent (f) | 115 | High-boiling point organic solvent (f) | 115 |
| | Surfactant (g) | 27 | Surfactant (g) | 27 |
| | Salicylanilide | 200 | Salicylanilide | 200 |
| | Water-Soluble Polymer (c) | 1 | Water-Soluble Polymer (c) | 1 |
| Medium-Sensitivity, Yellow Color-Forming Layer | Lime-Treated Gelatin | 1470 | Lime-Treated Gelatin | 1470 |
| | Emulsion B-4b (Amount of Silver) | 263 | Emulsion B-4b (Amount of Silver) | 263 |
| | Silver Benzotriazole (Amount of Silver) | 79 | Silver Benzotriazole (Amount of Silver) | 79 |
| | Silver Salt of 1-Phenyl-5-Mercaptotetrazole | 209 | 1-Dodecyl-5-Mercaptotetrazole | 6 |
| | Yellow Coupler (CPY-2) | 269 | Yellow Coupler (CPY-2) | 269 |
| | DEV (1)/(2) | 380 | DEV (1)/(2) | 380 |
| | Development Accelerator (X) | 26.9 | Development Accelerator (X) | 26.9 |
| | High-boiling point organic solvent (e) | 134 | High-boiling point organic solvent (e) | 134 |
| | High-boiling point organic solvent (f) | 190 | High-boiling point organic solvent (f) | 190 |
| | Surfactant (g) | 26 | Surfactant (g) | 26 |
| | Salicylanilide | 300 | Salicylanilide | 300 |
| | Water-Soluble Polymer (c) | 2 | Water-Soluble Polymer (c) | 2 |
| Low-sensitivity, Yellow Color-Forming Layer | Lime-Treated Gelatin | 1680 | Lime-Treated Gelatin | 1680 |
| | Emulsion B-3b (Amount of Silver) | 240 | Emulsion B-3b (Amount of Silver) | 240 |
| | Silver Benzotriazole (Amount of Silver) | 72 | Silver Benzotriazole (Amount of Silver) | 72 |
| | Silver Salt of 1-Phenyl-5-Mercaptotetrazole | 191 | 1-Dodecyl-5-Mercaptotetrazole | 5 |
| | Yellow Coupler (CPY-2) | 448 | Yellow Coupler (CPY-2) | 448 |
| | DEV (1)/(2) | 590 | DEV (1)/(2) | 590 |
| | Development Accelerator (X) | 44.8 | Development Accelerator (X) | 44.8 |
| | High-boiling point organic solvent (e) | 224 | High-boiling point organic solvent (e) | 224 |
| | High-boiling point organic solvent (f) | 295 | High-boiling point organic solvent (f) | 295 |
| | Surfactant (g) | 30 | Surfactant (g) | 30 |
| | Salicylanilide | 600 | Salicylanilide | 600 |

TABLE 9-continued

| | | | | |
|---|---|---|---|---|
| | Water-Soluble Polymer (c) | 3 | Water-Soluble Polymer (c) | 3 |
| Intermediate Layer (Yellow Filter Layer) | Lime-Treated Gelatin | 560 | Lime-Treated Gelatin | 560 |
| | Surfactant (b) | 15 | Surfactant (b) | 15 |
| | Surfactant (g) | 60 | Surfactant (g) | 60 |
| | Stearyl Alcohol | 1200 | Stearyl Alcohol | 1200 |
| | Leuco Dye L1 | 300 | Leuco Dye L1 | 300 |
| | Developer (SD-1) | 300 | Developer (SD-1) | 300 |
| | Water-Soluble Polymer (c) | 15 | Water-Soluble Polymer (c) | 15 |
| High-sensitivity, Magenta Color-Forming Layer | Lime-Treated Gelatin | 781 | Lime-Treated Gelatin | 781 |
| | Emulsion Dg (Amount of Silver) | 488 | Emulsion Dg (Amount of Silver) | 488 |
| | Silver Benzotriazole (Amount of Silver) | 146 | Silver Benzotriazole (Amount of Silver) | 146 |
| | Silver Salt of 1-Phenyl-5-Mercaptotetrazole | 388 | 1-Dodecyl-5-Mercaptotetrazole | 11 |
| | Magenta Coupler (CPM-1) | 47 | Magenta Coupler (CPM-1) | 47 |
| | Magenta Coupler (CPM-2) | 24 | Magenta Coupler (CPM-2) | 24 |
| | DEV (1)/(2) | 74 | DEV (1)/(2) | 74 |
| | Development Accelerator (X) | 4.7 | Development Accelerator (X) | 4.7 |
| | High-boiling point organic solvent (e) | 75 | High-boiling point organic solvent (e) | 75 |
| | Surfactant (g) | 8 | Surfactant (g) | 8 |
| | Salicylanilide | 100 | Salicylanilide | 100 |
| | Water-Soluble Polymer (c) | 8 | Water-Soluble Polymer (c) | 8 |
| Medium-Sensitivity, Magenta Color-Forming Layer | Lime-Treated Gelatin | 659 | Lime-Treated Gelatin | 659 |
| | Emulsion B-4g (Amount of Silver) | 492 | Emulsion B-4g (Amount of Silver) | 492 |
| | Silver Benzotriazole (Amount of Silver) | 148 | Silver Benzotriazole (Amount of Silver) | 148 |
| | Silver Salt of 1-Phenyl-5-Mercaptotetrazole | 391 | 1-Dodecyl-5-Mercaptotetrazole | 11 |
| | Magenta Coupler (CPM-3) | 94 | Magenta Coupler (CPM-3) | 94 |
| | Magenta Coupler (CPM-2) | 48 | Magenta Coupler (CPM-2) | 48 |
| | DEV (1)/(2) | 140 | DEV (1)/(2) | 140 |
| | Development Accelerator (X) | 14.1 | Development Accelerator (X) | 14.1 |
| | High-boiling point organic solvent (e) | 150 | High-boiling point organic solvent (e) | 150 |
| | Surfactant (g) | 11 | Surfactant (g) | 11 |
| | Salicylanilide | 80 | Salicylanilide | 80 |
| | Water-Soluble Polymer (c) | 14 | Water-Soluble Polymer (c) | 14 |
| Low-sensitivity, Magenta Color-Forming Layer | Lime-Treated Gelatin | 711 | Lime-Treated Gelatin | 711 |
| | Emulsion B-3g (Amount of Silver) | 240 | Emulsion B-3g (Amount of Silver) | 240 |
| | Silver Benzotriazole (Amount of Silver) | 72 | Silver Benzotriazole (Amount of Silver) | 72 |
| | Silver Salt of 1-Phenyl-5-Mercaptotetrazole | 191 | 1-Dodecyl-5-Mercaptotetrazole | 5 |
| | Magenta Coupler (CPM-3) | 234 | Magenta Coupler (CPM-3) | 234 |
| | Magenta Coupler (CPM-2) | 119 | Magenta Coupler (CPM-2) | 119 |

TABLE 9-continued

| | | | | |
|---|---|---|---|---|
| | DEV (1)/(2) | 349 | DEV (1)/(2) | 349 |
| | Development Accelerator (X) | 35.3 | Development Accelerator (X) | 35.3 |
| | High-boiling point organic solvent (e) | 376 | High-boiling point organic solvent (e) | 376 |
| | Surfactant (g) | 29 | Surfactant (g) | 29 |
| | Salicylanilide | 80 | Salicylanilide | 80 |
| | Water-Soluble Polymer (c) | 14 | Water-Soluble Polymer (c) | 14 |
| Intermediate Layer (Magenta Filter Layer) | Lime-Treated Gelatin | 850 | Lime-Treated Gelatin | 850 |
| | Surfactant (g) | 15 | Surfactant (g) | 15 |
| | Surfactant (h) | 24 | Surfactant (h) | 24 |
| | Stearyl Alcohol | 300 | Stearyl Alcohol | 300 |
| | Leuco Dye L2 | 75 | Leuco Dye L2 | 75 |
| | Developer (SD-1) | 75 | Developer (SD-1) | 75 |
| | Formalin Scavenger (d) | 300 | Formalin Scavenger (d) | 300 |
| | Water-Soluble Polymer (c) | 15 | Water-Soluble Polymer (c) | 15 |
| High-sensitivity, Cyan Color-Forming Layer | Lime-Treated Gelatin | 842 | Lime-Treated Gelatin | 842 |
| | Emulsion Dr (Amount of Silver) | 550 | Emulsion Dr (Amount of Silver) | 550 |
| | Silver Benzotriazole (Amount of Silver) | 165 | Silver Benzotriazole (Amount of Silver) | 165 |
| | Silver Salt of 1-Phenyl-5-Mercaptotetrazole | 437 | 1-Dodecyl-5-Mercaptotetrazole | 12 |
| | Cyan Coupler (CPC-1) | 19 | Cyan Coupler (CPC-1) | 19 |
| | Cyan Coupler (CPC-2) | 44 | Cyan Coupler (CPC-2) | 44 |
| | DEV (1)/(2) | 91 | DEV (1)/(2) | 91 |
| | Development Accelerator (X) | 6.2 | Development Accelerator (X) | 6.2 |
| | High-boiling point organic solvent (e) | 70 | High-boiling point organic solvent (e) | 70 |
| | Surfactant (g) | 5 | Surfactant (g) | 5 |
| | Salicylanilide | 80 | Salicylanilide | 80 |
| | Water-Soluble Polymer (c) | 18 | Water-Soluble Polymer (c) | 18 |
| Medium-Sensitivity, Cyan Color-Forming Layer | Lime-Treated Gelatin | 475 | Lime-Treated Gelatin | 475 |
| | Emulsion B-4r (Amount of Silver) | 600 | Emulsion B-4r (Amount of Silver) | 600 |
| | Silver Benzotriazole (Amount of Silver) | 180 | Silver Benzotriazole (Amount of Silver) | 180 |
| | Silver Salt of 1-Phenyl-5-Mercaptotetrazole | 477 | 1-Dodecyl-5-Mercaptotetrazole | 13 |
| | Cyan Coupler (CPC-3) | 56 | Cyan Coupler (CPC-3) | 56 |
| | Cyan Coupler (CPC-4) | 131 | Cyan Coupler (CPC-4) | 131 |
| | DEV (1)/(2) | 209 | DEV (1)/(2) | 209 |
| | Development Accelerator (X) | 18.7 | Development Accelerator (X) | 18.7 |
| | High-boiling point organic solvent (e) | 209 | High-boiling point organic solvent (e) | 209 |
| | Surfactant (g) | 10 | Surfactant (g) | 10 |
| | Salicylanilide | 50 | Salicylanilide | 50 |
| | Water-Soluble Polymer (c) | 15 | Water-Soluble Polymer (c) | 15 |
| Low-sensitivity, Cyan Color-Forming Layer | Lime-Treated Gelatin | 825 | Lime-Treated Gelatin | 825 |
| | Emulsion B-3r (Amount of Silver) | 300 | Emulsion B-3r (Amount of Silver) | 300 |
| | Silver | 90 | Silver | 90 |

TABLE 9-continued

| | | | | |
|---|---|---|---|---|
| | Benzotriazole (Amount of Silver) | | Benzotriazole (Amount of Silver) | |
| | Silver Salt of 1-Phenyl-5-Mercaptotetrazole | 239 | 1-Dodecyl-5-Mercaptotetrazole | 7 |
| | Cyan Coupler (CPC-3) | 99 | Cyan Coupler (CPC-3) | 99 |
| | Cyan Coupler (CPC-4) | 234 | Cyan Coupler (CPC-4) | 234 |
| | DEV (1)/(2) | 373 | DEV (1)/(2) | 373 |
| | Development Accelerator (X) | 33.2 | Development Accelerator (X) | 33.2 |
| | High-boiling point organic solvent (e) | 372 | High-boiling point organic solvent (e) | 372 |
| | Surfactant (g) | 17 | Surfactant (g) | 17 |
| | Salicylanilide | 100 | Salicylanilide | 100 |
| | Water-Soluble Polymer (c) | 10 | Water-Soluble Polymer (c) | 10 |
| Antihalation Layer | Lime-Treated Gelatin | 440 | Lime-Treated Gelatin | 440 |
| | Surfactant (g) | 14 | Surfactant (g) | 14 |
| | Stearyl Alcohol | 2400 | Stearyl Alcohol | 2400 |
| | Leuco Dye L3 | 600 | Leuco Dye L3 | 600 |
| | Developer (SD-1) | 600 | Developer (SD-1) | 600 |
| | Surfactant (b) | 120 | Surfactant (b) | 120 |
| | Water-Soluble Polymer (c) | 15 | Water-Soluble Polymer (c) | 15 |
| Transparent PEN Substrate (96 mm) | | | | |

| Layer | Silver Halide Photosensitive Material 407 | mg/m$^2$ | Silver Halide Photosensitive Material 408 | mg/m$^2$ |
|---|---|---|---|---|
| Protective Layer | Lime-Treated Gelatin | 914 | Lime-Treated Gelatin | 914 |
| | Matting Agent (Silica) | 50 | Matting Agent (Silica) | 50 |
| | Surfactant (a) | 30 | Surfactant (a) | 30 |
| | Surfactant (b) | 40 | Surfactant (b) | 40 |
| | Water-Soluble Polymer (c) | 15 | Water-Soluble Polymer (c) | 15 |
| | Hardening Agent (t) | 110 | Hardening Agent (t) | 110 |
| Intermediate Layer | Lime-Treated Gelatin | 461 | Lime-Treated Gelatin | 461 |
| | Surfactant (b) | 5 | Surfactant (b) | 5 |
| | Salicylanilide | 200 | Salicylanilide | 200 |
| | Formalin Scavenger (d) | 150 | Formalin Scavenger (d) | 150 |
| | Water-Soluble Polymer (c) | 15 | Water-Soluble Polymer (c) | 15 |
| High-sensitivity, Yellow Color-Forming Layer | Lime-Treated Gelatin | 1750 | Lime-Treated Gelatin | 1750 |
| | Emulsion Db (Amount of Silver) | 550 | Emulsion Db (Amount of Silver) | 550 |
| | Silver Benzotriazole (Amount of Silver) | 165 | Silver Benzotriazole (Amount of Silver) | 165 |
| | Silver Salt of 1-Phenyl-5-Mercaptotetrazole | 437 | 1-Dodecyl-5-Mercaptotetrazole | 12 |
| | Yellow Coupler (CPY-1) | 179 | Yellow Coupler (CPY-1) | 179 |
| | DEV (1)/(2) | 230 | DEV (1)/(2) | 230 |
| | Development Accelerator (X) | 17.9 | Development Accelerator (X) | 17.9 |
| | High-boiling point organic solvent (e) | 90 | High-boiling point organic solvent (e) | 90 |
| | High-boiling point organic solvent (f) | 115 | High-boiling point organic solvent (f) | 115 |
| | Surfactant (g) | 27 | Surfactant (g) | 27 |
| | Salicylanilide | 200 | Salicylanilide | 200 |

TABLE 9-continued

| | | | | |
|---|---|---|---|---|
| | Water-Soluble Polymer (c) | 1 | Water-Soluble Polymer (c) | 1 |
| Medium-Sensitivity, Yellow Color-Forming Layer | Lime-Treated Gelatin | 1470 | Lime-Treated Gelatin | 1470 |
| | Emulsion C-4b (Amount of Silver) | 263 | Emulsion C-4b (Amount of Silver) | 263 |
| | Silver Benzotriazole (Amount of Silver) | 79 | Silver Benzotriazole (Amount of Silver) | 79 |
| | Silver Salt of 1-Phenyl-5-Mercaptotetrazole | 209 | 1-Dodecyl-5-Mercaptotetrazole | 6 |
| | Yellow Coupler (CPY-2) | 269 | Yellow Coupler (CPY-2) | 269 |
| | DEV (1)/(2) | 380 | DEV (1)/(2) | 380 |
| | Development Accelerator (X) | 26.9 | Development Accelerator (X) | 26.9 |
| | High-boiling point organic solvent (e) | 134 | High-boiling point organic solvent (e) | 134 |
| | High-boiling point organic solvent (f) | 190 | High-boiling point organic solvent (f) | 190 |
| | Surfactant (g) | 26 | Surfactant (g) | 26 |
| | Salicylanilide | 300 | Salicylanilide | 300 |
| | Water-Soluble Polymer (c) | 2 | Water-Soluble Polymer (c) | 2 |
| Low-sensitivity, Yellow Color-Forming Layer | Lime-Treated Gelatin | 1680 | Lime-Treated Gelatin | 1680 |
| | Emulsion C-3b (Amount of Silver) | 240 | Emulsion C-3b (Amount of Silver) | 240 |
| | Silver Benzotriazole (Amount of Silver) | 72 | Silver Benzotriazole (Amount of Silver) | 72 |
| | Silver Salt of 1-Phenyl-5-Mercaptotetrazole | 191 | 1-Dodecyl-5-Mercaptotetrazole | 5 |
| | Yellow Coupler (CPY-2) | 448 | Yellow Coupler (CPY-2) | 448 |
| | DEV (1)/(2) | 590 | DEV (1)/(2) | 590 |
| | Development Accelerator (X) | 44.8 | Development Accelerator (X) | 44.8 |
| | High-boiling point organic solvent (e) | 224 | High-boiling point organic solvent (e) | 224 |
| | High-boiling point organic solvent (f) | 295 | High-boiling point organic solvent (f) | 295 |
| | Surfactant (g) | 30 | Surfactant (g) | 30 |
| | Salicylanilide | 600 | Salicylanilide | 600 |
| | Water-Soluble Polymer (c) | 3 | Water-Soluble Polymer (c) | 3 |
| Intermediate Layer (Yellow Filter Layer) | Lime-Treated Gelatin | 560 | Lime-Treated Gelatin | 560 |
| | Surfactant (b) | 15 | Surfactant (b) | 15 |
| | Surfactant (g) | 60 | Surfactant (g) | 60 |
| | Stearyl Alcohol | 1200 | Stearyl Alcohol | 1200 |
| | Leuco Dye L1 | 300 | Leuco Dye L1 | 300 |
| | Developer (SD-1) | 300 | Developer (SD-1) | 300 |
| | Water-Soluble Polymer (c) | 15 | Water-Soluble Polymer (c) | 15 |
| High-sensitivity, Magenta Color-Forming Layer | Lime-Treated Gelatin | 781 | Lime-Treated Gelatin | 781 |
| | Emulsion Dg (Amount of Silver) | 488 | Emulsion Dg (Amount of Silver) | 488 |
| | Silver Benzotriazole (Amount of Silver) | 146 | Silver Benzotriazole (Amount of Silver) | 146 |
| | Silver Salt of 1-Phenyl-5-Mercaptotetrazole | 388 | 1-Dodecyl-5-Mercaptotetrazole | 11 |
| | Magenta Coupler (CPM-1) | 47 | Magenta Coupler (CPM-1) | 47 |

TABLE 9-continued

| | | | | |
|---|---|---|---|---|
| | Magenta Coupler (CPM-2) | 24 | Magenta Coupler (CPM-2) | 24 |
| | DEV (1)/(2) | 74 | DEV (1)/(2) | 74 |
| | Development Accelerator (X) | 4.7 | Development Accelerator (X) | 4.7 |
| | High-boiling point organic solvent (e) | 75 | High-boiling point organic solvent (e) | 75 |
| | Surfactant (g) | 8 | Surfactant (g) | 8 |
| | Salicylanilide | 100 | Salicylanilide | 100 |
| | Water-Soluble Polymer (c) | 8 | Water-Soluble Polymer (c) | 8 |
| Medium-Sensitivity, Magenta Color-Forming Layer | Lime-Treated Gelatin | 659 | Lime-Treated Gelatin | 659 |
| | Emulsion C-4g (Amount of Silver) | 492 | Emulsion C-4g (Amount of Silver) | 492 |
| | Silver Benzotriazole (Amount of Silver) | 148 | Silver Benzotriazole (Amount of Silver) | 148 |
| | Silver Salt of 1-Phenyl-5-Mercaptotetrazole | 391 | 1-Dodecyl-5-Mercaptotetrazole | 11 |
| | Magenta Coupler (CPM-3) | 94 | Magenta Coupler (CPM-3) | 94 |
| | Magenta Coupler (CPM-2) | 48 | Magenta Coupler (CPM-2) | 48 |
| | DEV (1)/(2) | 140 | DEV (1)/(2) | 140 |
| | Development Accelerator (X) | 14.1 | Development Accelerator (X) | 14.1 |
| | High-boiling point organic solvent (e) | 150 | High-boiling point organic solvent (e) | 150 |
| | Surfactant (g) | 11 | Surfactant (g) | 11 |
| | Salicylanilide | 80 | Salicylanilide | 80 |
| | Water-Soluble Polymer (c) | 14 | Water-Soluble Polymer (c) | 14 |
| Low-sensitivity, Magenta Color-Forming Layer | Lime-Treated Gelatin | 711 | Lime-Treated Gelatin | 711 |
| | Emulsion C-3g (Amount of Silver) | 240 | Emulsion C-3g (Amount of Silver) | 240 |
| | Silver Benzotriazole (Amount of Silver) | 72 | Silver Benzotriazole (Amount of Silver) | 72 |
| | Silver Salt of 1-Phenyl-5-Mercaptotetrazole | 191 | 1-Dodecyl-5-Mercaptotetrazole | 5 |
| | Magenta Coupler (CPM-3) | 234 | Magenta Coupler (CPM-3) | 234 |
| | Magenta Coupler (CPM-2) | 119 | Magenta Coupler (CPM-2) | 119 |
| | DEV (1)/(2) | 349 | DEV (1)/(2) | 349 |
| | Development Accelerator (X) | 35.3 | Development Accelerator (X) | 35.3 |
| | High-boiling point organic solvent (e) | 376 | High-boiling point organic solvent (e) | 376 |
| | Surfactant (g) | 29 | Surfactant (g) | 29 |
| | Salicylanilide | 80 | Salicylanilide | 80 |
| | Water-Soluble Polymer (c) | 14 | Water-Soluble Polymer (c) | 14 |
| Intermediate Layer (Magenta Filter Layer) | Lime-Treated Gelatin | 850 | Lime-Treated Gelatin | 850 |
| | Surfactant (g) | 15 | Surfactant (g) | 15 |
| | Surfactant (h) | 24 | Surfactant (h) | 24 |
| | Stearyl Alcohol | 300 | Stearyl Alcohol | 300 |
| | Leuco Dye L2 | 75 | Leuco Dye L2 | 75 |
| | Developer (SD-1) | 75 | Developer (SD-1) | 75 |
| | Formalin Scavenger (d) | 300 | Formalin Scavenger (d) | 300 |
| | Water-Soluble Polymer (c) | 15 | Water-Soluble Polymer (c) | 15 |
| High-sensitivity, Cyan Color-Forming Layer | Lime-Treated Gelatin | 842 | Lime-Treated Gelatin | 842 |
| | Emulsion Dr (Amount of Silver) | 550 | Emulsion Dr (Amount of Silver) | 550 |
| | Silver Benzotriazole (Amount of Silver) | 165 | Silver Benzotriazole (Amount of Silver) | 165 |
| | Silver Salt of 1-Phenyl-5-Mercaptotetrazole | 437 | 1-Dodecyl-5-Mercaptotetrazole | 12 |
| | Cyan Coupler (CPC-1) | 19 | Cyan Coupler (CPC-1) | 19 |
| | Cyan Coupler (CPC-2) | 44 | Cyan Coupler (CPC-2) | 44 |
| | DEV (1)/(2) | 91 | DEV (1)/(2) | 91 |
| | Development Accelerator (X) | 6.2 | Development Accelerator (X) | 6.2 |
| | High-boiling point organic solvent (e) | 70 | High-boiling point organic solvent (e) | 70 |
| | Surfactant (g) | 5 | Surfactant (g) | 5 |
| | Salicylanilide | 80 | Salicylanilide | 80 |
| | Water-Soluble Polymer (c) | 18 | Water-Soluble Polymer (c) | 18 |
| Medium-Sensitivity, Cyan Color-Forming Layer | Lime-Treated Gelatin | 475 | Lime-Treated Gelatin | 475 |
| | Emulsion C-4r (Amount of Silver) | 600 | Emulsion C-4r (Amount of Silver) | 600 |
| | Silver Benzotriazole (Amount of Silver) | 180 | Silver Benzotriazole (Amount of Silver) | 180 |
| | Silver Salt of 1-Phenyl-5-Mercaptotetrazole | 477 | 1-Dodecyl-5-Mercaptotetrazole | 13 |
| | Cyan Coupler (CPC-3) | 56 | Cyan Coupler (CPC-3) | 56 |
| | Cyan Coupler (CPC-4) | 131 | Cyan Coupler (CPC-4) | 131 |
| | DEV (1)/(2) | 209 | DEV (1)/(2) | 209 |
| | Development Accelerator (X) | 18.7 | Development Accelerator (X) | 18.7 |
| | High-boiling point organic solvent (e) | 209 | High-boiling point organic solvent (e) | 209 |
| | Surfactant (g) | 10 | Surfactant (g) | 10 |
| | Salicylanilide | 50 | Salicylanilide | 50 |
| | Water-Soluble Polymer (c) | 15 | Water-Soluble Polymer (c) | 15 |
| Low-sensitivity, Cyan Color-Forming Layer | Lime-Treated Gelatin | 825 | Lime-Treated Gelatin | 825 |
| | Emulsion C-3r (Amount of Silver) | 300 | Emulsion C-3r (Amount of Silver) | 300 |
| | Silver Benzotriazole (Amount of Silver) | 90 | Silver Benzotriazole (Amount of Silver) | 90 |
| | Silver Salt of 1-Phenyl-5-Mercaptotetrazole | 239 | 1-Dodecyl-5-Mercaptotetrazole | 7 |
| | Cyan Coupler (CPC-3) | 99 | Cyan Coupler (CPC-3) | 99 |
| | Cyan Coupler (CPC-4) | 234 | Cyan Coupler (CPC-4) | 234 |
| | DEV (1)/(2) | 373 | DEV (1)/(2) | 373 |
| | Development Accelerator (X) | 33.2 | Development Accelerator (X) | 33.2 |
| | High-boiling point organic solvent (e) | 372 | High-boiling point organic solvent (e) | 372 |
| | Surfactant (g) | 17 | Surfactant (g) | 17 |
| | Salicylanilide | 100 | Salicylanilide | 100 |
| | Water-Soluble Polymer (c) | 10 | Water-Soluble Polymer (c) | 10 |
| Antihalation Layer | Lime-Treated Gelatin | 440 | Lime-Treated Gelatin | 440 |
| | Surfactant (g) | 14 | Surfactant (g) | 14 |
| | Stearyl Alcohol | 2400 | Stearyl Alcohol | 2400 |

TABLE 9-continued

| | | | |
|---|---|---|---|
| Leuco Dye L3 | 600 | Leuco Dye L3 | 600 |
| Developer (SD-1) | 600 | Developer (SD-1) | 600 |
| Surfactant (b) | 120 | Surfactant (b) | 120 |
| Water-Soluble Polymer (c) | 15 | Water-Soluble Polymer (c) | 15 |
| Transparent PEN Substrate (96 mm) | | | |

Surfactant (a)

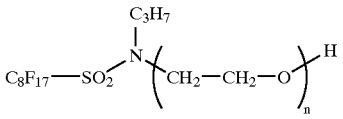

n = 14–16

Surfactant (b)

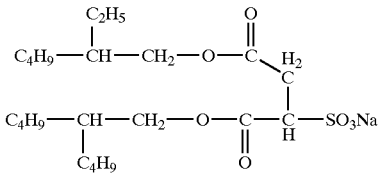

Water-Soluble Polymer (c)

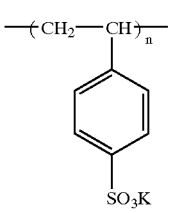

Hardening Agent (t)

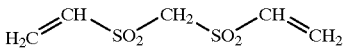

Formalin Scavenger (d)

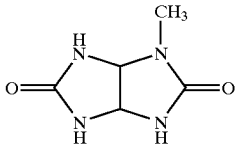

Surfactant (g)

Alkanol XC

2. Evaluation

A sample was cut from each of the silver halide photosensitive materials 401 to 408 and exposed to a white light of 500 lux for 1/100 second through a continuous optical wedge, according to a method for obtaining ISO sensitivity (ANSI PH2.27). After the exposure, each sample was heated at 150° C. for 20 seconds by a heat drum for thermal development, Each of the silver halide photosensitive materials 401 to 408 was then cut to a 135-negative-film size, punched and incorporated into a camera to take pictures of a human being and Macbeth chart. Image formed on each thermally developed, silver halide photosensitive material was read by a digital image-reading device "Frontier SP-1000" manufactured by Fuji Photo Film Co., Ltd., subjected to image processing by a workstation, and output by a thermal development printer "PICTROGRAPHY 3000" manufactured by Fuji Photo Film Co., Ltd. The image was read with warm wind sent to the surface of the silver halide photosensitive material by a dryer, such that the surface temperature was kept at 60 to 70° C. The image was subjected to color correction for increasing chroma with color reproduction maintained by digital signal processing using a Macbeth chart, to provide the printed image with high chroma. The printed image had excellent sharpness.

The comparative silver halide photosensitive materials 409 and 410 were evaluated in the same manner as in the silver halide photosensitive materials 401 to 408. The silver halide photosensitive materials 409 and 410 were lower in sensitivity and higher in minimum density than the silver halide photosensitive materials 401 to 408, proving the advantages of the silver halide photosensitive materials of the present invention over those conventional ones.

With respect to each silver halide photosensitive material, the ISO sensitivity and the minimum density after the development are shown in Tables 10 and 11.

TABLE 10

| Photosensitive Material | | 401 | 402 | 403 | 404 | 405 | 406 | 407 | 408 |
|---|---|---|---|---|---|---|---|---|---|
| ISO Sensitivity | | 435 | 415 | 405 | 390 | 690 | 680 | 660 | 645 |
| Minimum Density after Treatment | B | 0.53 | 0.46 | 0.52 | 0.44 | 0.75 | 0.67 | 0.73 | 0.65 |
| | G | 0.55 | 0.47 | 0.54 | 0.45 | 0.64 | 0.56 | 0.63 | 0.53 |
| | R | 0.59 | 0.52 | 0.57 | 0.50 | 0.63 | 0.55 | 0.62 | 0.54 |

TABLE 11

| Photosensitive Material | 409 | 410 |
|---|---|---|
| ISO Sensitivity | 575 | 550 |
| Minimum Density after Treatment | | |
| B | 1.07 | 1.01 |
| G | 0.98 | 0.95 |
| R | 0.79 | 0.77 |

As described above in detail, the first silver halide photosensitive material of the present invention using high-silver chloride tabular grains is high in sensitivity, and capable of providing a sufficiently low minimum density simply by thermal development and thus producing a high-quality image by a scanner.

The silver halide photosensitive material comprising a silver salt of 1-phenyl-5-mercaptotetrazole or 1-alkyl-5-mercaptotetrazole can provide excellent discrimination with reduced fogging.

The second silver halide photosensitive material of the present invention using tabular grains satisfying the conditions of the equation (1) as a highest-sensitivity emulsion exhibits remarkable sensitivity with sufficiently low minimum density.

Applicants hereby incorporate by reference the entire subject matter of the foreign priority documents from which benefit is claimed, 2001-217314 and 2001-154549.

What is claimed is:

1. A silver halide photosensitive material comprising a substrate and at least one photosensitive silver halide emulsion layer formed thereon, wherein said photosensitive silver halide emulsion layer comprises a silver halide emulsion comprising silver halide grains, a silver salt of a benzotriazole compound, a mercaptotetrazole compound and a reducing agent, a silver chloride content of said silver halide grains being 50 mole % or more, a molar ratio of said silver salt of a benzotriazole compound to said silver halide grains being 1 mole % or more, and a molar ratio of said mercaptotetrazole compound to said silver halide grains being 0.1 mole % or more, wherein said mercaptotetrazole compound is 1-alkyl-5-mercaptotetrazole.

2. The silver halide photosensitive material according to claim 1, wherein at least 50% of a projected area of said silver halide grains is occupied by tabular silver halide grains having an average thickness of 0.2 $\mu$m or less and a major crystal face of (111).

3. The silver halide photosensitive material according to claim 1, wherein at least 50% of a projected area of said silver halide grains is occupied by tabular silver halide grains having an average thickness of 0.2 μm or less and a major crystal face of (100).

4. The silver halide photosensitive material according to claim 1, wherein said silver halide grains are chemically sensitized by a tellurium compound.

5. The silver halide photosensitive material according to claim 1, wherein said benzotriazole compound has an alkyl group having 1 to 12 carbon atoms.

6. A method for forming an image comprising the steps of exposing the silver halide photosensitive material according to claim 1; and heating the exposed silver halide photosensitive material at 100 to 200° C. for 5 to 60 seconds to form an image thereon.

7. The method for forming an image according to claim 6, wherein said image formed on said silver halide photosensitive material is optically read to produce a digital image information.

8. A silver halide photosensitive material comprising a substrate and at least one photosensitive silver halide emulsion layer formed thereon, wherein said silver halide photosensitive material comprises at least two types of silver halide grains with different projected areas having photosensitivity in the same spectral range; silver halide grains having a larger projected area having a refractive index n1 and an average thickness a, and silver halide grains having a smaller projected area having a refractive index n2 and an average thickness b among said at least two types of silver halide grains;

and said silver halide grains satisfying the conditions defined by the following equations (1a) and (1b):

$$\text{if } n2<n1, \text{ then } a \leqq b\times(n2/n1) \quad (1a)$$

$$\text{if } n2=n1, \text{ then } a<b \quad (1b).$$

9. The silver halide photosensitive material according to claim 8, wherein at least 50% of the projected area of each of said at least two silver halide grains is occupied by tabular silver halide grains having an average aspect ratio of 5 or more and an average thickness of 0.2 μm or less.

10. The silver halide photosensitive material according to claim 8, wherein said silver halide grains satisfy the condition defined by the following equation (2):

$$a \leqq b\times(n2/n1)^6 \quad (2).$$

11. The silver halide photosensitive material according to claim 8, wherein said n2 is 2.15 or less.

12. The silver halide photosensitive material according to claim 8, wherein said at least two types of silver halide grains are contained in different layers.

13. The silver halide photosensitive material according to claim 8, wherein said silver halide grains having a smaller projected area are tabular silver halide grains having a major crystal face of (100) and an average aspect ratio of 5 or more.

14. The silver halide photosensitive material according to claim 8, wherein said silver halide grains having a smaller projected area are tabular silver halide grains having a major crystal face of (111) and an average aspect ratio of 5 or more.

15. The silver halide photosensitive material according to claim 8, wherein said silver halide photosensitive material further comprises a reducing agent and a silver source that can be reduced by said reducing agent.

16. The silver halide photosensitive material according to claim 15, wherein said silver halide photosensitive material further comprises a compound that forms a dye by a coupling reaction with an oxidation product of said reducing agent.

17. The silver halide photosensitive material according to claim 8, wherein n2<n1.

18. A method for forming an image comprising the steps of exposing the silver halide photosensitive material according to claim 8; and heating the exposed silver halide photosensitive material at 100 to 200° C. for 5 to 60 seconds to form an image thereon.

19. The method for forming an image according to claim 18, wherein said image formed on said silver halide photosensitive material is optically read to produce a digital image information.

20. A complete dry-processing, mono-sheet-type, silver halide color photosensitive material comprising photograph-constituting layers comprising at least one photosensitive silver halide emulsion layer comprising a photosensitive silver halide and a substrate, wherein said photograph-constituting layers comprise a silver salt of a benzotriazole compound, a thermal solvent, a 1-alkyl-5-mercaptotetrazole compound, where alkyl represents an alkyl group having 6 to 12 carbon atoms, a developing agent, a compound that forms a dye by a coupling reaction with an oxidation product of said developing agent (a coupler) and a binder, a silver chloride content of said photosensitive silver halide being 50 mole % or more.

21. The complete dry-processing, mono-sheet type, silver halide color photosensitive material according to claim 20, wherein said photosensitive silver halide emulsion layer contains tabular silver halide grains comprising said photosensitive silver halide, and an average thickness of said tabular silver halide grains is 0.2 μm or less.

22. The complete dry-processing, mono-sheet type, silver halide color photosensitive material according to claim 21, wherein said tabular silver halide grains have a major crystal face of (111).

23. The complete dry-processing, mono-sheet type, silver halide color photosensitive material according to claim 21, wherein said tabular silver halide grains have a major crystal face of (100).

24. The complete dry-processing, mono-sheet type, silver halide color photosensitive material according to claim 20, wherein said photosensitive silver halide is chemically sensitized by a tellurium compound.

25. The complete dry-processing, mono-sheet type, silver halide color photosensitive material according to claim 20, wherein said silver salt of a benzotriazole compound has an alkyl group having 1 to 12 carbon atoms.

26. The complete dry-processing, mono-sheet type, silver halide color photosensitive material of claim 20, capable of developing at a developing temperature of 100° C. or higher.

* * * * *